US007105809B2

(12) United States Patent
Wood et al.

(10) Patent No.: US 7,105,809 B2
(45) Date of Patent: Sep. 12, 2006

(54) MICROSTRUCTURED POLYMERIC SUBSTRATE

(75) Inventors: Kenneth B. Wood, Minneapolis, MN (US); Raymond P. Johnston, Lake Elmo, MN (US); Patricia M. Biessener, Maplewood, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 115 days.

(21) Appl. No.: 10/299,962

(22) Filed: Nov. 18, 2002

(65) Prior Publication Data

US 2004/0094705 A1 May 20, 2004

(51) Int. Cl.
*H01J 49/04* (2006.01)
*H01J 49/16* (2006.01)

(52) U.S. Cl. ..... 250/288
(58) Field of Classification Search ..... 250/288
See application file for complete search history.

(56) References Cited

U.S. PATENT DOCUMENTS 4,468,468 A * 8/1984 Benninghoven et al. .... 250/288
5,498,545 A * 3/1996 Vestal ..... 250/288
5,719,060 A 2/1998 Hutchens (Continued)

FOREIGN PATENT DOCUMENTS

| | | |
|---|---|---|
| DE | 3221681 | 6/1982 |
| WO | WO 01/46458 | 6/2001 |
| WO | WO 01/66820 | 9/2001 |
| WO | WO 01/68940 | 9/2001 |

OTHER PUBLICATIONS

Michael J. Dale, et al, Analytical Chemistry, vol. 68, No. 19, Oct. 1, 1996 "Graphite/Liquid Mixed Matrices for Laser Desorption/Ionization Mass Spectrometry".
Joseph D. Cuiffi, et al, Analytical Chemistry, vol. 73, No. 6, Mar. 15, 2001, "Desportion–Ionization Mass Spectrometry Using Deposited Nanostructured Silicon Films".
Gyorgy Marko–Varga et al, Electrophoresis 2001, 22, 3978–3983, "Disposable Polymeric High–Density Nanovial Arrays For Matrix Assisted Laser Desportion/Ionization–Time of Flight–Mass Spectrometry—1. Microstructure Development and Manufacturing". Oct. 2001.
Simon Ekstrom et al, Electrophoresis 2001, 22, 3984–3992, "Disposable Polymeric High–Density Nanovial Arrays For Matrix Assisted Laser Desportion/Ionization–Time of Flight–Mass Spectrometry—2. Biological Application". Oct. 2001.
Martin Schurenberg, et al, Analytical Chemistry, vol. 71, No. 1, Jan. 1, 1999, "Laser Desportion/Ionization Mass Spectrometry of Peptides and Proteins with Particle Suspension Matrixes".
Martin Schuerenberg, et al, Analytical Chemistry, vol. 72, No. 15, Aug. 1, 2000, "Prestructured MALDI–MS Sample Supports".
Pending U.S. Appl. No. 10/183,122, filed Jun. 25, 2002.
Pending U.S. Appl. No. 10/183,121, filed Jun. 25, 2002.

*Primary Examiner*—Jack I. Berman
(74) *Attorney, Agent, or Firm*—Stephen W. Buckingham

(57) ABSTRACT

Methods and apparatuses for the high-energy desorption/ionization of various compositions are disclosed. The methods and apparatuses of the invention generally utilize structured substrates, such as micro- and nano-structured films, optionally in combination with one or more surface coatings, to provide enhanced desorption of analytes. Such enhanced desorption is particularly useful in fields of analysis such as mass spectroscopy which use laser desorption of the substrate.

42 Claims, 56 Drawing Sheets

U.S. PATENT DOCUMENTS 5,795,648 A * 8/1998 Goel et al. ..... 428/336
5,854,486 A 12/1998 Dreyfus
5,859,431 A 1/1999 Cotrell et al.
5,882,496 A 3/1999 Northrup
5,894,063 A 4/1999 Hutchens
5,948,610 A 9/1999 Ho
6,020,208 A 2/2000 Hutchens
6,027,942 A 2/2000 Hutchens
6,111,251 A 8/2000 Hillenkamp
6,265,068 B1 7/2001 David
6,288,390 B1 9/2001 Siuzdak
2001/0051264 A1 12/2001 Mazurek
2002/0113859 A1 8/2002 Gaudiana
2003/0010908 A1 * 1/2003 Clark et al. ..... 250/288
2003/0148401 A1 * 8/2003 Agrawal et al. ..... 435/7.9

* cited by examiner

MICROSTRUCTURED POLYMERIC SUBSTRATE

FIELD OF THE INVENTION

The present invention is directed to a substrate for use in the retention and subsequent desorption of molecules. More specifically, the invention is directed to a substrate for using in receiving and releasing samples to be used in analytic processes, such as mass spectrometry.

BACKGROUND

Matrix-assisted laser desorption and ionization (MALDI) has developed into an important tool for the analysis of numerous compositions, especially complex biological materials. MALDI uses a chemical matrix to suspend and retain one or more analytes prior to subjecting the matrix and analytes to laser desorption and ionization, typically during mass spectrometry. Prior to the development of current organic matrices used in MALDI, it was difficult to ionize intact analyte molecules without molecular fragmentation.

Numerous matrices have been developed over the years to fulfill the poorly understood requirements for successful laser absorbtion and analyte ionization without fragmentation of the analyte. The use of these matrices has become important because they have permitted the analysis of organic compositions that would otherwise not be readily observable using laser desorption and ionization methods.

MALDI has been successfully used to identify peptides, proteins, synthetic polymers, oligonucleotides, carbohydrates, and other large molecules. Unfortunately, traditional MALDI has drawbacks for the analysis of many small molecules because signals from the chemical matrix interfere with signals from analyte molecules. FIGS. 1 and 2 show spectra of two common matrices, 2,5-Dihydroxybenzoic acid (DHBA) and Alpha Cyano-4-hydroxycinnamic acid (α-CHCA). These spectra show numerous peaks that potentially interfere with analysis of the mass spectra of other materials.

Chemical matrices have many other undesirable consequences besides signal interference. For example, matrices can complicate sample preparation, and the additional processing steps and materials risk the introduction of contaminants into the sample. Both the matrix and analyte must typically be dissolvable in the same solvent, further complicating sample preparation. The matrix can also make it more difficult to interface separation techniques, and inhomogeneous sample spots can lead to a sweet-spot phenomenon wherein higher amounts of analyte and matrix crystals aggregate along the perimeter of the sample drop, leading to reduced reproducibility of spectra.

The co-crystallization process of sample and matrix is also often harsh, risking the denaturation or aggregation of proteins. Additionally, it is not always clear which matrix is appropriate for a given sample. For example, matrices that are effective for peptides and proteins often do not work for oligonucleotides or polymers. Furthermore, different matrices may be required in the positive-ion detection mode and the negative-ion detection mode. Thus, an exhaustive trial and error search can be required to find the optimal matrix.

Another difficulty with MALDI is that the currently used desorption substrates are typically metal plates. These metal plates are expensive and they typically must be cleaned after use so that they can be reused. Cleaning the metal plates is time consuming and presents the possibility of carryover contamination, and also does not allow for using the substrate as a storage device for archiving the analyte samples for additional analysis. Therefore, a need exists for a method and apparatus for reducing or eliminating the need for matrices.

In 1999, a matrix-free method was described by Wei et al. in U.S. Pat. No. 6,288,390. Wei discloses the use of silicon wafers that have been electrochemically etched with an HF/ethanol solution under illumination and constant current. The sample, in solvent, is applied directly to the silicon without the addition of any matrix. This new method, labeled desorption/ionization on silicon (DIOS), allowed for the ionization of molecules within the mass range of 100 to 6000 Da without the interference caused by a matrix. Some spectra obtained using DIOS, however, have been difficult to reproduce, and the shelf life of the DIOS chips is often short. Also, DIOS chips are relatively expensive due to the high cost of the materials and processes used in their manufacture.

Therefore, a need remains for an apparatus and method that provides enhanced laser desorption in comparison to conventionally used techniques. There is also a need for an analyte desorption substrate that is sufficiently inexpensive so that it can be used and then discarded or archived.

SUMMARY OF THE INVENTION

The present invention is directed to apparatuses and methods for the high-energy desorption/ionization of various compositions. Methods of the invention utilize microstructured substrates, optionally in combination with one or more surface coatings, to provide enhanced desorption of analytes. Such enhanced desorption is particularly useful in fields of analysis such as mass spectroscopy. This enhanced desorption has various utilities. For example, use of the microstructured substrate may allow desorption to be performed without the use of chemical matrices. In some matrixless implementations, particularly when a small molecule (such as those with a molecular weight of less 1000) is being analyzed, the methods of the invention may achieve superior performance over that of conventional matrix based methods (for example, higher signal to noise ratios and/or better resolution).

Alternatively, the microstructured substrate may allow desorption to be performed in the presence of matrix, but with superior performance compared to standard matrix based methods using conventional desorption substrates. For example, using the microstructured substrate, an applied analyte/matrix droplet may dry in a more uniform manner than without a microstructured substrate. Also, in some implementations lower levels of matrix may be used, thereby reducing signal noise from the matrix. Such behavior is advantageous in allowing the use of automated sample deposition, location, and analysis. Also, use of the microstructured substrate may result in fewer ionic adducts (such as potassium and sodium) being formed, resulting in a simpler and easier to interpret spectrum.

The invention also includes structured substrates, such as micro- and nano-structured substrates, comprised of polymer materials such as polypropylene and polycarbonate films. These structured substrates receive and retain samples and are later used as desorption substrates. These structured substrates can have layers of nonvolatile materials coated onto their sample receiving surface, such as inorganic coatings including metals, metal oxides, and alloys, and organic (carbon containing) coatings including graphite, silicones, silane derivativess, diamond like glass (DLG), and parylene.

Specific implementations of the invention are directed to an article having a structured surface. The article contains a polymeric substrate with a plurality of microstructures, and in certain implementations a nonvolatile coating over at least a portion of the plurality of microstructures.

In some implementations the microstructured substrate comprises a thermoplastic material, which can be made from one or more of various polymers, such as polycarbonate and/or polypropylene. Also, the substrate can contain at least two layers, the layers comprising a first layer of a polymeric substrate, and a second layer of a nonvolatile material, the second layer positioned on top of the first layer to form an upper surface of the substrate; wherein the upper surface of the substrate comprises a plurality of microstructures. This second layer is also referred to herein as a coating, and can be formed using various methods, including lamination, electrodeposition, knife coating, etc. The microstructures may be formed in the substrate and then subsequently coated with the second layer. Alternatively, the substrate may be coated with the second layer, after which the microstructures are formed in the substrate. Or, in certain implementations the microstructures may be formed in the second layer itself.

The present invention also provides for a desorption substrate that is made from relatively inexpensive raw materials and can be economically produced such that it may be used and disposed of or alternatively used as a storage device for archiving analyte samples.

The methods and apparatuses of the invention have many applications including use in proteomics, which is the study of protein location, interaction, structure and function and seeks to identify and characterize the proteins present in both healthy and diseased biological samples. Other applications include DNA analysis, small molecule analysis, automated high throughput mass spectrometry, and combinations with separation techniques such as electrophoresis, immobilized affinity chromatography, or liquid chromatography.

Additional features and advantages of the invention will be apparent from the following detailed description of the invention and the claims. The above summary of principles of the disclosure is not intended to describe each illustrated embodiment or every implementation of the present disclosure. The detailed description that follows more particularly exemplifies certain embodiments utilizing the principles disclosed herein.

FIGURES

The invention will be more fully explained with reference to the following drawings.

Figure 1:
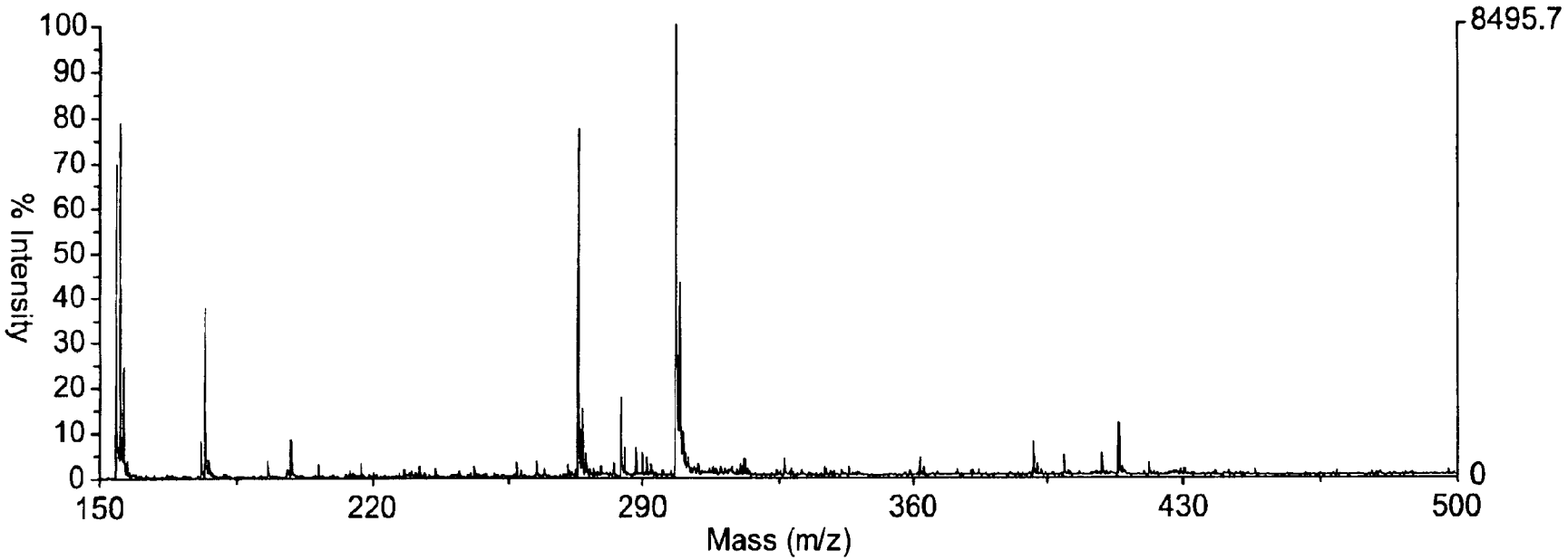
FIG. 1 is a mass spectrum of the matrix 2,5-dihydroxybenzoic acid (DHBA).
Figure 2:
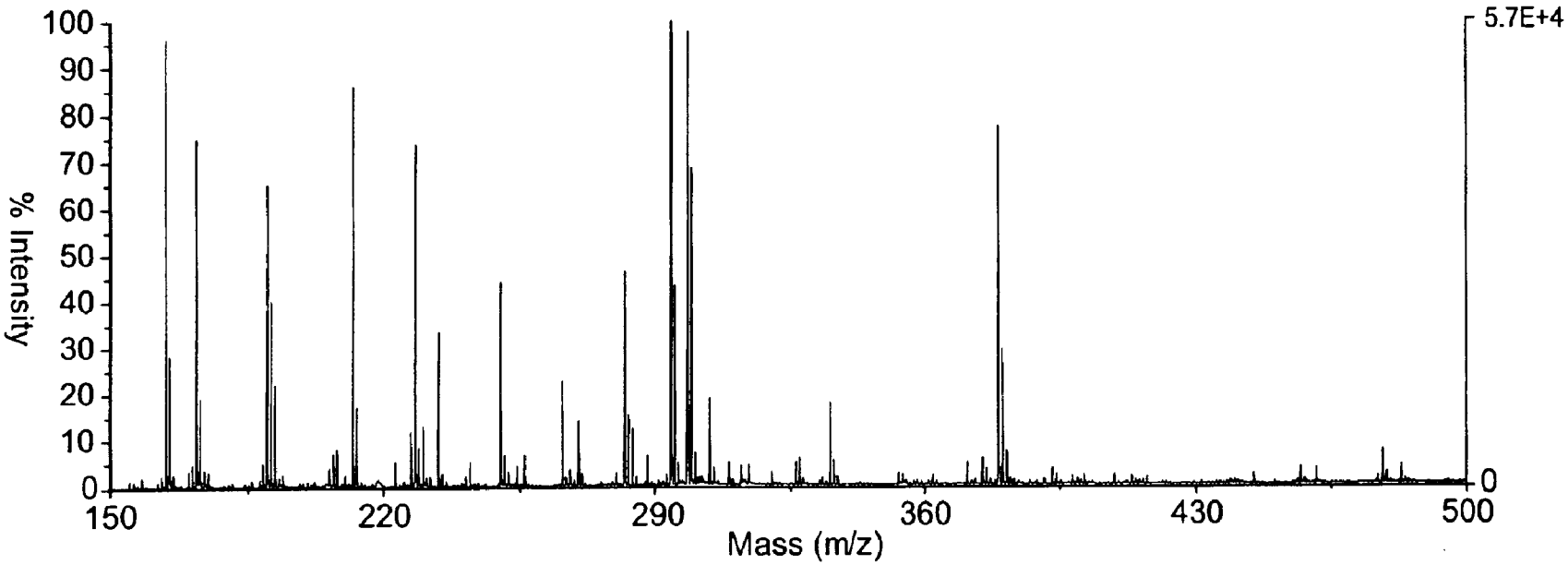
FIG. 2 is a mass spectrum of the matrix alpha cyano-4-hydroxy-cinnamic acid (α-CHCA).

While principles of the invention are amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the disclosure and claims.

DETAILED DESCRIPTION

A. General Configuration

The present invention is directed to methods and apparatuses for the analysis of various compositions, in particular those utilizing high-energy desorption/ionization of a sample. For example, laser desorption and ionization of samples for mass spectroscopy are suitable applications of the invention. The invention utilizes microstructured substrates, such as micro- and nano-structured polypropylene and polycarbonate films, as desorption substrates. These structured substrates can include films with nonvolatile layers coated onto their sample receiving surface, such as inorganic coatings including metals, metal oxides, and alloys, and organic (carbon containing) coatings including graphite, silicones, silane derivatives, diamond like glass (DLG), and parylene. Substrates made in accordance with the present invention are typically structured in a manner such that they promote desorption of a sample more effectively than non-structured substrates. The structured substrate serves to achieve, promote or enhance useful desorption and ionization without fragmentation. In addition to providing analyses without the complications of signal due to the matrix, in some implementations, such as when a small molecule is being analyzed, the methods of the invention may achieve superior performance (as manifested by, for example, higher signal to noise values) compared to traditional methods and devices.

Various aspects of the invention, including surface structure and topology, coating compositions, substrate materials and other aspects of the invention will now be described in greater detail.

B. Microstructured Surface

Substrates made in accordance with the invention typically have a microstructured surface, and in some cases a microstructured or nano-structured surface. For the purposes of this invention, microstructured films are those that have a desirable surface topography (i.e., are non-planar) on at least one surface. Microstructures include configurations of features wherein at least two dimensions of the features are microscopic, as described in U.S. Patent Application Publication US 2001/0051264 A1, incorporated herein by reference in its entirety. In this context, "microscopic" refers to features that are sufficiently small so as to require an optic aid to the naked eye to determine their shape.

In some example implementations, microstructured films can be defined for the purpose of this invention as those with physical feature sizes in the range of two hundred microns or less in at least two of the three possible dimensions (in/out of the plane of the film, and in each direction along the plane of the film). Within these general guidelines, films of this invention can be more specifically characterized as those that exhibit surface features with a desirable characteristic size (such as length measured along any dimension) and feature density (features per unit area of film surface). A feature, in this context, can be anything that represents a departure or deviation from a flat planar surface. Features can include those that protrude (nodules, posts, lumps, ridges, for example), or those which are recessed (holes, pits, fissures, crevices, for example). The microstructured surface may also possess a combination of protruding and recessed features (for example, furrows and ridges, protruding and recessed pyramids). In the case of ridges, furrows, or intersecting planes, a "feature" may be a corner or linear intersection of such ridges, furrows or planes.

A feature may be such that its characteristic length in all three dimensions (i.e. into and out of the plane of the film, and in each orthogonal direction along the plane of the film) is similar. Conversely, a feature may be such that the characteristic length in one or more directions is somewhat longer, or even much longer, than in the other directions (for example, in the case of features such as ridges or furrows.)

In some implementations of the invention, microstructured features include those possessing a maximum characteristic length in one or more directions of two hundred microns. In some implementations, the maximum characteristic length is fifty microns, while in yet other implementations; the characteristic length is less than ten microns. In some implementations the microstructured fims include those possessing a minimum characteristic length in one or more directions of one one nanometer. In other implementations the minimum characteristic length is ten nanometers, while in yet other implementations the minimum characteristic length is one hundred nanometers. Also, in some implementations, microstructured feature densities which are preferable are those in the range of 100 features or greater per square mm of film. More preferable are those that possess features at a density of greater than 1000 per square mm. Most preferable still are those that possess features at a density of greater than 10000 per square mm.

Figure 4:
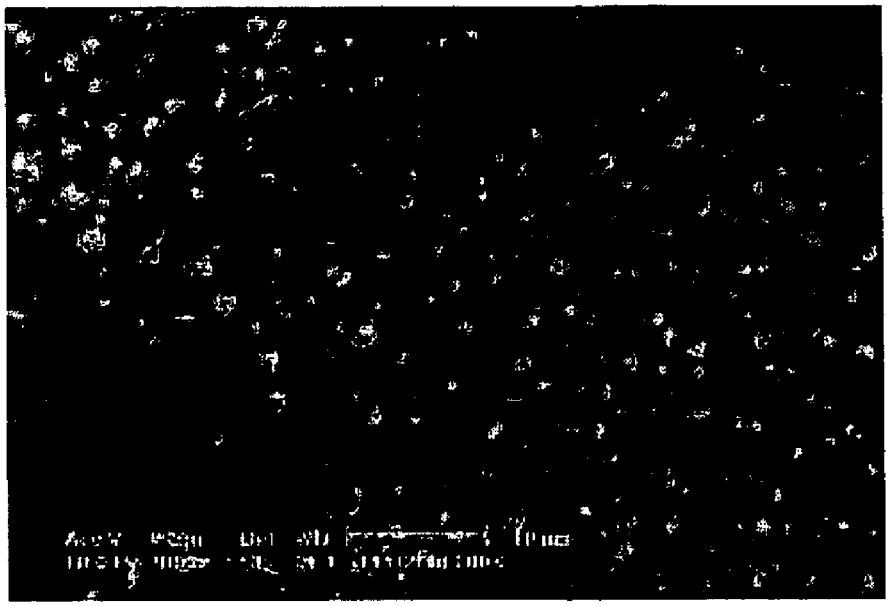
FIG. 4 is a scanning electron micrograph of a first microstructured substrate manufactured in accordance with the invention.
Figure 5:
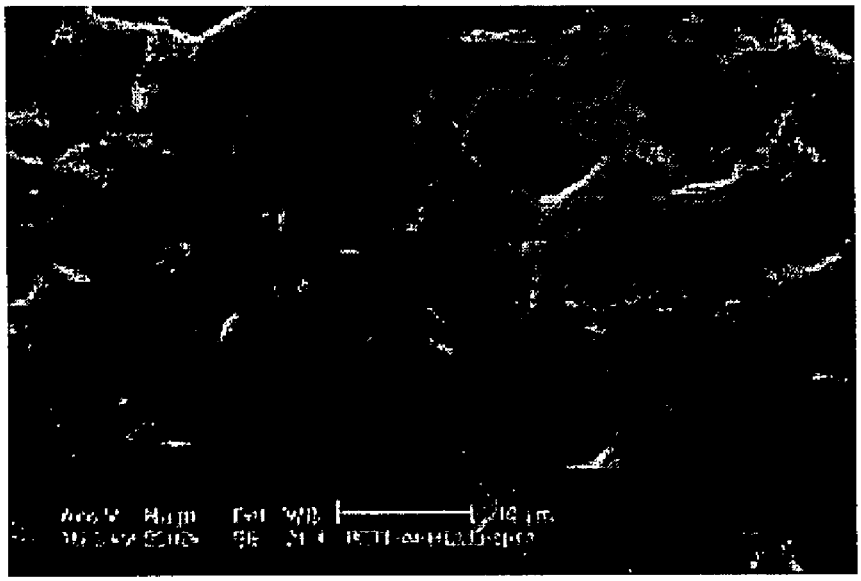
FIG. 5 is a scanning electron micrograph of a second microstructured substrate manufactured in accordance with the invention.
Figure 6:
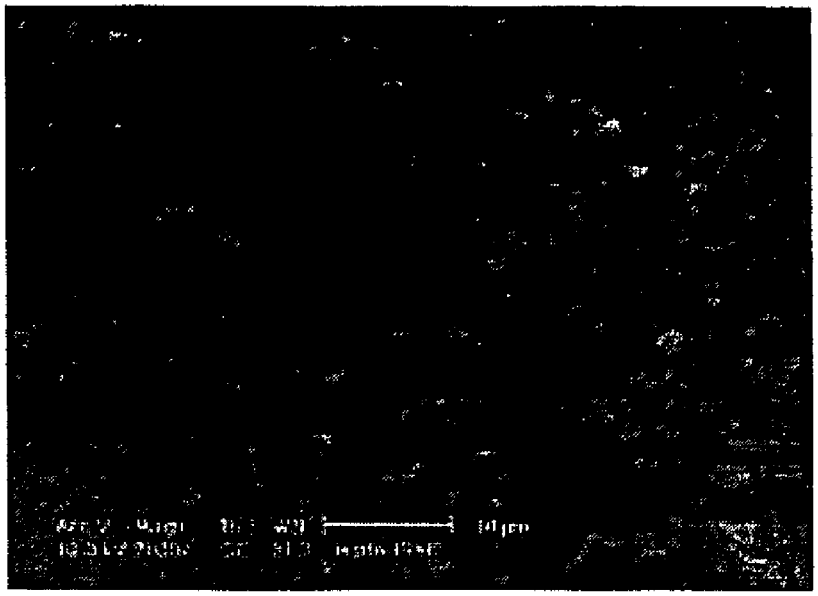
FIG. 6 is a scanning electron micrograph of a third microstructured substrate manufactured in accordance with the invention.
Figure 7:
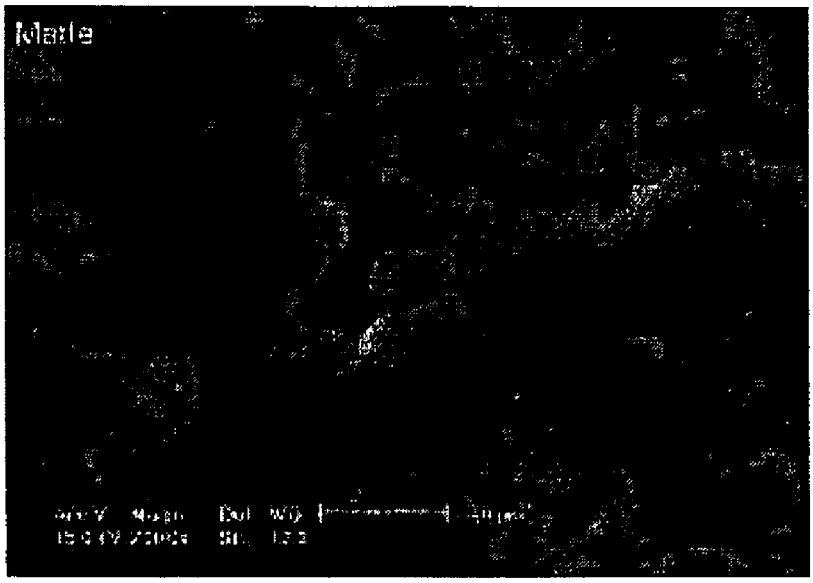
FIG. 7 is a scanning electron micrograph of a fourth microstructured substrate manufactured in accordance with the invention.

Examples of microstructured substrates according to the present invention are shown in the scanning electron micrographs of FIGS. 4, 5, 6, 7 and 8. The first structure, designated as TYPE A, is depicted in FIG. 4, and exhibits features in the size range of hundreds of nanometers to a few microns. The second structure, referred to as TYPE B, exhibits features in the size range of several microns, and is depicted in FIG. 5. The third structure, depicted in FIG. 6, is a so-called matte finish polypropylene film which exhibits features in the size range of several hundred nanometers to a few microns. The fourth structure, depicted in FIG. 7, is another matte finish polypropylene film which exhibits features in the size range of several microns.

Figure 8:
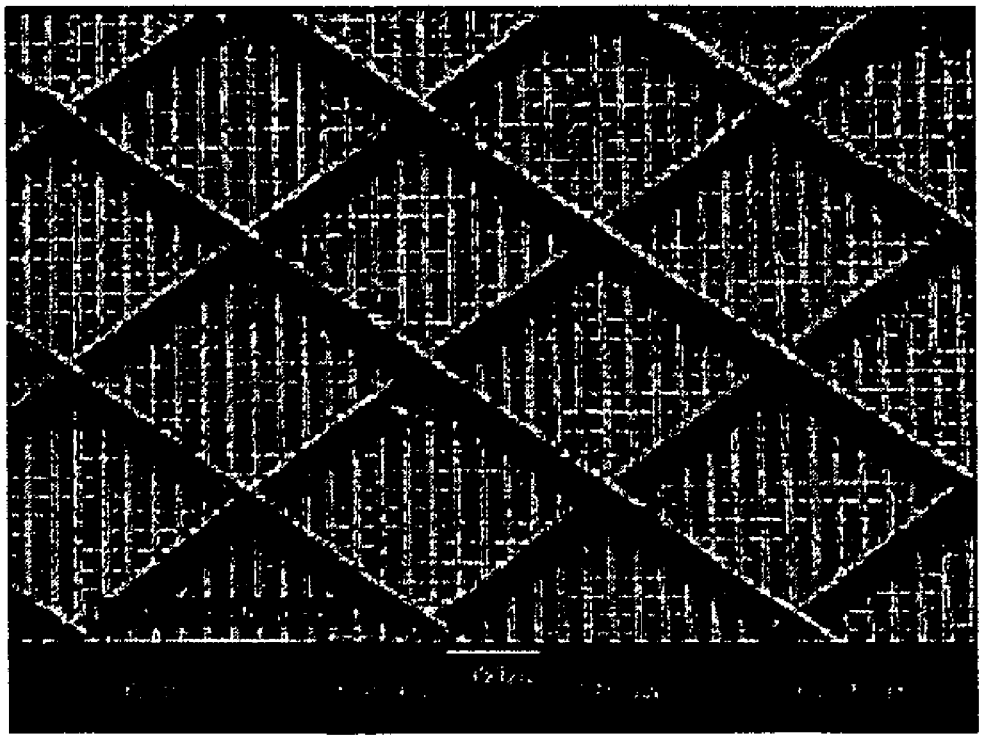
FIG. 8 is a scanning electron micrograph of a fifth microstructured substrate manufactured in accordance with the invention.

Smaller scale features can be superimposed upon larger scale features, as shown for example in FIG. 8. The fine and large scale features may both serve to provide enhanced desorption, or in some cases the fine and large scale features may perform different functions. For example, the larger scale features can serve to demarcate a particular area for sample placement, may serve as physical barriers to confine a deposited sample within a desired area, or may serve as reinforcing ribs to impart greater strength and stiffness to the film.

The features may be present on a regular repeating basis, such as in the structure of FIG. 8, or they may be "random" such as in the structures of FIGS. 4, 5, 6 and 7. The features may be present over the entire area of the film, or may be present only in areas in which sample is to be deposited.

Microstructured films of the invention are typically produced by placing a formable precursor (such as a liquid) in contact with a mold bearing the negative topology (opposite) of the desired structure, then allowing the precursor to solidify into a solid film bearing the desired structure. One such method is to provide the film precursor in the form of molten plastic which is allowed to cool to solidification while in contact with the mold. This extrusion/embossing method allows the use of materials that are less subject to contamination and disadvantageous byproducts than some prior substrates. An alternative method is to utilize an existing film, heat it to the point of softening, bring it into contact with a mold, and allow it to cool (embossing). An alternative method is to bring an existing film into contact with a mold and conform the film surface to the mold by means of pressure (calendaring). Yet another alternative method is to provide the film precursor in the form of a liquid syrup consisting of curable, polymerizable or crosslinkable molecules, which are then cured while in contact with the mold.

Films can be prepared bearing features of characteristic length and density as desired, the features being determined by the mold utilized. In extrusion embossing, the mold is typically in the form of a cylinder (roll) or belt. Utilization of cylinders or belts with various topographies can provide films with varying microstructures. For example, extrusion of molten polymer onto an extremely smooth surface (such as polished metal rolls which are commonly used in extrusion) will usually result in a film that is smooth, glossy and essentially featureless and unstructured for the purposes of this invention. Extrusion onto a mold which has had no particular surface modification to make it extremely smooth (for example matte finish metal rolls or belts) will provide a film that has a microstructured topography in comparison to the smooth film. Such films can provide enhancement in some analyte desorption cases.

Extrusion onto a molds which are rough (for example, cloth or fabric-covered rolls), or molds that have been subjected to deliberate roughening treatment (for example, a roll or belt which has been sandblasted, abraded, etched, etc.) will also provide a film with more microstructured topography in comparison to the smooth film. Extrusion onto molds that have been designed to provide film specifically engineered for the present application will provide a microstructured topography possessing the most advantageous combination of feature characteristic length and feature density. Such molds may be generated by a wide variety of methods, including physical abrasion, drilling, chemical milling, lithography, laser ablation, plasma treatment, engraving, chemical etching, reactive ion etching, chemical vapor deposition, physical vapor deposition, and electrochemical deposition. Such films are exemplified by the structures of FIGS. 4 and 5, and are generally the most useful for a wide variety of analytes as described in more detail in the examples.

In an alternative implementation, smooth, featureless films are processed to generate the desired features. For example, a smooth film may be abraded or modified by, for example, embossing, sandblasting, laser ablation, corona treatment, plasma treatment, or flame treatment, to impart features. In certain cases the smooth films may be coated, then treated to form the desired structure (for example via embossing or calendaring), as long as the structure forming process does not damage or adversely affect the coated layer.

In yet another implementation, it is also possible to coat the substrate with a coating that itself forms the features useful in the present invention. For example, an aluminum layer might be deposited in the form of nodules or granules, rather than as a smooth layer. It is also possible to apply a coating to the film that serves to provide the features (for example a silica or other particulate coating), followed by application of a substantially nonvolatile coating atop the features.

C. Coatings

The microstructured films of the present invention may be advantageously used in combination with one or more coatings applied on top of the microstructured film to provide enhanced desorption. Coatings may also serve other purposes; for example, coatings may provide a protective or abrasion-resistant barrier.

Useful coatings according to the present invention include inorganic materials such as metals; for example aluminum, gold, silver, nickel, titanium, palladium, and platinum; metal oxides, for example titanium dioxide, silicon oxide and zirconium oxide, and alloys of metals or metal oxides, such as inconel or indium tin oxide. Other useful coatings include organic materials such as graphite, carbon black, the families of materials referred to as Diamond-Like Carbon (DLC), as described in U.S. Pat. No. 6,265,068, and Diamond-Like Glass (DLG), as described in PCT publication WO 0166820 entitled Diamond-Like Glass Thin Films, and incorporated herein by reference, silanes and silane derivatives, and parylene. The coatings can be conformal (as in the case of parylene and DLG) or particulate in nature (such as graphite).

Such surface coatings are generally nonvolatile under conditions used for laser desorption. That is, the coating either exhibits negligible volatility, or the entities that are volatilized are so low in molecular weight (for example, carbon clusters which may be emitted from graphite, or aluminum ions which may be emitted from aluminum) that they do not interfere with the analyte being measured.

In this regard, the coatings are distinguished from conventional matrices. While matrix materials are typically thought of as "nonvolatile" in that they have a slow evaporation or sublimation rate under ambient conditions, they are volatilized to a significant extent in the actual laser desorption process, and the volatilized species have molecular weight such that they may interfere with or obscure the analyte signal.

This fundamental difference in volatility results in part from the fact that the coatings of this invention are typically present in the form of large-scale networks which possess bonded interconnectivity over many molecular lengths. This bonded connectivity may be present in either or both directions along the surface of the film, and/or perpendicular to the film. For example, graphite coatings may be employed in which the graphite particles consist of many millions of carbon atoms connected by covalent bonds over distances of up to microns. Alternatively, metal coatings may be employed which consist of many millions of metal atoms connected by metallic bonds, over distances of up to microns and or even millimeters. In contrast, matrices are typically applied as crystals comprised of individual molecules that are not connected by chemical bonds; or as molecules that are individually tethered to attachment sites on the surface of the substrate and are not connected to each other by chemical bonds.

Coatings may be applied to the microstructured film via various methods, including vapor coating, sputter coating, plasma coating, vacuum sublimation, chemical vapor deposition, cathodic arc deposition, and so on. These methods are particularly suited for coating of metals and metal oxides. Coatings such as graphite are most easily applied by obtaining the graphite as a dispersion and applying it to the substrate by any of the well-known methods for liquid coating (knife coating, spray coating, dip coating, spin coating, etc.).

It can be advantageous to provide the coating in a discontinuous manner as opposed to a continuous coating over the entire microstructured surface. For example, the coating can be provided at discrete locations, such as spots. In the case of multilayer coatings, one coating may be discrete while the other may be continuous, according to the needs of the particular instance. Discontinuous coatings may serve several functions. For example, they may serve to demarcate the particular area in which the analyte sample is to be deposited, and then to allow the area to be located once the film with sample is placed in the mass spectrometer. A coating may also be used which provides a discontinuity in the surface energy of the microstructured film to advantageously contain a deposited analyte sample within a desired area, and to prevent wicking or spreading of the sample over an undesirably wide area.

Such coatings may be applied in a discrete manner via any number of methods. If the coating is applied via vapor coating, a mask, such as a perforated screen or film, may be used to limit the coating to the areas defined by the mask. In the case in which it is desired to have multilayer, registered discrete coatings (for example spots containing superimposed multilayer coatings), the mask can be attached to the film (for example via an adhesive) during coating of the different layers such that the layers are superimposed in registration. The mask is then removed after the final coating process. In an alternative embodiment, the perforated mask itself can remain on the film, in which case it will serve to provide wells that serve to contain the analyte droplet that is placed in the wells. It is also possible to provide a perforated layer for this purpose independently of any role in defining the coating. In the case of coatings such as graphite, well-known liquid coating methods such as gravure coating can be used to deposit the graphite in a discontinuous manner.

D. Substrate Materials

The present invention relies on substrate materials that are amenable to formation or generation of the microstructured surface. Various materials are suitable for use as substrates in accordance with the invention. In general the substrate is a polymeric material, although non-polymeric materials having the properties described herein can also be used. The substrate is typically non-porous or substantially non-porous.

The microstructured films of the present invention possess advantages over currently available porous materials (for example, DIOS chips), in that such porous materials are known to be susceptible to contamination via the uptake of impurities from the atmosphere during storage or use. In contrast, the microstructured materials are less susceptible to such contamination in some implementations because they are typically nonporous.

A wide variety of polymeric materials are useful in this invention. These include thermoplastic materials (such as polyolefins, inlcuding polypropylene and polyethylene) and thermoset (curable) materials. Suitable materials include crystalline, semi-crystalline, amorphous, or glassy polymers. Copolymers may be used as well.

Such polymers may be filled or modified, as long as the filling agent does not significantly interfere with the enhanced desorption of the analyte. A wide variety of fillers and additives are available which impart various of functions and properties. These include, for example, fillers to increase strength and/or modulus, additives to provide increased resistance to oxidation, increased heat stability, or increased UV stability, processing additives (for example to provide for improved extrusion properties), pigments and colorants, and so on.

The polymeric materials used in this invention can thus be tailored to possess a wide variety of physical, chemical, optical, electrical, and thermal properties.

E. Device Assembly and Features

The present invention comprises a substrate bearing a structure, and optional coatings, useful for enhanced desorption, particularly in mass spectroscopy. In typical use the film is attached to a standard metal plate for insertion into a mass spectrometry instrument. As such, a number of useful embodiments of the invention exist. It is advantageous to provide the film with a layer of adhesive applied to the back (non-microstructured) side, to facilitate attachment to the metal plate. The adhesive can be a laminating adhesive or double-faced tape. The laminating adhesive can be attached to the underside of the microstructured film, with a release liner remaining in place on the bottom of the adhesive. The user can then simply remove the release liner and attach the film directly to the plate by means of the adhesive. Alternatively, a separate piece of laminating adhesive can be supplied to the user, who can then apply the adhesive to the metal plate, remove the liner, and attach the microstructured film to the top of the adhesive.

The adhesive should be carefully selected such that it does not harbor or generate any impurities which might contaminate the microstructured substrate. In addition, it may be desirable in some cases for the adhesive to be electrically conductive. Such conductive adhesives are readily available, for example conductive adhesive 9713 available from 3M of Maplewood, Minn. The adhesive may be selected such that it is permanently attached to the underside of the microstructured film; alternatively, it may be removable.

Typically, the microstructured film, optionally with attached adhesive underneath, will be packaged for delivery to the customer. This packaging may consist of any means that protects the film and does not act to impart contaminating impurities to the film. For example, the film could be packaged in a plastic bag or plastic case. As an additional protective measure, a protective liner may be placed atop the upper (microstructured) surface of the film.

In another embodiment, a bar code label is applied to the microstructured film so that the film sample can be readily identified and inventoried for archiving. In such cases, an area can be provided outside the working area (i.e. the area upon which samples are deposited) for placement of the bar code.

F. Sample Preparation and Methods of Using the Substrates

The present invention is particularly well suited to mass spectrometry analysis. Analyte spots deposited on a substrate are hit with short laser pulses to desorb and ionize the sample. Ions are formed and then accelerated by one or more electric fields before arriving at a detector. The time it takes to reach the detector, or the location on the detector at which the particles strike, can be used to determine the mass of the particles.

Figure 3:
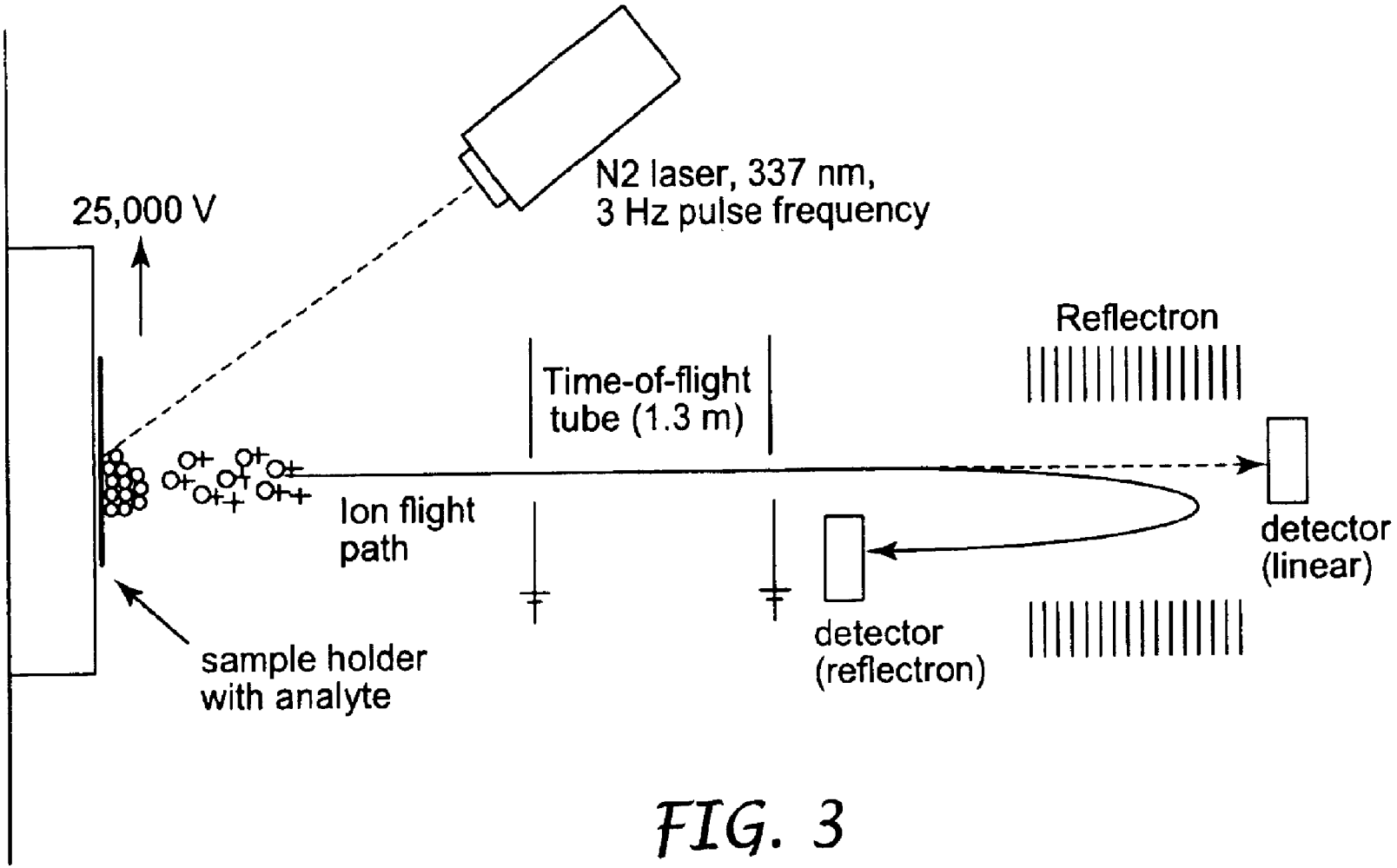
FIG. 3 is a schematic diagram of an apparatus for performing mass spectroscopy in accordance with an implementation of the invention.

Time-of-flight analysis (TOF) is one mass spectrometry method that can be used. FIG. 3 shows a schematic diagram of a time-of-flight setup. For molecules under 10,000 Da, the reflectron mode is used to condense the kinetic energy distribution of the ions reaching the detector. This method was developed to increase the resolution of mass spectroscopy and is used primarily for molecules under 10,000 Da. This higher resolution often results in a drop in sensitivity and a limited mass range.

G. EXAMPLES

The invention can be further understood by means of the following examples.

For these examples, substrates were prepared using polymer melt processing methods. Plastic film bearing the "TYPE A" topology of FIG. 4 was prepared by extruding Exxon Polypropylene 3445 onto a silicone belt tool bearing a structure. The silicone belt tool had been prepared by placing liquid silicone in contact with a metal tool by means of spin casting and allowing the silicone to solidify. The metal tool had been prepared by vapor deposition as described in International Patent Number WO 01/68940, hereby incorporated by reference. The polymer was extruded at a melt temperature of 400° F., and the tool temperature setting was set at 125° F. The nip pressure was set at 20 psi, and the line speed was set at 5 fpm. The polypropylene was removed from the tool as it cooled. The polypropylene extrudate replicated the tool, resulting in a surface bearing random features ranging from hundreds of nanometers to several microns in characteristic dimensions.

Plastic film bearing the "TYPE B" topology of FIG. 5 was prepared by compression molding. A piece of 0.014" thick film of Makrolon 2407 polycarbonate (produced by Bayer AG) was placed between a flat polished metal press plate and a metal tool bearing a structure. The metal tool had been prepared by electrochemical deposition of metal onto a flat metal surface. The tool, film, and press plate stack was placed into a Wabash compression molder. The platens of the compression molder were set to 190° C., and the platens were closed to attain 50 psi pressure on the sample. The sample was pressed at this condition for 2 minutes, and then the pressure was increased to 200 psi on the sample. This condition was held for 3 minutes, and then the system was cooled. The samples remained in the compression molder at 200 psi until the platens reached 80° C., when the press was opened and the sample removed. The feature characteristic dimensions of the polycarbonate film were in the range of a few microns.

Film bearing a matte finish (FIG. 6) was produced by extruding Exxon Polypropylene 3445 onto a matte finish silicone belt, under the same conditions used to produce the TYPE A pattern described above. The matte finish polypropylene exhibited features with characteristic dimensions in the range of several hundred nanometers to several microns. The features were in general less pronounced and less well defined than that of the TYPE A structure.

Another matte finish film (FIG. 7) was produced by extruding polypropylene onto an unpolished, matte finish metal roll under typical polypropylene extrusion conditions. This film exhibited features with characteristic dimensions generally in the range of several microns, with the feature density being generally lower than that of the TYPE A structure.

Film bearing regular, nonrandom structure-within-structure features (FIG. 8) was produced by extruding Dow Chemical 7C50 high impact polypropylene copolymer onto a metal tool roll bearing the negative of the desired structure. The copolymer resin was extruded by means of a Killion single screw 1.25" extruder with die temperature set at 480° F. The molten resin exited the die and was drawn between two nip rollers closed under pressure. One roll was rubber coated backing roll and the other was the metal tool roll bearing the microstructured pattern. The backing roll was maintained at 100° F. and the tool roll at 230° F. The web speed was between approximately 9.8 and 12.1 feet per minute.

The metal tool roll was engraved with four sets of grooves. There were two sets of parallel grooves, which were perpendicular to each other and are referred to hereinafter as the major grooves. These two perpendicular sets of helical grooves ran at an angle of approximately 45° to the roll axis, and had a depth of approximately 60 micrometers (microns, or μm), a width of approximately 18 μm at the bottom and approximately 34 μm at the top, and were spaced approximately 250 μm apart. A third set of grooves ran at an angle of approximately 90° to the roll axis, and had a depth of between approximately 2 and approximately 4 micrometers (microns, or μm), a width of approximately 5 μm at the bottom and approximately 7 μm at the top, and were spaced approximately 25 μm apart. A fourth set of grooves ran at a direction parallel to the roll axis, and had a depth of between approximately 5 micrometers (microns, or μm), a width of approximately 5 μm at the bottom and approximately 7 μm at the top, and were spaced approximately 25 μm apart. The third and fourth sets of grooves are collectively referred to as the minor grooves.

Figure 11:
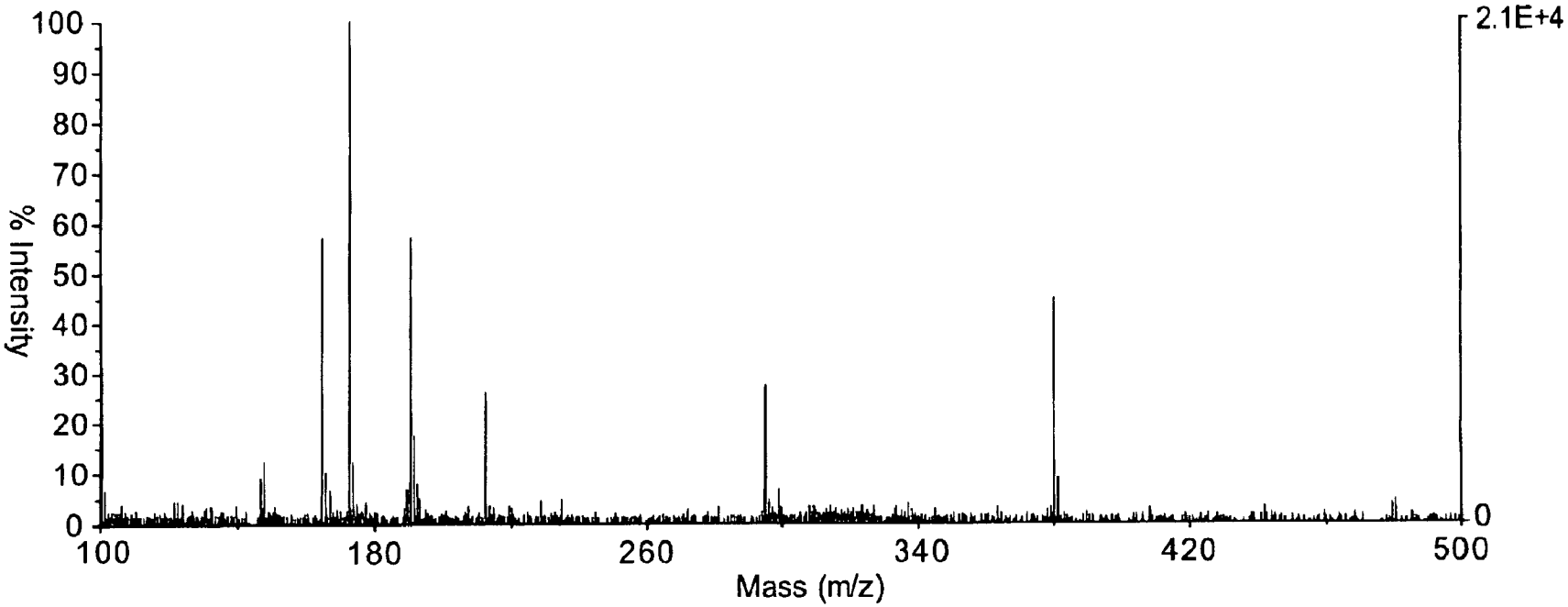
FIG. 11 is a mass spectrum of ascorbic acid with α-CHCA matrix.

During embossing, the molten polypropylene resin filled the above groove structures and solidified, such that a microstructured film was formed bearing features that were the negative of the above described grooves. That is, film exhibited a smaller scale grid of perpendicular ridges superimposed within a larger scale grid of perpendicular ridges, as shown in FIG. 11, such as those disclosed in U.S. Ser. Nos. 10/183,122 and 10/183,121 and incorporated herein by reference.

Nonstructured polypropylene film bearing a smooth surface finish was produced by extruding polypropylene onto a polished metal roll, under the same extrusion conditions used to produce the TYPE A pattern described above. The surface was generally flat and featureless.

Nonstructured polycarbonate film bearing smooth surface finish was produced by extruding polycarbonate onto a polished metal roll, under standard polycarbonate extrusion conditions. The surface was generally flat and featureless.

Metal and metal oxide coatings were applied to the films utilizing an NRC 3115 Bell Jar. For aluminum, the deposition thickness was approximately 950 Å. DLG (Diamond Like Glass) was applied using a Plasma-Therm vapor coater, according to methods described in PCT publication WO 0166820. The DLG coating thickness was approximately 1100 Å. In some cases the DLG coating was post treated to render it hydrophilic (designated H-DLG), as described in the same reference. In some cases both coatings were continuous; in other cases, one or both coatings were deposited in discrete areas (for example, in spots) by use of masks during the coating process. Masks were either metal foils with areas removed, or polymer films likewise with areas removed. In some cases the masks were adhered to the microstructured film by means of adhesive, particularly when it was desired to deposit superimposed, registered, coatings in discrete areas. Specific coating patterns are described in the specific examples. Masks were removed after coating.

All mass spectrometry experiments were conducted on an Applied Biosystems (Framingham, Mass.) Voyager-DE STR time-of-flight mass spectrometer. The films were attached to commercially available metal MALDI plates using double-faced adhesive tape. A pulsed 337 nm nitrogen laser with a 3 Hz pulse frequency was used, and laser intensity was set at the threshold value. The table below summarizes the main instrument parameters:

| | |
|---|---|
| Polarity | Positive (Except where specified) |
| Mode of Operation | Reflector |
| Extraction mode | Delayed |
| Accelerating voltage | 18,000–20,000 V for small molecules; 20,000–24,000 V for peptides |
| Grid Voltage | 76%–87.5% |
| Extraction delay time | 150 nsec |
| Number of laser shots | 150 shots/spectrum |

The mass spectrometry data was processed by using Data Explorer™ Version 4.0. Before measuring the resolution (R) and signal-to-noise (S/N), the "Noise Filter/Smooth" function with a 0.7 correlation factor was applied to all spectra.

Example 1

This example illustrates the use of a microstructured substrate with and without a chemical matrix.

Polypropylene film bearing the TYPE A structure (henceforth referred to as PPTYPE A) was produced as described previously. A metal mask with a ten by ten grid array of 1.19 mm diameter holes was adhered to the microstructured side of the film using ReMount™ removable spray adhesive. The film was then vapor coated with aluminum, as described previously, after which the metal mask was removed. The resulting films thus contained 1.19 mm diameter spots of aluminum. (PPTYPE A coated with aluminum is henceforth referred to as polypropylene with microstructured surface TYPE A and an aluminum film).

Samples for analysis were prepared with 0.1 mg of three common drug compounds: acetaminophen (151.17 Da), ascorbic acid (176.12 Da), and penicillin (389 Da). These drug compounds were dissolved in 1.0 ml of a 1:1:0.001 methanol/water/trifluoro acetic acid solution. A volume of 0.5 μL of each analyte solution was pipetted directly onto one of the aluminum-coated spots on the film. Analyte samples were applied with and without the addition of 0.5 μL of the matrix alpha cyano-4-hydroxy-cinammic acid (α-CHCA). The samples were allowed to air dry for approximately fifteen minutes.

Figure 9:
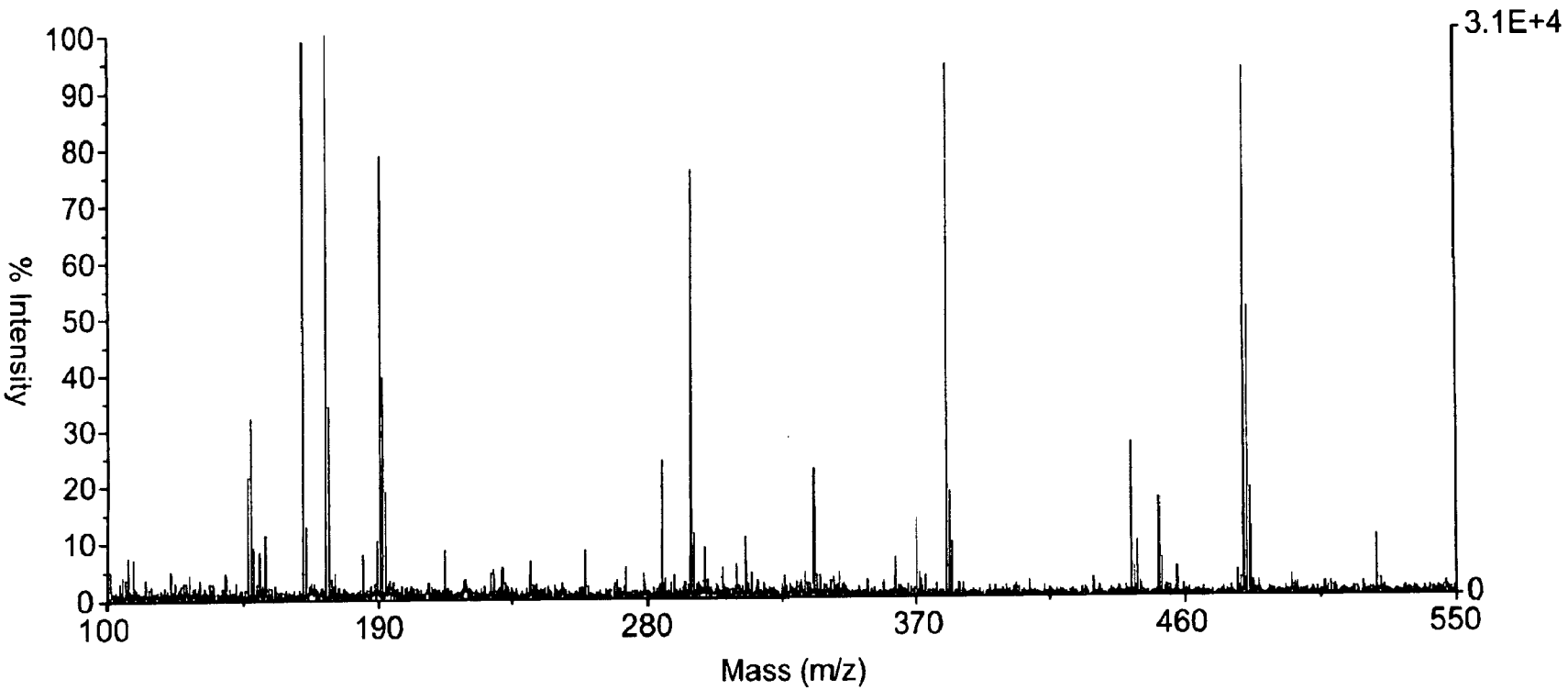
FIG. 9 is a mass spectrum of acetaminophen with α-CHCA matrix.
Figure 10:
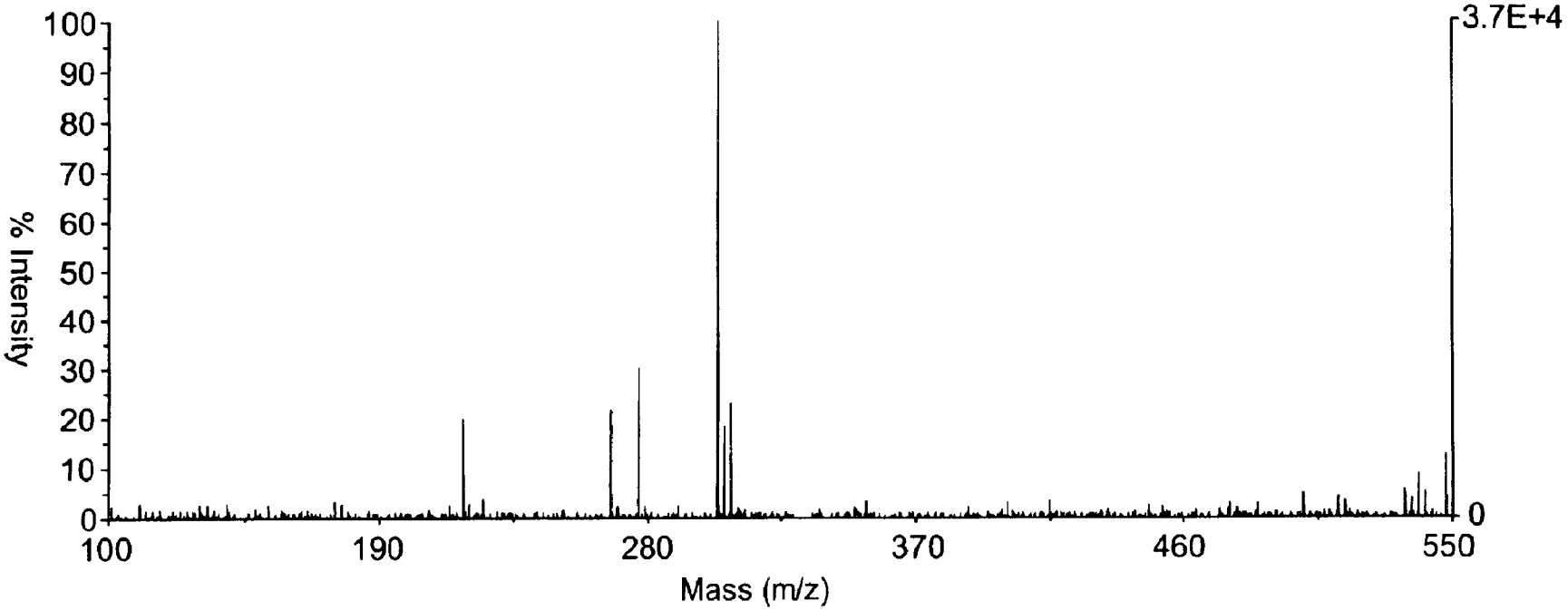
FIG. 10 is a mass spectrum of acetaminophen off polypropylene with microstructured surface TYPE A and an aluminum film.

FIG. 9 shows the mass spectrum of acetaminophen with the addition of α-CHCA matrix. The matrix signal saturated the detector and no analyte peak can be seen. FIG. 10 shows the mass spectrum of acetaminophen off polypropylene with microstructured surface TYPE A and an aluminum film without a matrix. The molecular ion can be clearly seen at $_{m/z}$ 152.51, along with the sodium and potassium adducts at $_{m/z}$ 174.53 and $_{m/z}$ 190.54 respectively. The spectrum is substantially free from noise, allowing the analyte to easily be identified.

Figure 12:
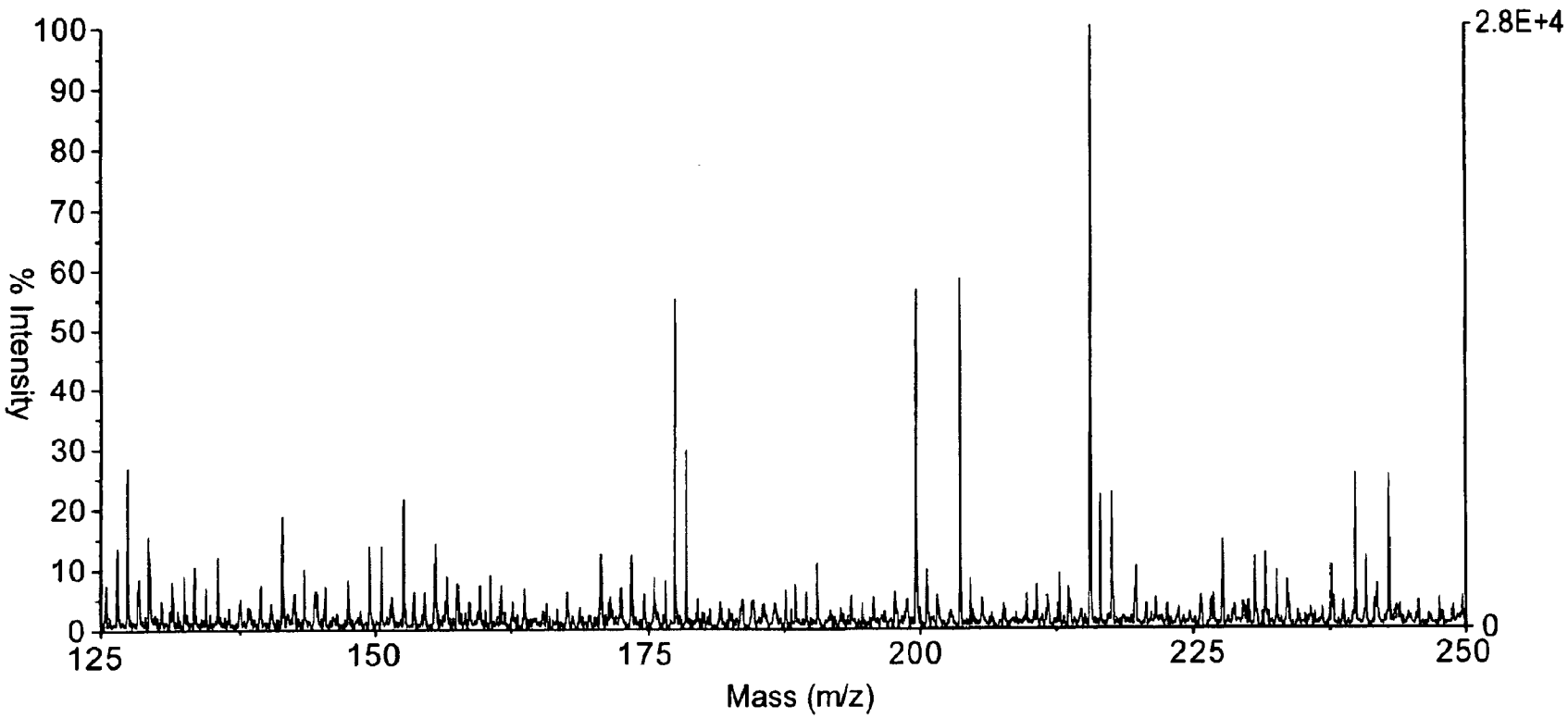
FIG. 12 is a mass spectrum of ascorbic acid off polypropylene with microstructured surface TYPE A and an aluminum film.

FIG. 11 shows the mass spectrum of ascorbic acid with the addition of α-CHCA matrix. Again, the matrix signal saturated the detector and the analyte peak cannot be seen. FIG. 12 shows the mass spectrum of ascorbic acid off polypropylene with microstructured surface TYPE A and an aluminum film without matrix. The molecular ion can be clearly seen at $_{m/z}$ 177.53, along with the sodium and potassium adducts at $_{m/z}$ 199.53 and $_{m/z}$ 215.57 respectively. This method also allows for high resolution allowing the isotopes of the molecules to be seen.

Figure 13:
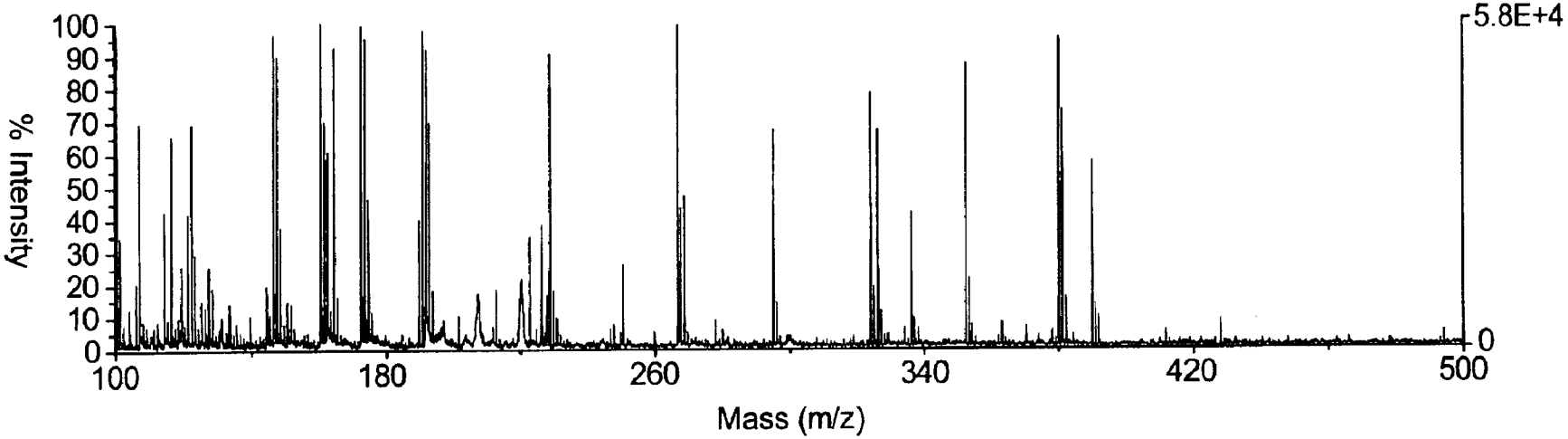
FIG. 13 is a mass spectrum of penicillin with α-CHCA matrix.
Figure 14:
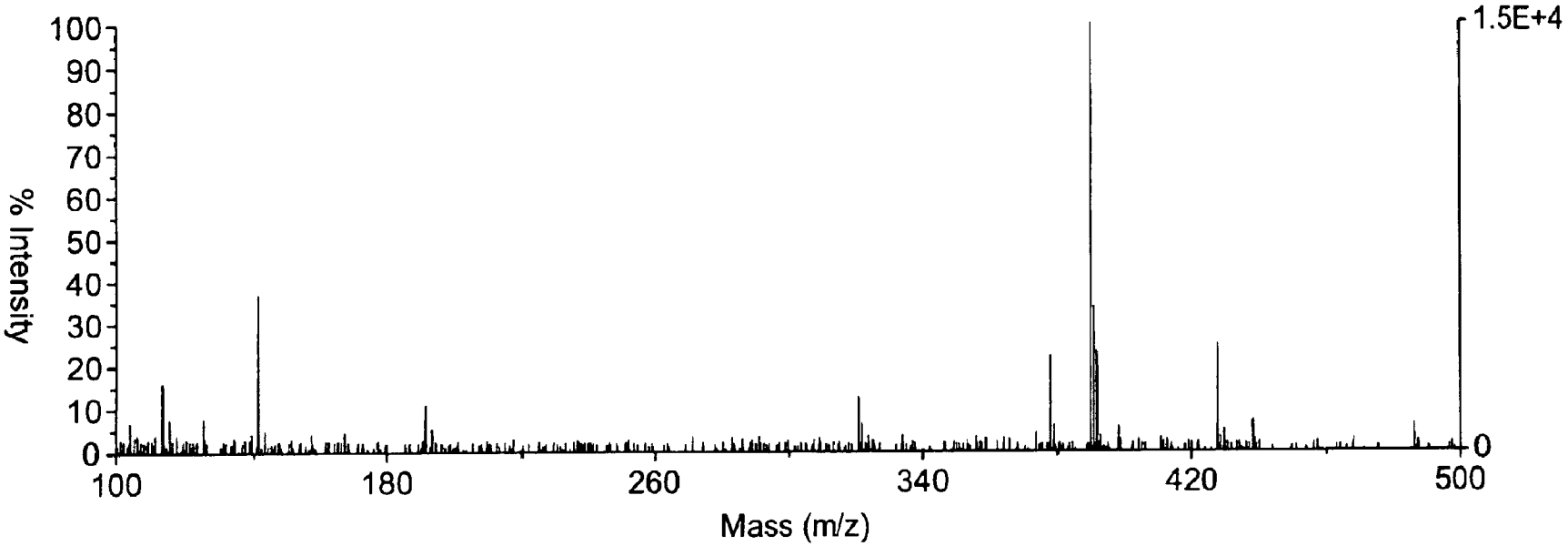
FIG. 14 is a mass spectrum of penicillin off polypropylene with microstructured surface TYPE A and an aluminum film.

FIG. 13 shows the mass spectrum of penicillin with α-CHCA matrix. The molecular ion does show up at $_{m/z}$ 390.03, but is hard to identify in the midst of the matrix noise. FIG. 14 shows the mass spectrum of penicillin off PPTYPE A-Al without matrix. The molecular ion can easily be picked out at $_{m/z}$ 389.93 with a signal-to-noise ratio of over forty times that of the spectrum obtained with matrix.

Example 2

This example illustrates the use of polypropylene with the TYPE A structure and with the matte finish structure, coated with aluminum.

Matte finish polypropylene was obtained by extrusion of polypropylene resin against a matte finish metal roll as described previously. Polypropylene bearing the TYPE A structure was obtained as described previously. Both films were coated with a continuous layer of aluminum as described previously.

One small molecule, clonidine (266.6 Da), and two peptides, substance P (1347.6 Da) and angiotensin II (1046.2 Da), were obtained from Sigma Chemical Co. (St. Louis, Mo.) and were used without further purification. A solution containing 100 ng/μL of each analyte in 50:50 HPLC grade acetonitrile/water with 0.1% trifluoro acetic acid was made for the small molecule. A solution containing 1000 ng/μL of each analyte in 50:50 methanol/water with 0.1% trifluoro acetic acid was made for each of the peptides. A volume of 0.5 μL–3.0 μL of analyte was pipetted directly onto the film, followed by drying at room temperature for approximately fifteen minutes.

Figure 15:
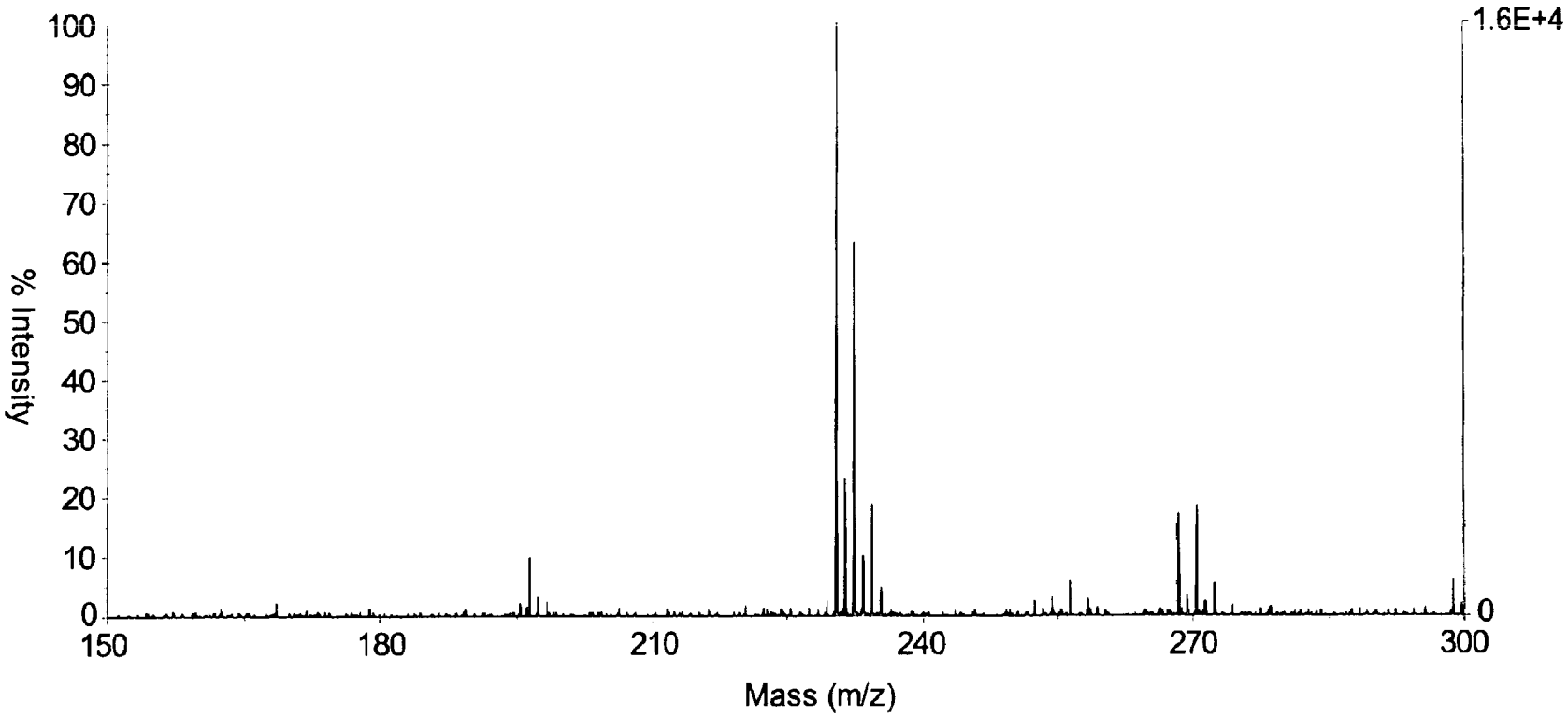
FIG. 15 is a mass spectrum of clonidine off polypropylene with microstructured surface TYPE A and an aluminum film.
Figure 16:
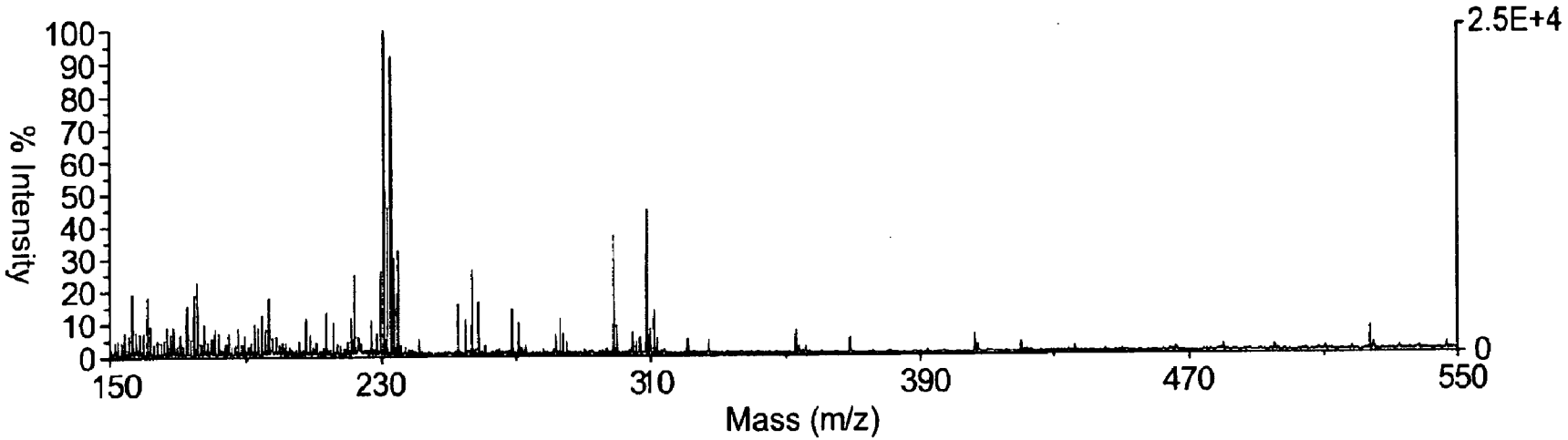
FIG. 16 is a mass spectrum of clonidine off Al-coated matte polypropylene.

FIG. 15 shows the spectrum for clonidine off the polypropylene with the TYPE A structure; FIG. 16 shows the spectrum for the matte finish polypropylene. The TYPE A microstructured film shows over three times the signal-to-noise ratio of the matte finish polypropylene. Also, the spectrum off the TYPE A microstructured film shows a cleaner baseline due to the lower threshold laser intensity that the microstructured film allowed to be used.

Figure 17:
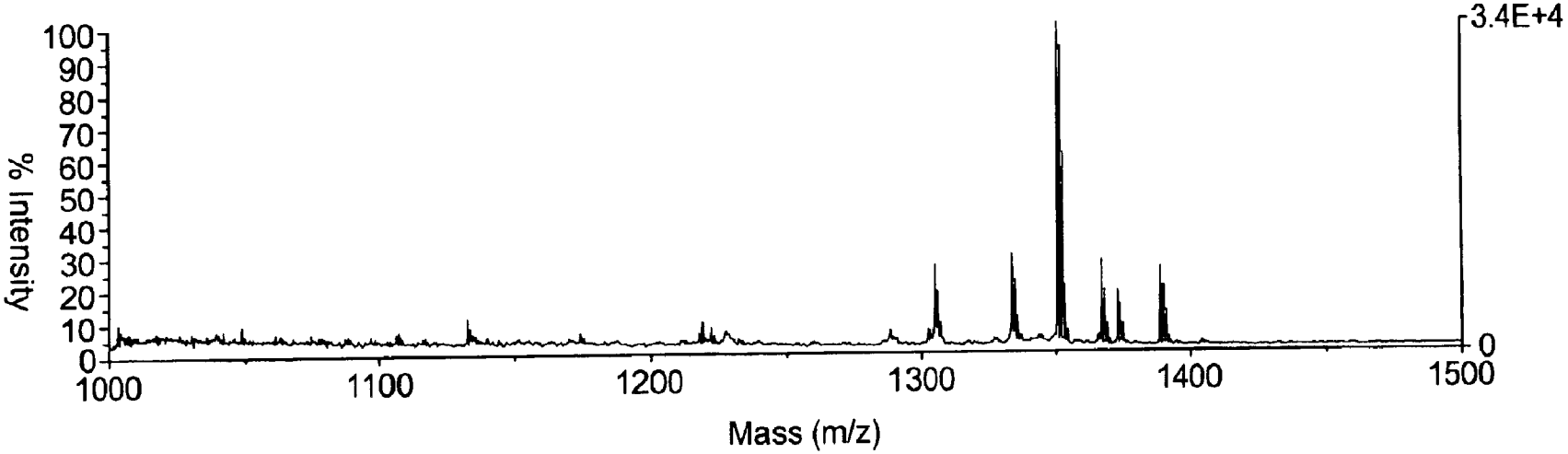
FIG. 17 is a mass spectrum of Substance P off polypropylene with microstructured surface TYPE A and an aluminum film.
Figure 18:
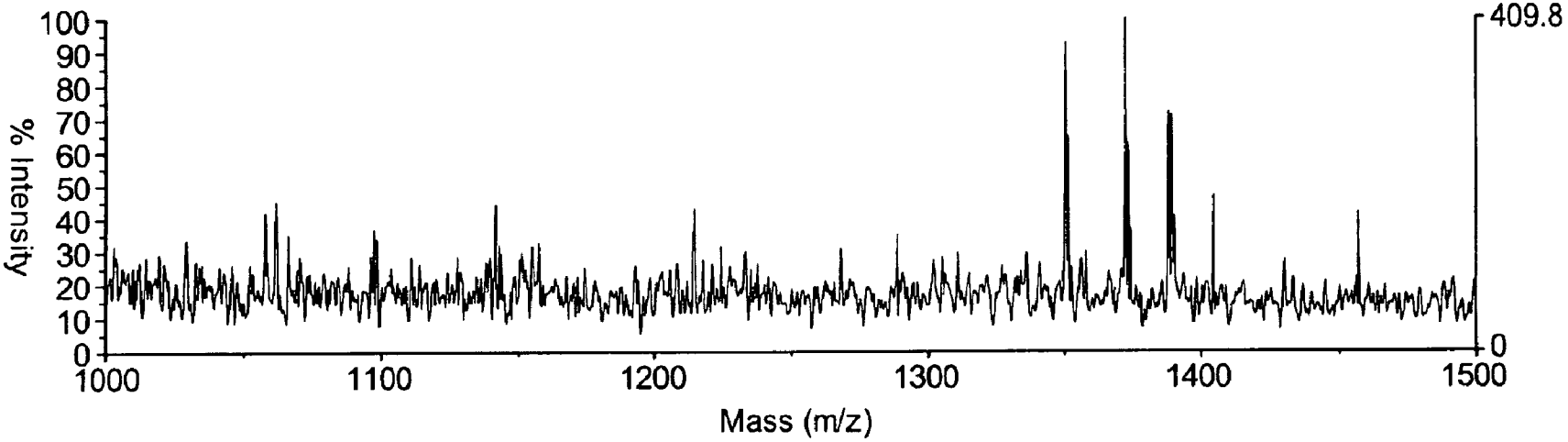
FIG. 18 is a mass spectrum of Substance P off Al-coated matte polypropylene.

FIG. 17 shows the spectrum for substance P off of the polypropylene with the TYPE A structure; FIG. 18 shows the spectrum for substance P off of the matte finish polypropylene. The signal-to-noise is over twenty times greater on the TYPE A microstructured film. Additionally, the threshold laser intensity was lower for the TYPE A microstructured film leading to a cleaner spectrum and easier identification of the analyte of interest.

Figure 19:
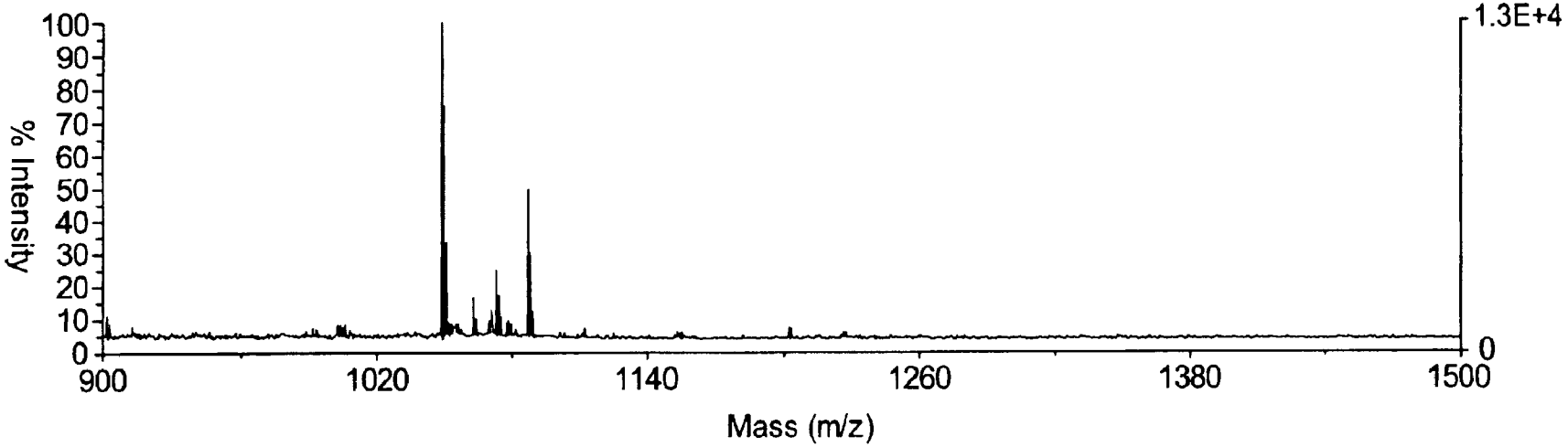
FIG. 19 is a mass spectrum of Angiotensin II off polypropylene with microstructured surface TYPE A.
Figure 20:
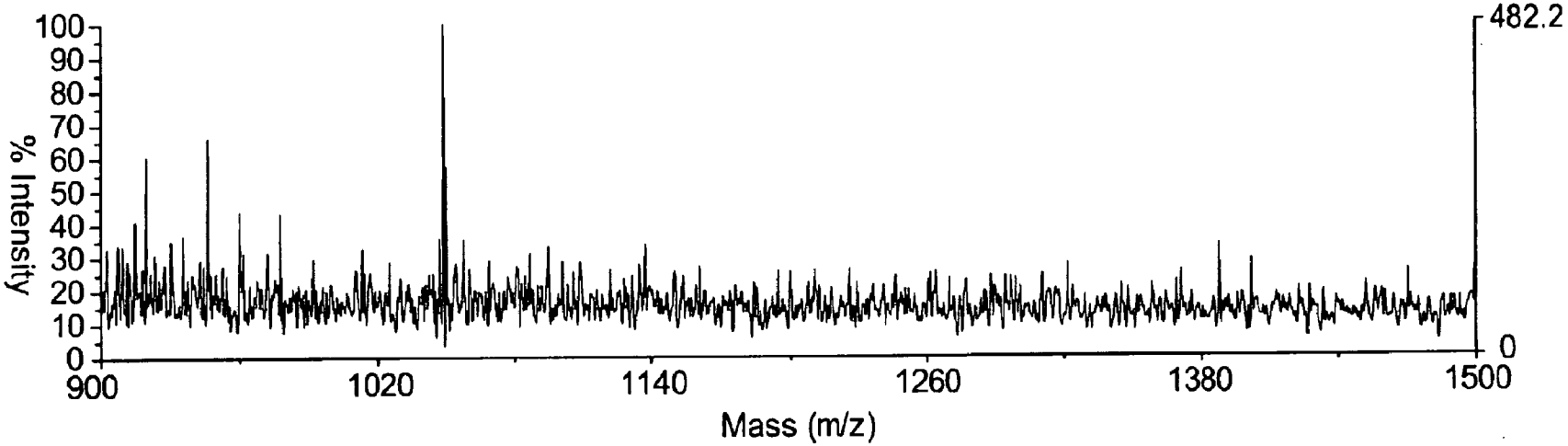
FIG. 20 is a mass spectrum of Angiotensin II off Al-coated matte polypropylene.
Figure 21:
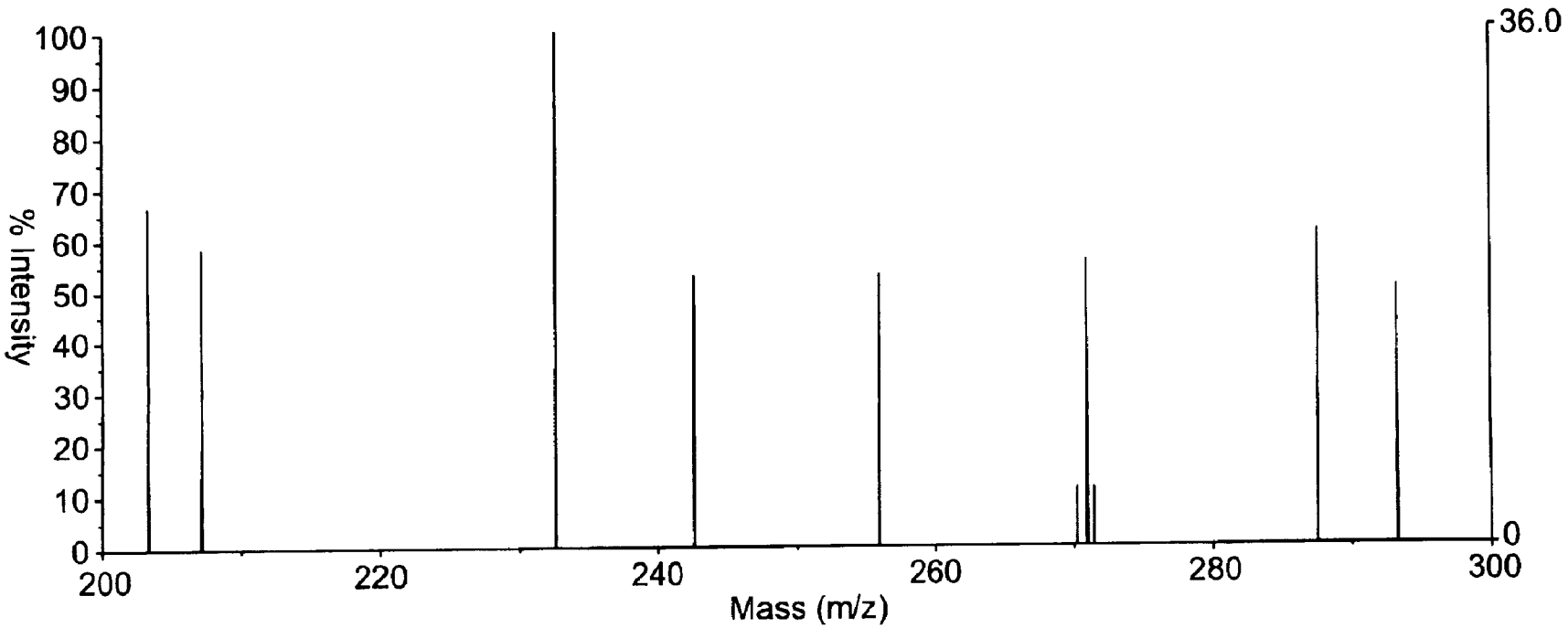
FIG. 21 is a mass spectrum of clonidine off Al/H-DLG coated smooth polypropylene.
Figure 22:
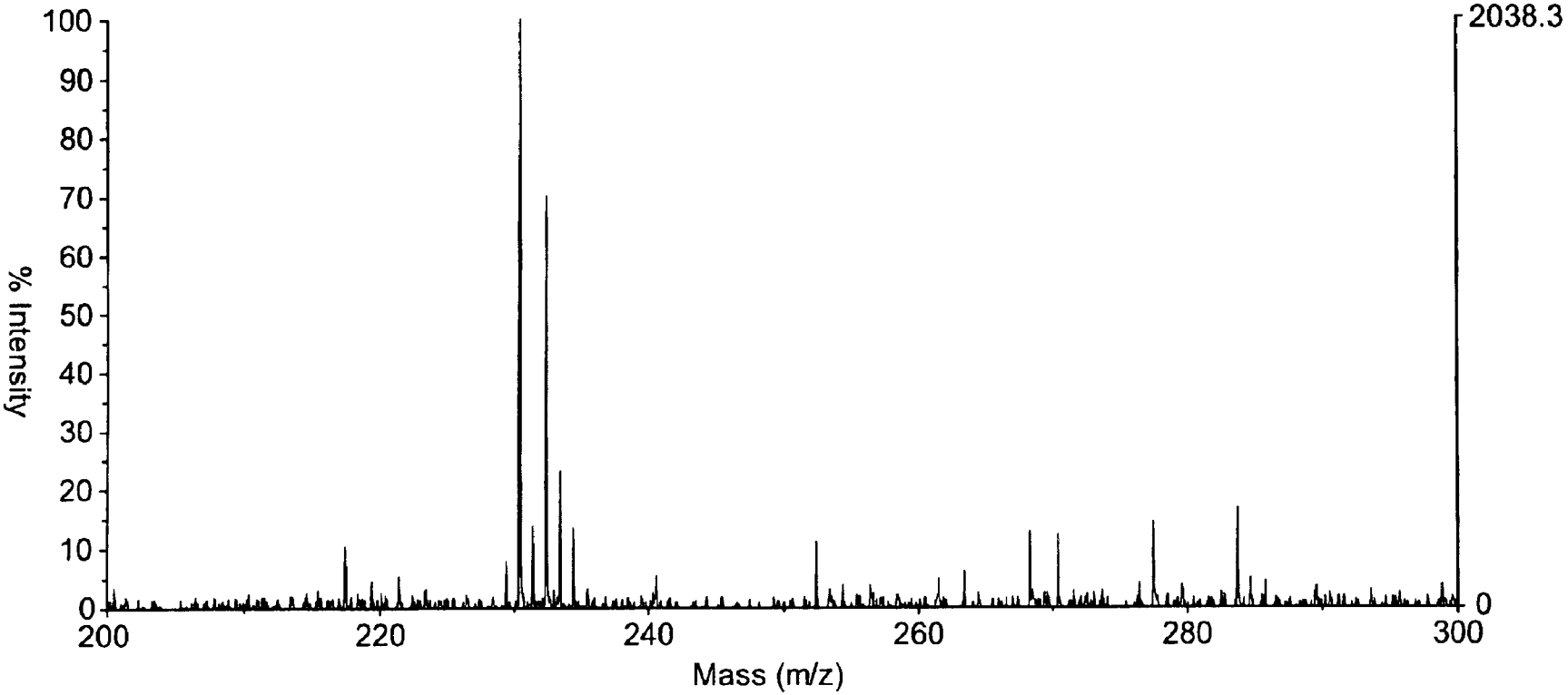
FIG. 22 is a mass spectrum of clonidine off Al/H-DLG coated matte polypropylene (via silicone belt tooling).
Figure 23:
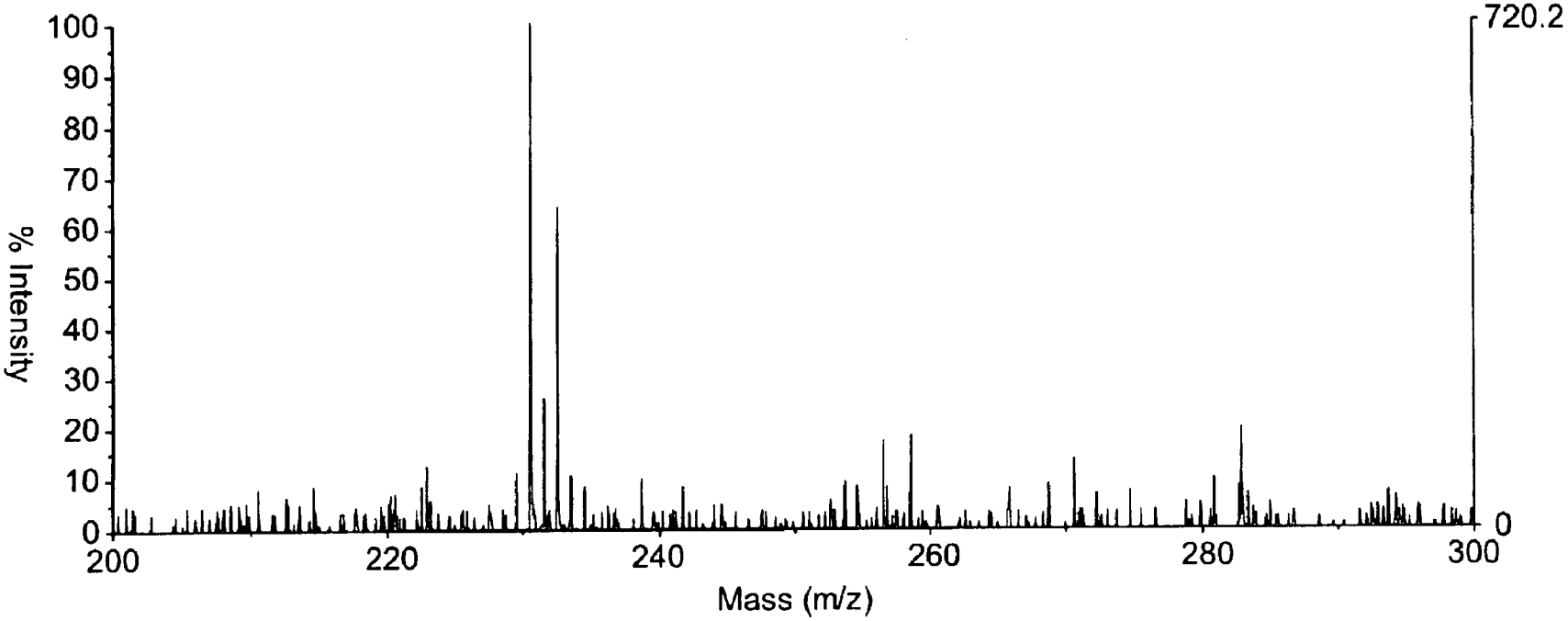
FIG. 23 is a mass spectrum of clonidine off Al/H-DLG coated matte polypropylene (via metal roll tooling).
Figure 24:
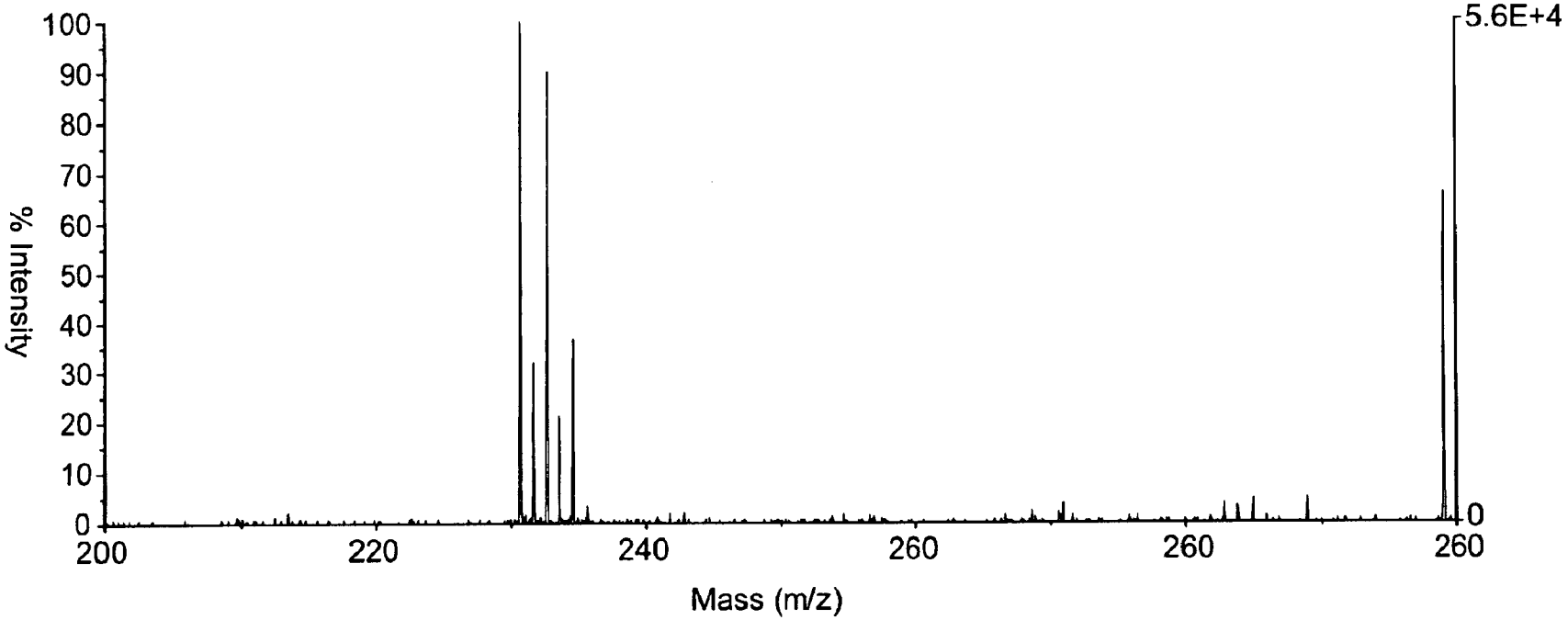
FIG. 24 is a mass spectrum of clonidine off Al/H-DLG coated polypropylene with microstructured surface TYPE A.
Figure 25:
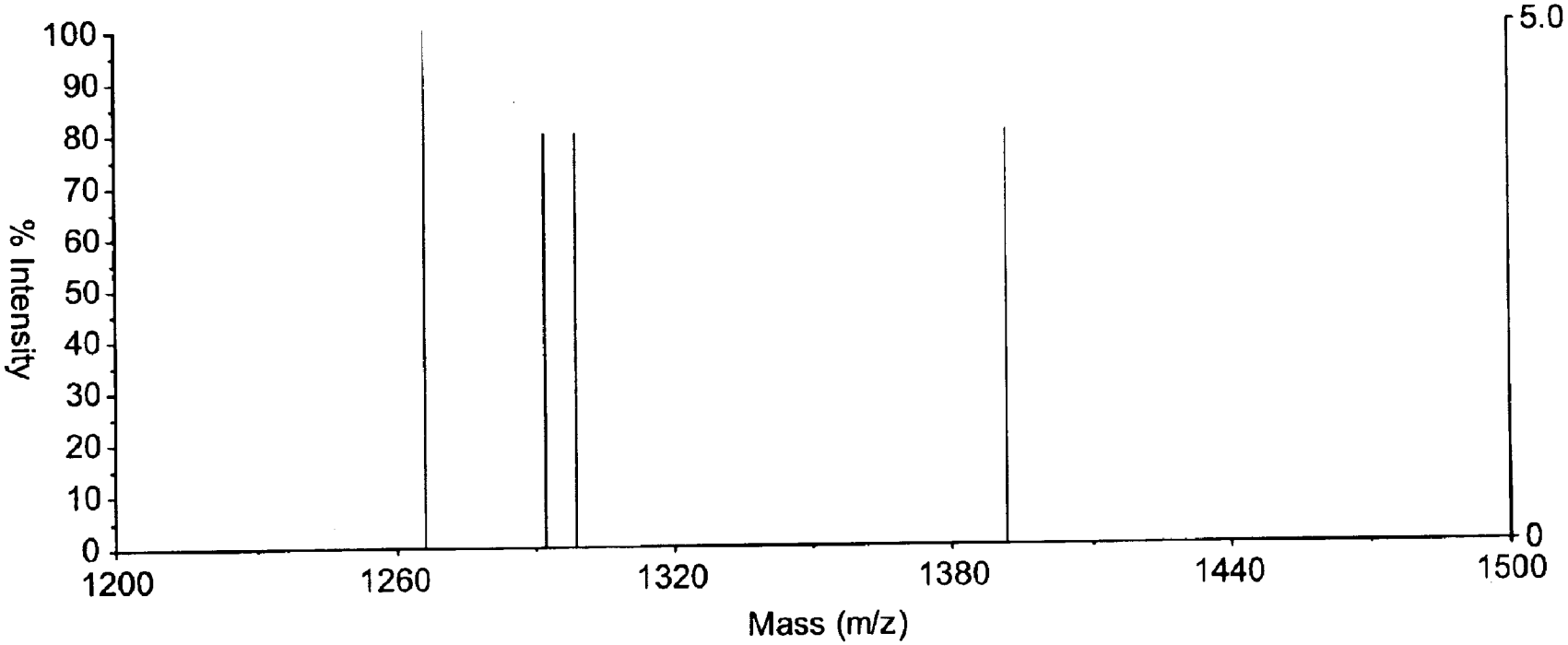
FIG. 25 is a mass spectrum of Substance P off Al/H-DLG coated smooth polypropylene.
Figure 26:
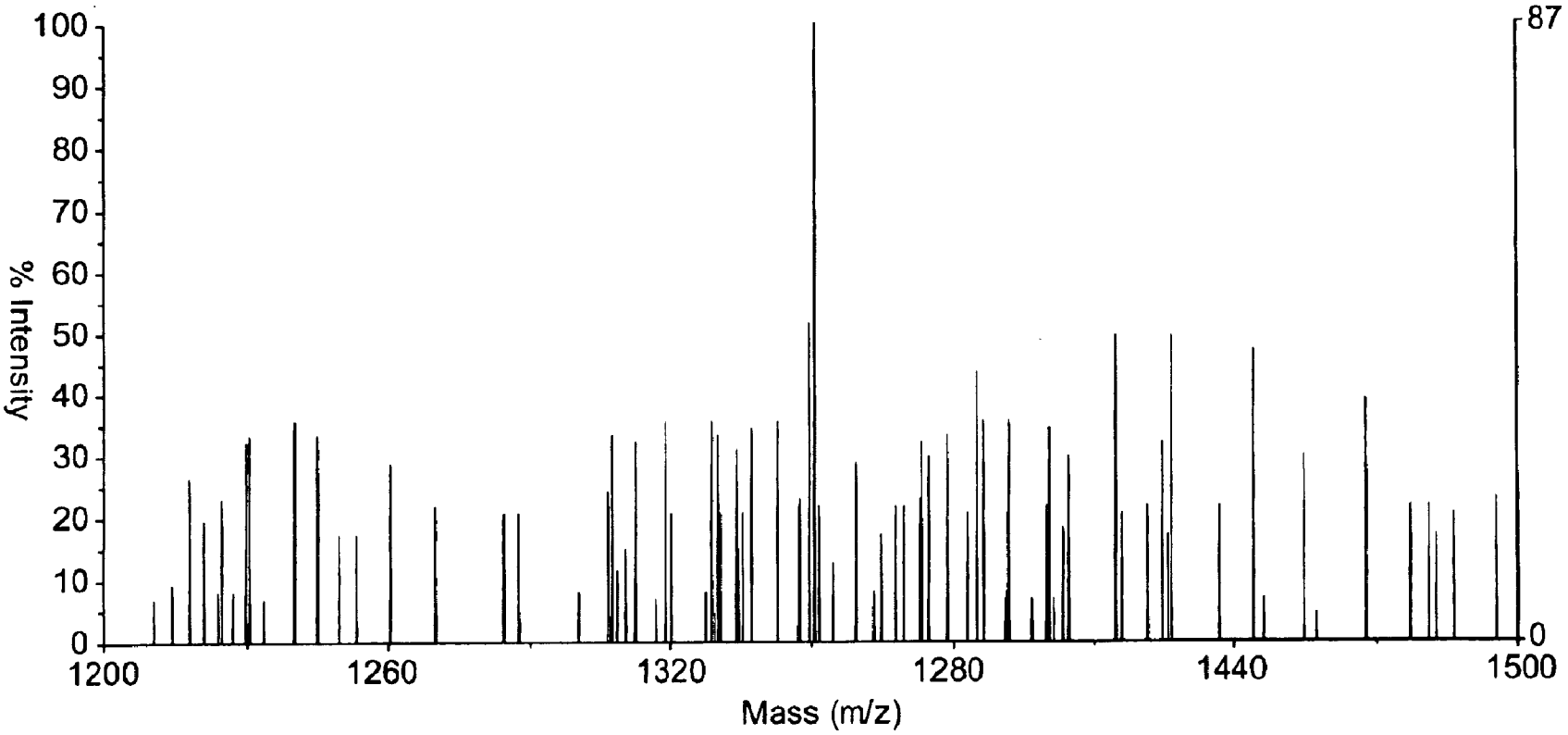
FIG. 26 is a mass spectrum of Substance P off Al/H-DLG coated matte polypropylene (via silicone belt tooling).
Figure 27:
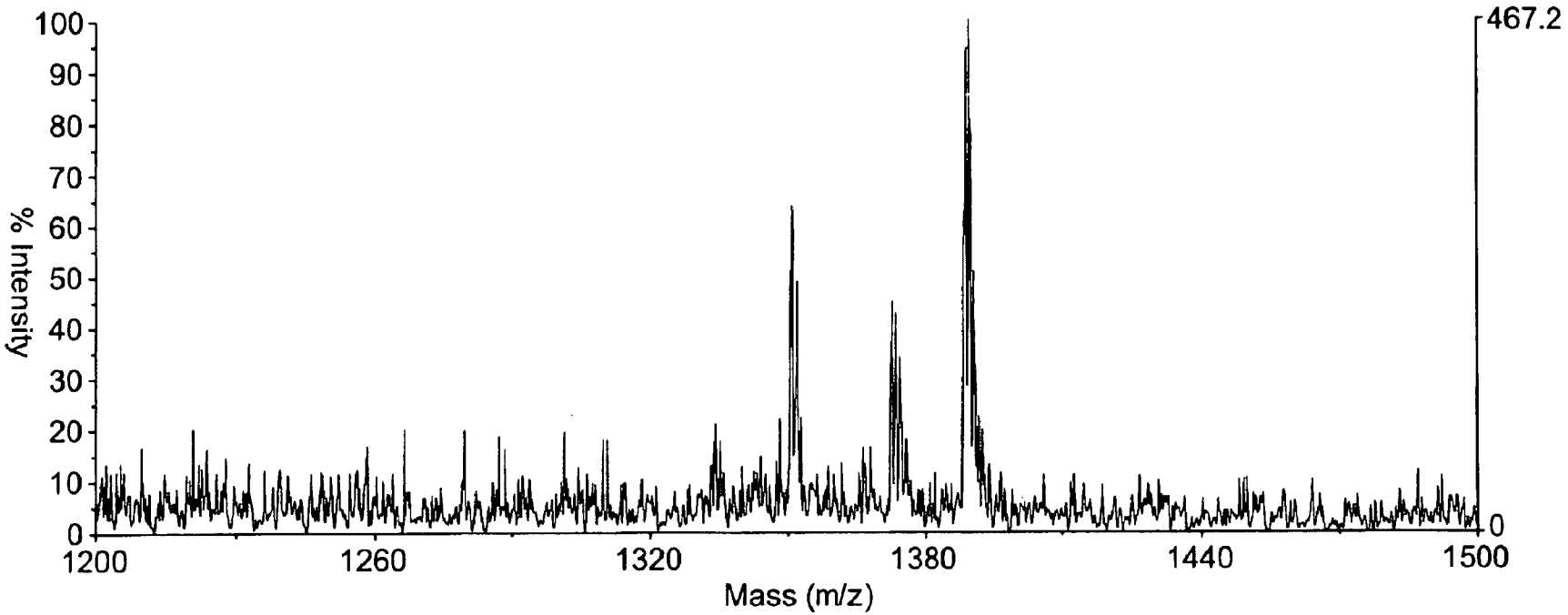
FIG. 27 is a mass spectrum of Substance P off Al/H-DLG coated matte polypropylene (via metal roll tooling).
Figure 28:
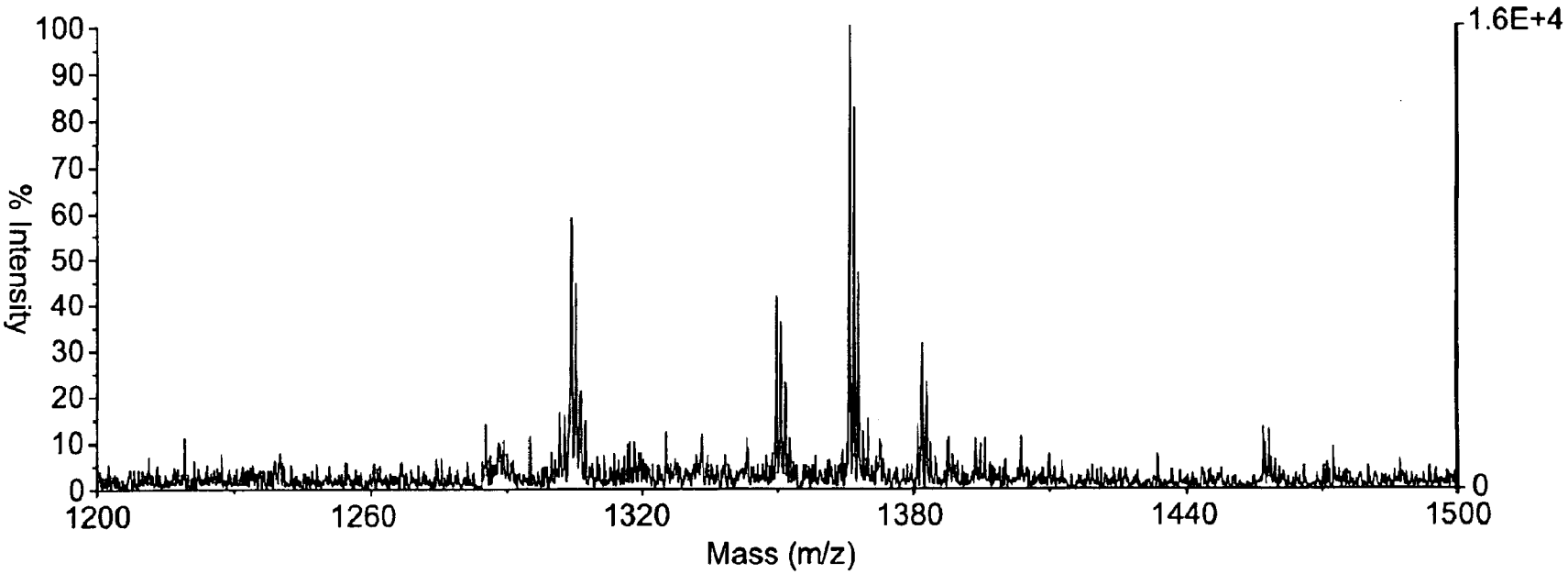
FIG. 28 is a mass spectrum of Substance P off Al/H-DLG coated PPTYPE A.

FIG. 19 shows the spectrum for angiotensin II off of the polypropylene with the TYPE A structure; FIG. 20 shows the spectrum for angiotensin II off of the matte finish polypropylene. As in the above spectra, the TYPE A microstructured film gives a much higher signal-to-noise ratio and a cleaner baseline.

Example 3

This example illustrates the results of mass spectrometry analysis using films with various structures. In all cases the film is polypropylene and the coating is aluminum followed by hydrophilic DLG (H-DLG). The structures are: nonstructured (made by extrusion onto a polished metal roll), matte finish (made by extrusion onto a matte finish silicone belt), matte finish (made by extrusion onto an unpolished, matte finish metal roll) and the TYPE A structure, all obtained as described previously.

A metal mask with 2.00 mm diameter holes was adhered to each film via ReMount™ removable spray adhesive. The samples were then coated with aluminum followed by H-DLG, using methods and apparatus and described previously, after which the mask was removed. The resulting films contained superimposed 2.00 mm diameter spots of aluminum and H-DLG.

One small molecule, clonidine (266.6 Da), and one peptide, substance P (1347.6 Da), were obtained from Sigma Chemical Co. (St. Louis, Mo.). Solutions containing 20 ng/μL of clonidine in 50:50 HPLC grade methanol/water with 0.1% trifluoro acetic acid and 100 ng/μL of substance P in 50:50 HPLC grade methanol/water with 0.1% trifluoro acetic acid were made.

For each analyte, a volume of 0.3 μL of analyte solution was pipetted directly onto one of the Al/H-DLG-coated spots on the film. Due to the difference in surface energy between the H-DLG and the surrounding polypropylene, the applied sample remained confined within the coated area. The samples were allowed to air dry at room temperature for approximately fifteen minutes.

FIGS. 21–24 show mass spectra of the small molecule clonidine off of unstructured polypropylene, matte finish (silicone belt) polypropylene, matte finish (metal roll) polypropylene, and polypropylene with the TYPE A structure. With the unstructured film, no analyte signal can be obtained, even at high laser power. With the two matte finish films, the analyte can be seen, with signal-to-noise of around 600. The spectrum off the TYPE A film shows signal-to-noise of 56,000.

FIGS. 25–28 shows mass spectra of the peptide substance P off of unstructured, matte finish (metal and silicone), and the TYPE A microstructured polypropylene films. Again, the unstructured film shows zero analyte signal. There is an analyte signal off each of the two matte finish films, but signal-to-noise is low. The spectrum quality off the TYPE A microstructured film is much better, with higher relative intensity and signal-to-noise.

Example 4

This example illustrates the results of mass spectrometry analysis using aluminum and hydrophilic DLG single layer coatings.

Polypropylene films with the TYPE A structure was obtained without a coating, with a continuous coating of hydrophilic diamond-like glass (H-DLG), and with a continuous coating of aluminum.

One small molecule, clonidine (266.6 Da), and one peptide, bradykinin (1060.2 Da), were obtained from Sigma Chemical Co. (St. Louis, Mo.) and were used without any further purification. A solution containing 100 ng/μL of clonidine in 50:50 HPLC grade methanol/water with 0.1% trifluoro acetic acid was made. Two different concentrations of bradykinin solution were made in 50:50 methanol/water with 0.1% trifluoro acetic acid, one at a concentration of 1000 ng/μL and one at a concentration of 100 ng/μL.

A volume of 3.0 μL of analyte solution was pipetted directly onto the film, followed by drying at room temperature for approximately fifteen minutes.

Figure 29:
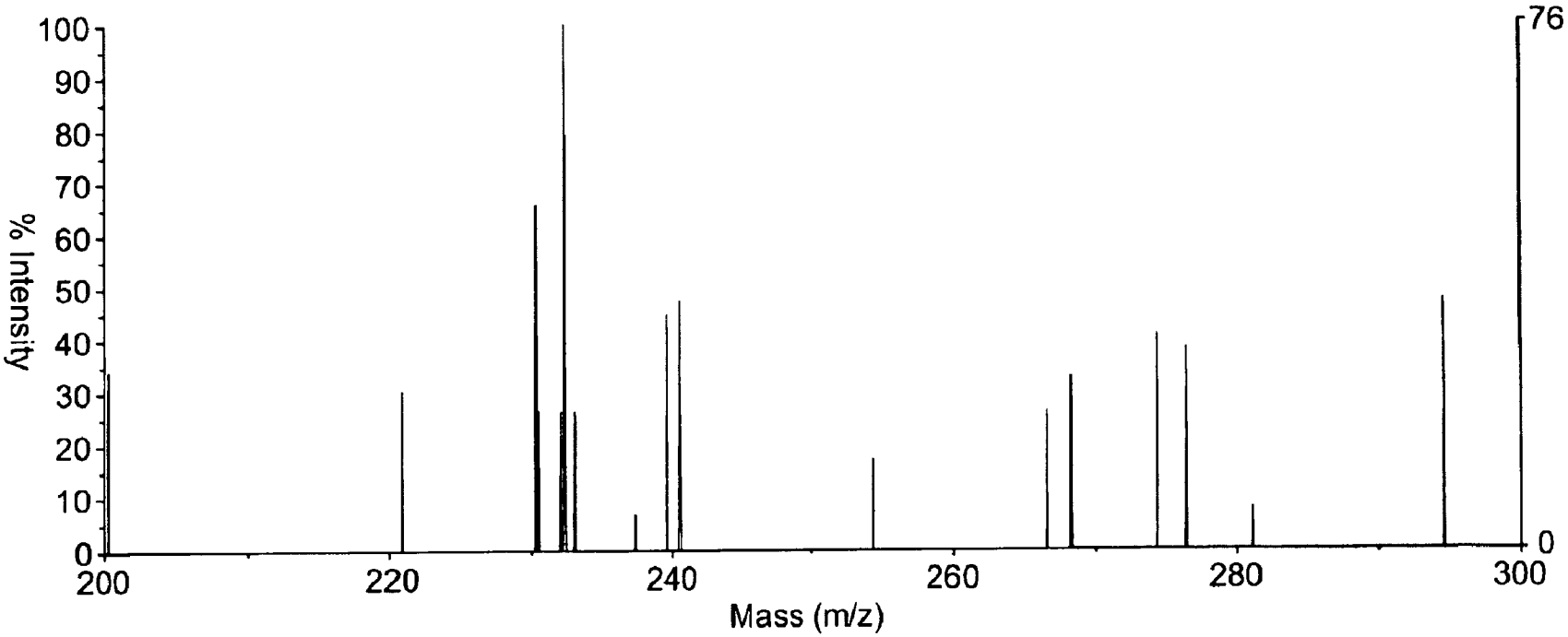
FIG. 29 is a mass spectrum of clonidine off uncoated polypropylene with microstructured surface TYPE A.
Figure 30:
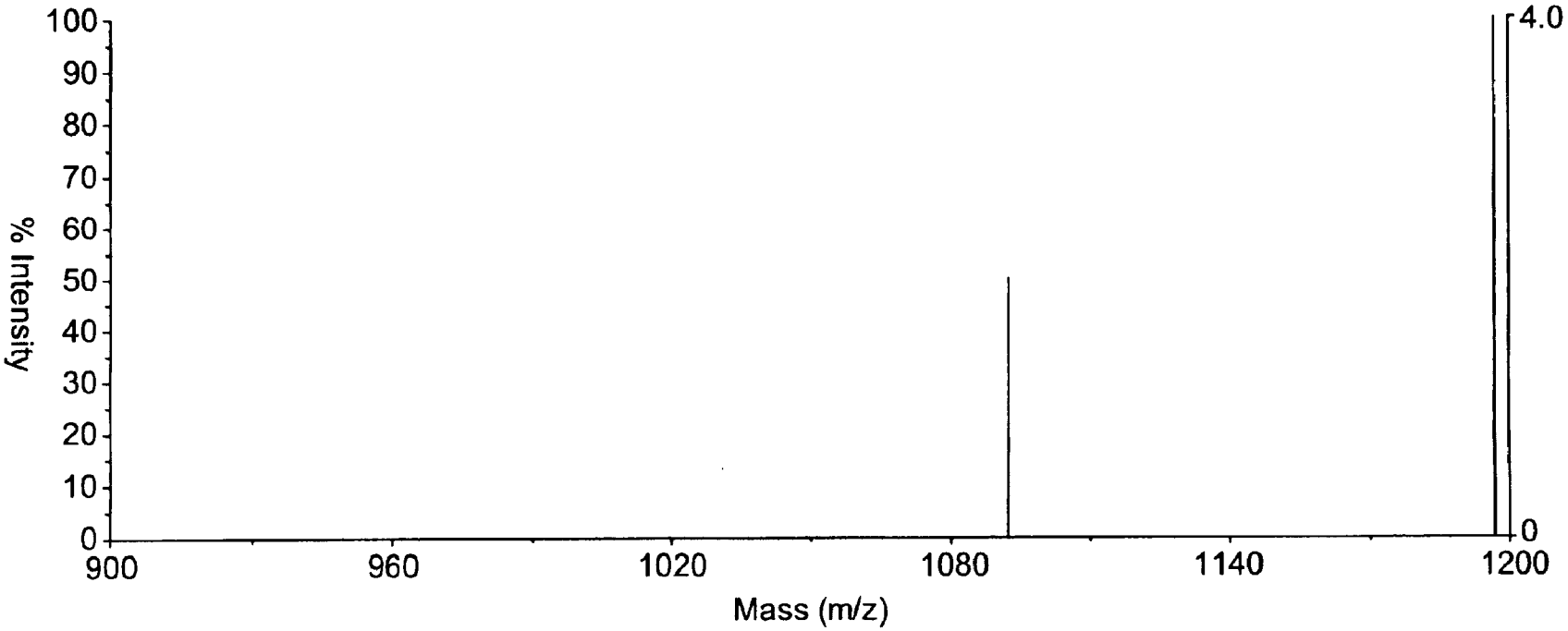
FIG. 30 is a mass spectrum of bradykinin (1000 ng/μL) off uncoated polypropylene with microstructured surface TYPE A.

FIG. 29 shows a mass spectrum of clonidine taken off of the polypropylene film with the TYPE A structure and no coating. The molecular ion peak can be seen, but the relative intensity is low. FIG. 30 shows a mass spectrum of the higher concentration of bradykinin taken off the same film. No signal can be seen for the peptide.

Figure 31:
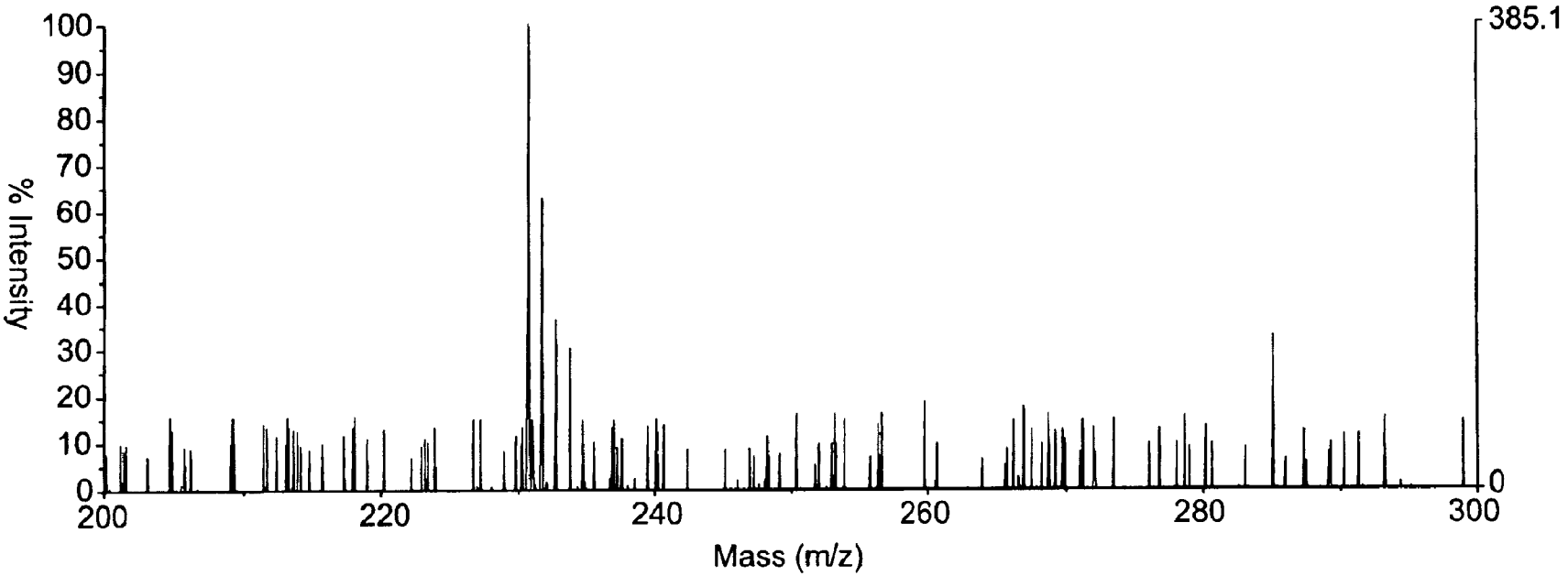
FIG. 31 is a mass spectrum of clonidine off H-DLG coated polypropylene with microstructured surface TYPE A.

FIG. 31 shows a mass spectrum of clonidine taken off of the polypropylene film with the TYPE A structure and H-DLG coating. The spectrum is substantially free from chemical noise, but relative intensity is low. No signal was obtained for either concentration of bradykinin with this film.

Figure 32:
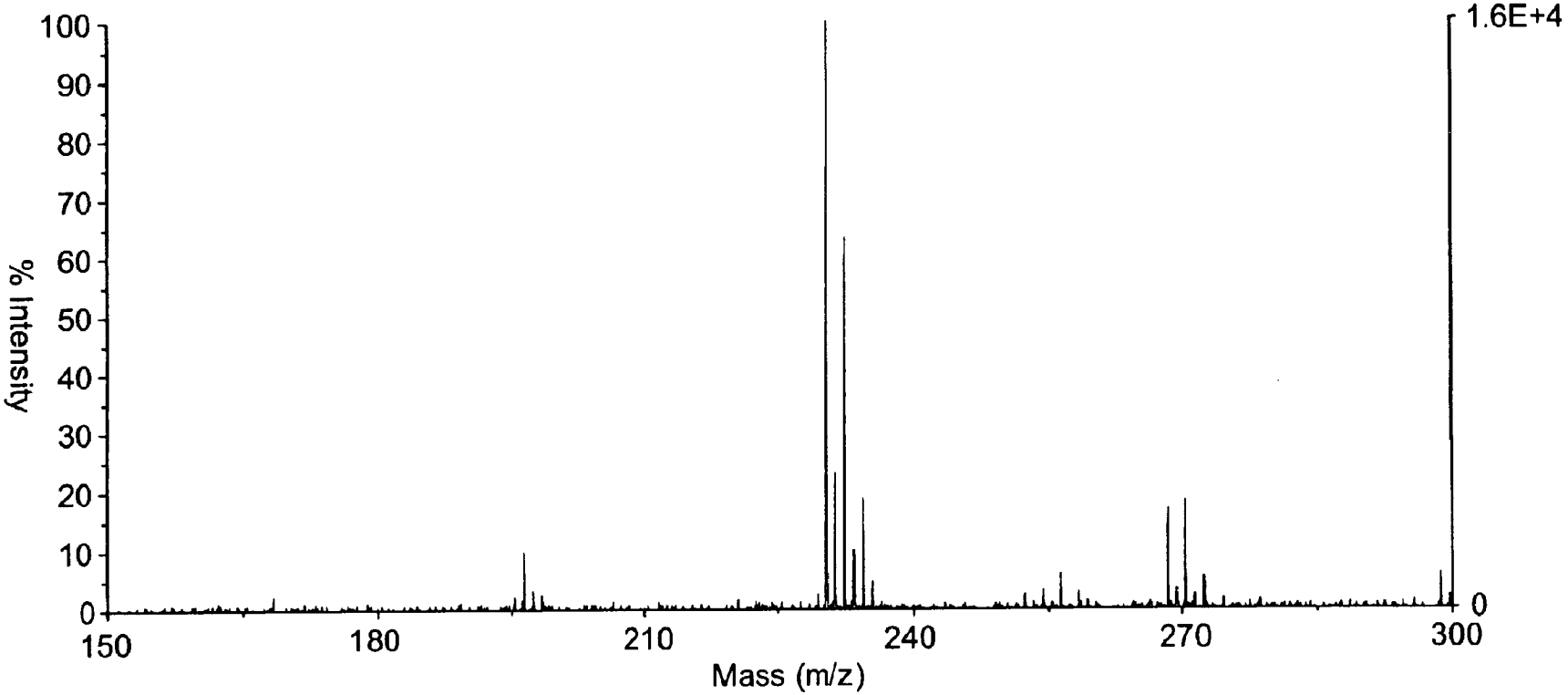
FIG. 32 is a mass spectrum of clonidine off Al-coated polypropylene with microstructured surface TYPE A.
Figure 33:
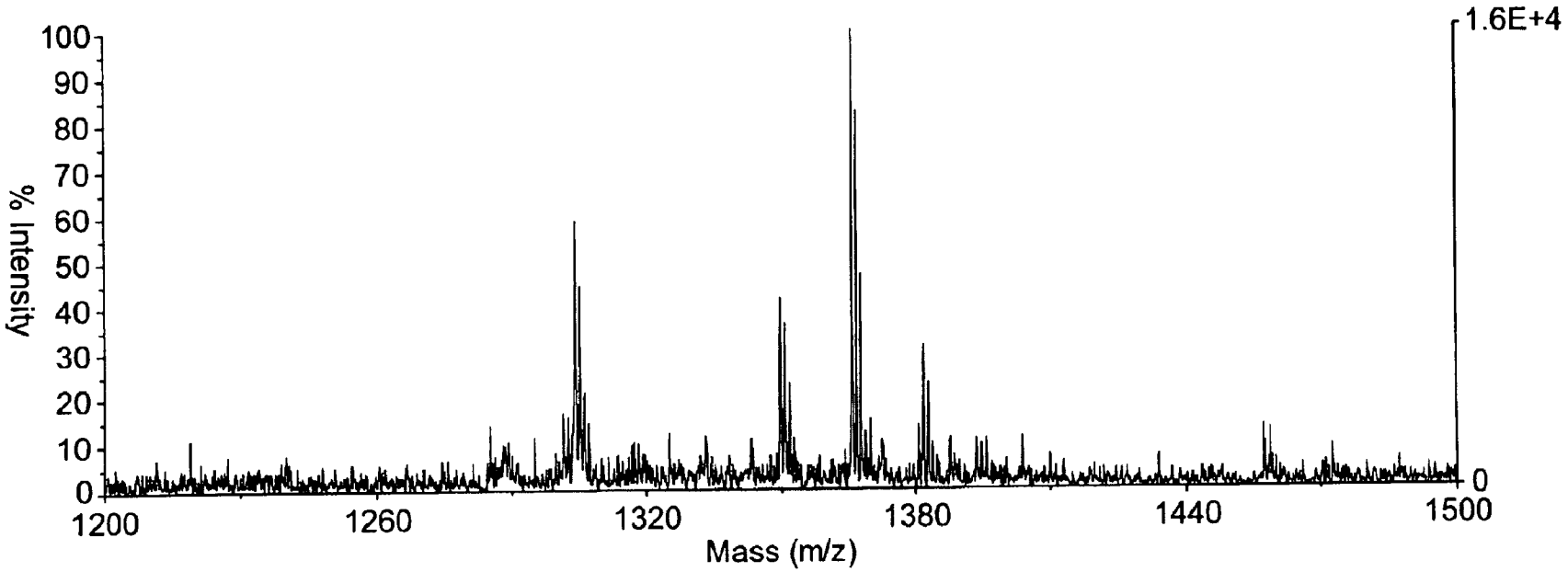
FIG. 33 is a mass spectrum of bradykinin [1000 ng/μL] off Al-coated polypropylene with microstructured surface TYPE A.
Figure 34:
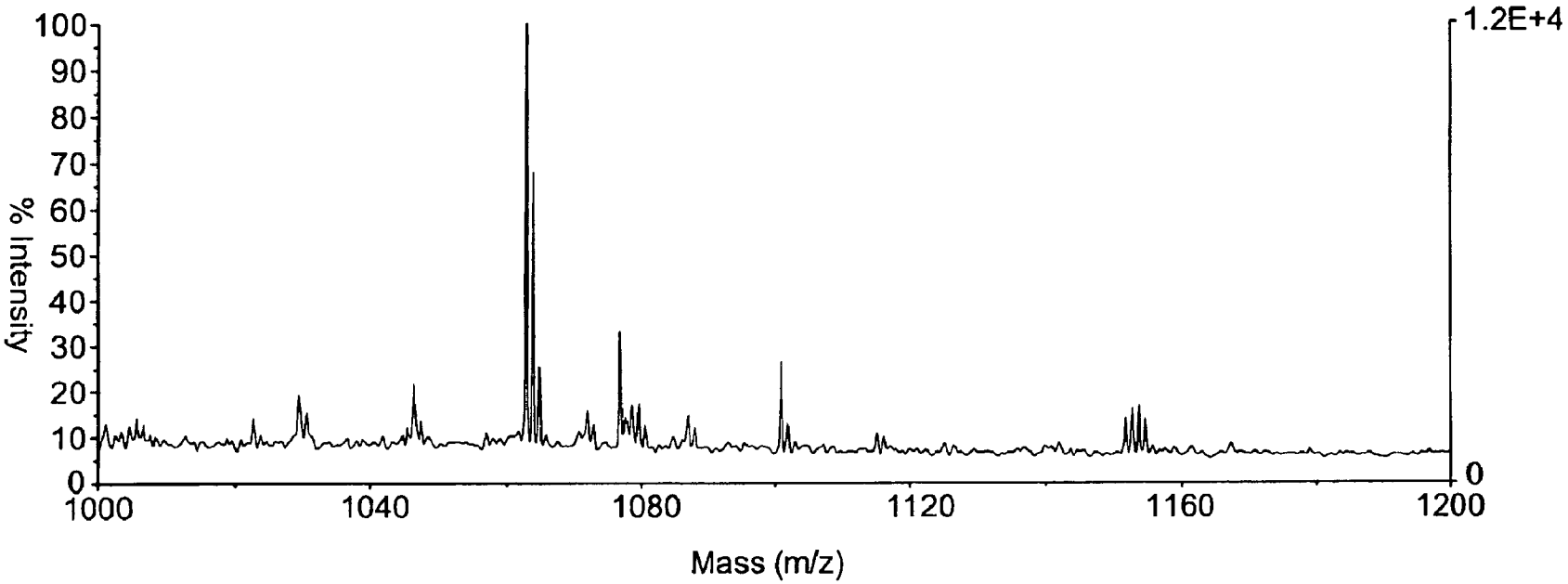
FIG. 34 is a mass spectrum of bradykinin [100 ng/μL] off Al-coated polypropylene with microstructured surface TYPE A.

FIG. 32 shows a mass spectrum of clonidine taken off of the TYPE A microstructured polypropylene film with aluminum coating. The spectrum is relatively clean, with good signal-to-noise. FIG. 33 and FIG. 34 show the mass spectra of the [1000 ng/μL] bradykinin and the [100 ng/μL] bradykinin off the TYPE A microstructured polypropylene film with aluminum coating. The signal to noise is higher than with the uncoated or HDLG-coated TYPE A.

Example 5

This example utilizes a multilayer coating of H-DLG on top of aluminum on polypropylene film with the TYPE A structure. The aluminum coating is continuous, with the H-DLG being applied as discontinuous spots atop the aluminum.

Polypropylene film with the TYPE A structure was obtained and coated with aluminum as described previously. A perforated polymer mask containing 550 μm diameter holes was taped to the film, and the film was then coated with H-DLG, after which the mask was removed. The resulting films contained 550 μm diameter spots of H-DLG over a continuous layer of aluminum.

Three small molecules, clonidine (266.6 Da), haloperidol (375.9 Da), prazosin (419.9 Da), and one peptide, bradykinin (1060.2 Da), were obtained from Sigma Chemical Co. (St. Louis, Mo.) and were used without further purification. A solution containing 100 ng/μL of each analyte in 50:50 HPLC grade methanol/water with 0.1% trifluoro acetic acid was made for each of the analytes.

For each analyte, a volume of 0.5 μL analyte solution was pipetted directly onto one of the H-DLG coated spots on the film. Due to the difference in surface energy between the H-DLG and the surrounding aluminum, the applied sample remained confined within the H-DLG coated area. The samples were allowed to air dry at room temperature for approximately fifteen minutes.

Figure 35:
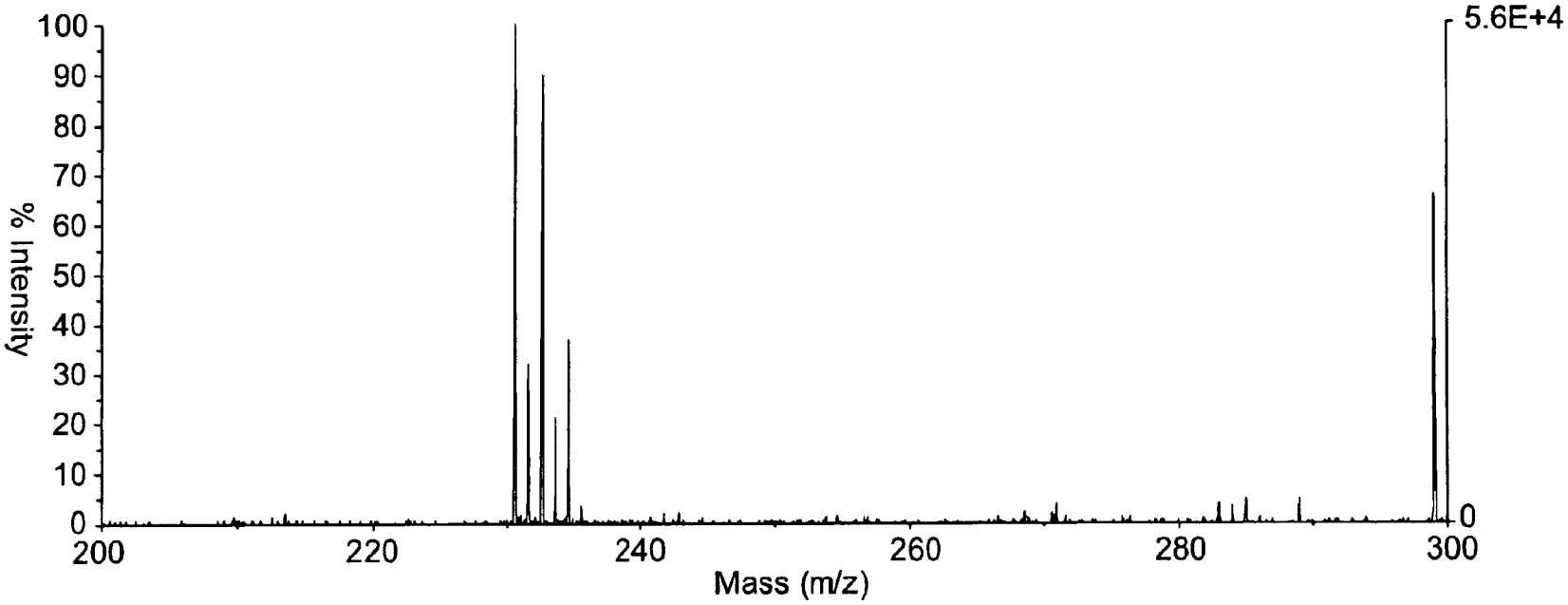
FIG. 35 is a mass spectrum of clonidine off Al/H-DLG coated polypropylene with microstructured surface TYPE A.
Figure 36:
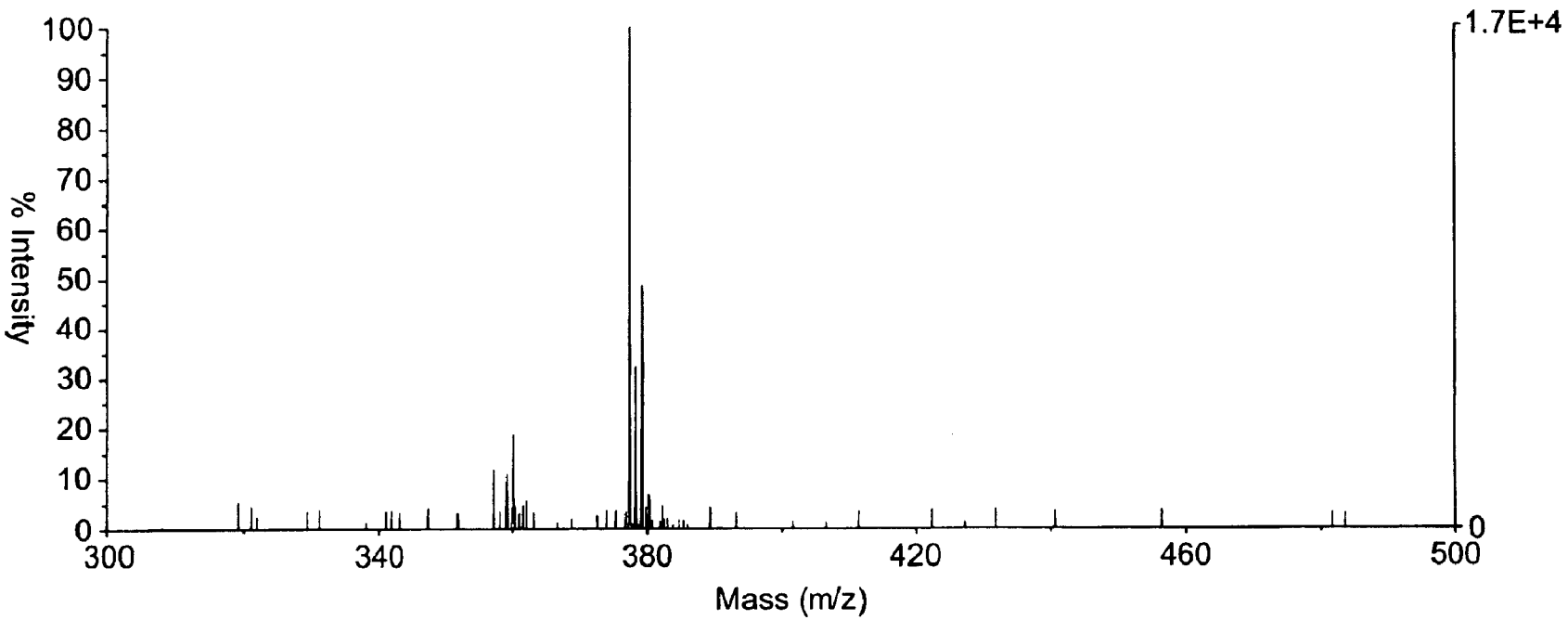
FIG. 36 is a mass spectrum of haloperidol off Al/H-DLG coated polypropylene with microstructured surface TYPE A.
Figure 37:
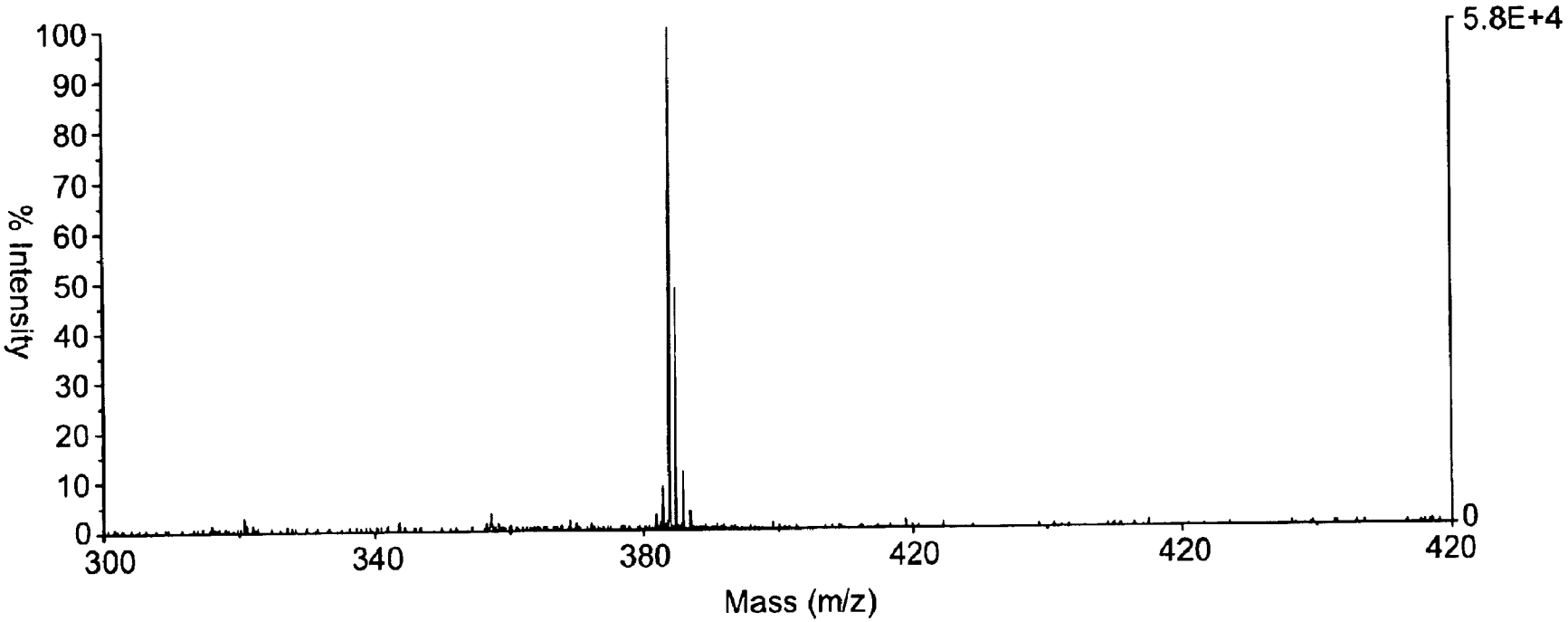
FIG. 37 is a mass spectrum of prazosin off Al/H-DLG coated polypropylene with microstructured surface TYPE A.
Figure 38:
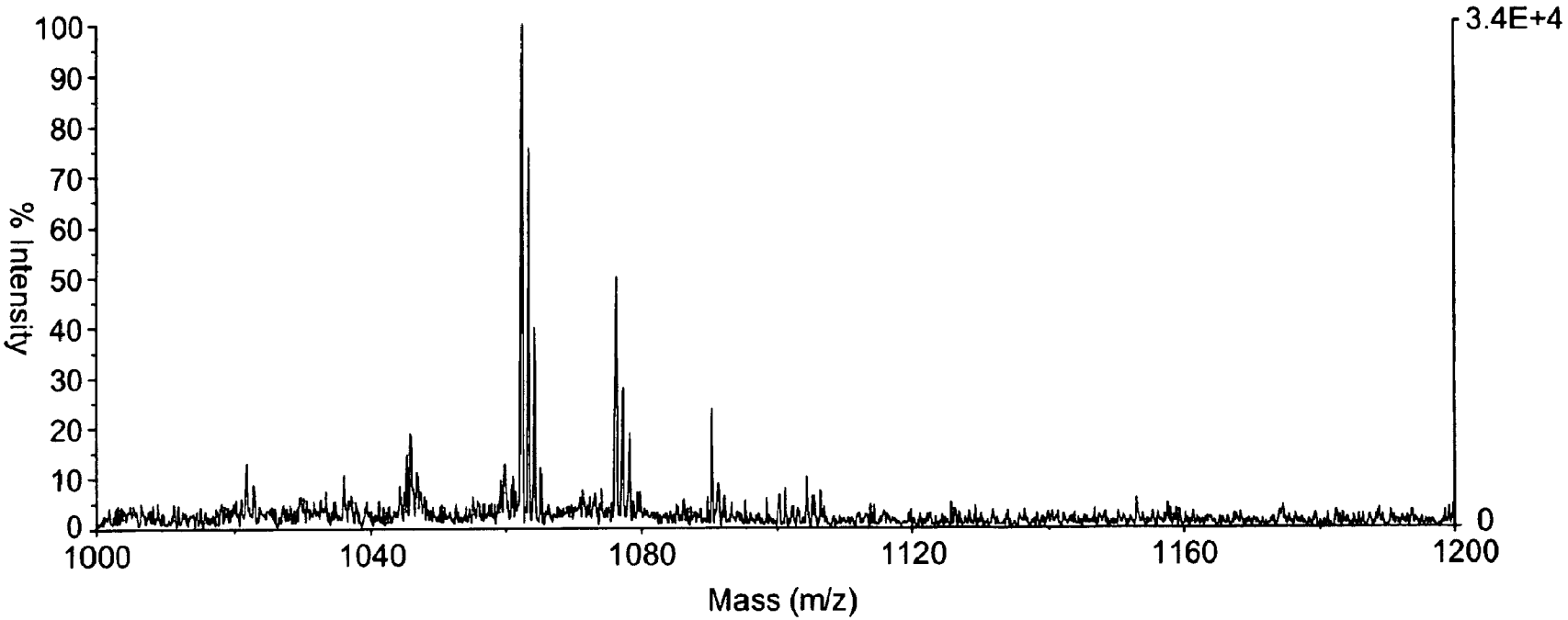
FIG. 38 is a mass spectrum of bradykinin off Al/H-DLG coated polypropylene with microstructured surface TYPE A.

FIG. 35, FIG. 36, and FIG. 37 show mass spectra of the small molecules clonidine, haloperidol, and prazosin taken off of the TYPE A microstructured polypropylene films with aluminum plus hydrophilic DLG coating. As can be seen in all the spectra, extremely high signal-to-noise ratios are achieved with low laser intensity. This leads to a clean spectrum with no extraneous peaks and easy identification of the molecule of interest. FIG. 38 shows a mass spectrum of the peptide bradykinin taken off of the same film. The spectrum has high relative intensity, and once again the molecule of interest is easily picked out. For all spectra, signal uniformity across the dried droplet was very good with no "sweet-spot" phenomenon observed.

Example 6

This example demonstrates the excellent shelf life of aluminum coated TYPE A films over several months of storage.

Polypropylene film with the TYPE A structure was obtained as described and coated with a continuous layer of aluminum. Some film samples were used for mass spectrometry analysis within a few days after coating. Other films were used for analysis after five months storage in covered plastic petri dishes at room temperature.

Two small molecules, clonidine (266.6 Da) and prazosin (419.9 Da) were obtained from Sigma Chemical Co. (St. Louis, Mo.) and were used without any further purification. A solution containing 100 ng/μL of each analyte in 50:50 HPLC grade methanol/water with 0.1% trifluoro acetic acid was made fresh for each of the small molecules. A volume of 3.0 μL of analyte solution was pipetted directly onto the film, and allowed to air dry at room temperature for approximately fifteen minutes.

Figure 39:
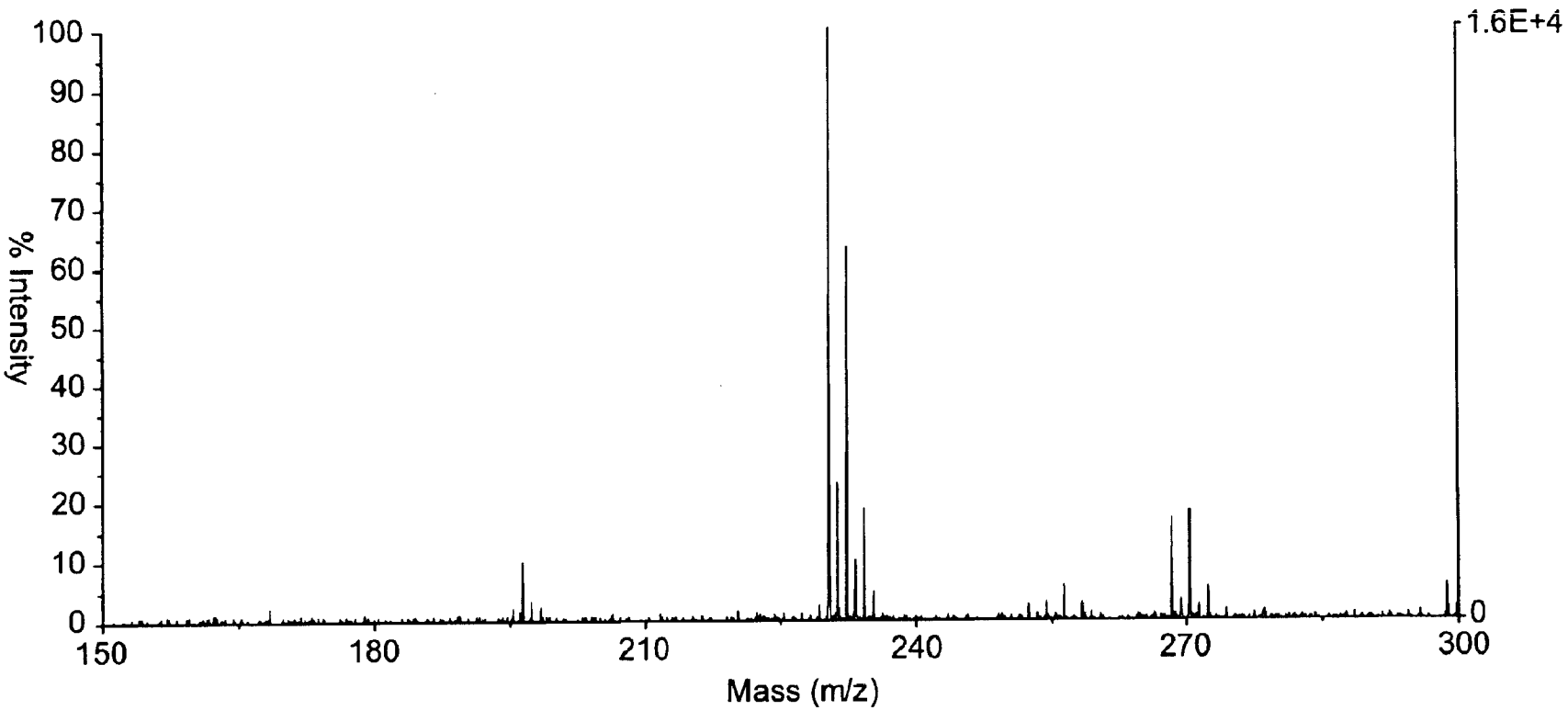
FIG. 39 is a mass spectrum of clonidine off polypropylene with microstructured surface TYPE A freshly coated with aluminum.
Figure 40:
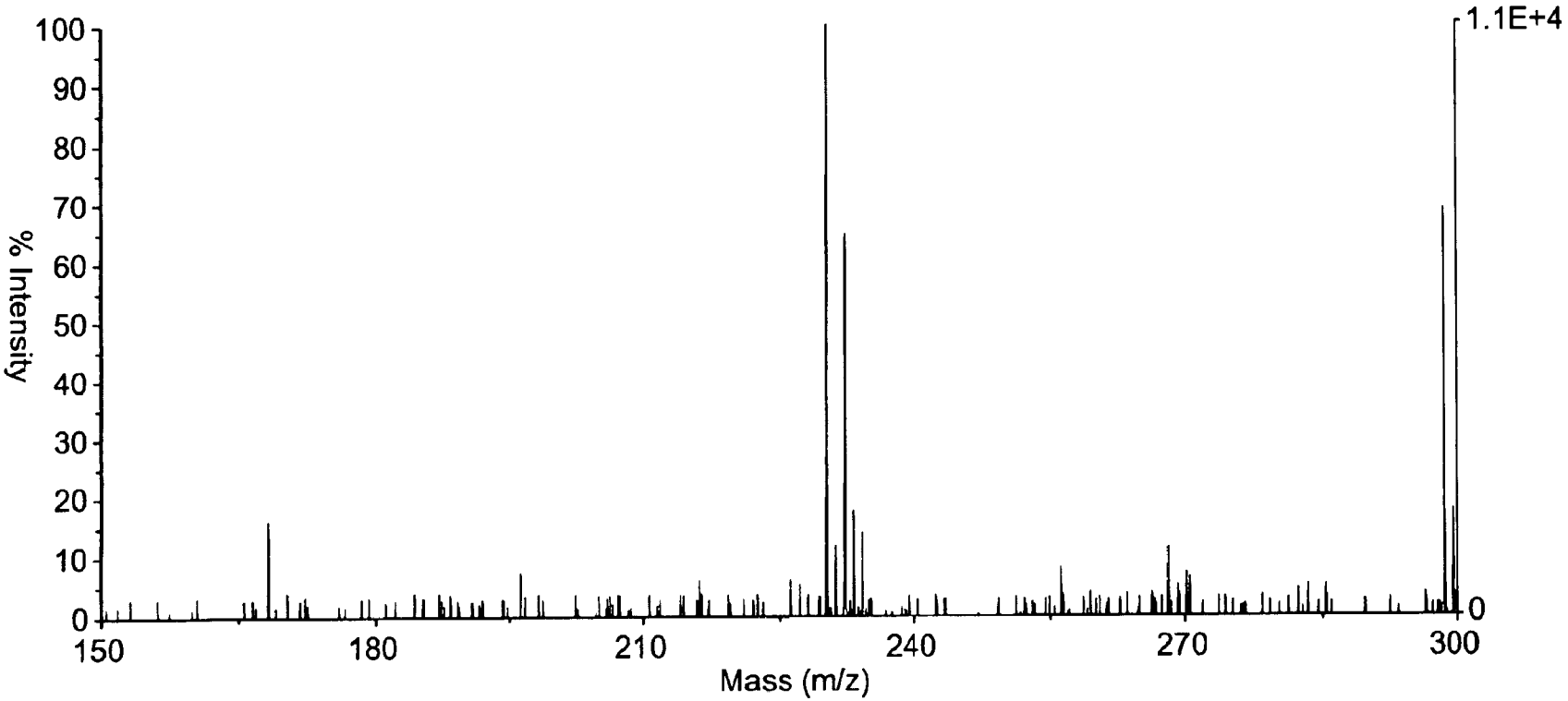
FIG. 40 is a mass spectrum of clonidine off polypropylene with microstructured surface TYPE A coated with aluminum and aged for five months.

FIG. 39 shows a mass spectrum of clonidine taken off of the films freshly coated with aluminum. FIG. 40 shows a mass spectrum of clonidine taken off of film from the same batch five months later with fresh analytes applied. No deterioration in performance is evident with the aged film, in terms of signal-to-noise and spectrum quality. Nor is there any sign of contamination or loss of sensitivity.

Figure 41:
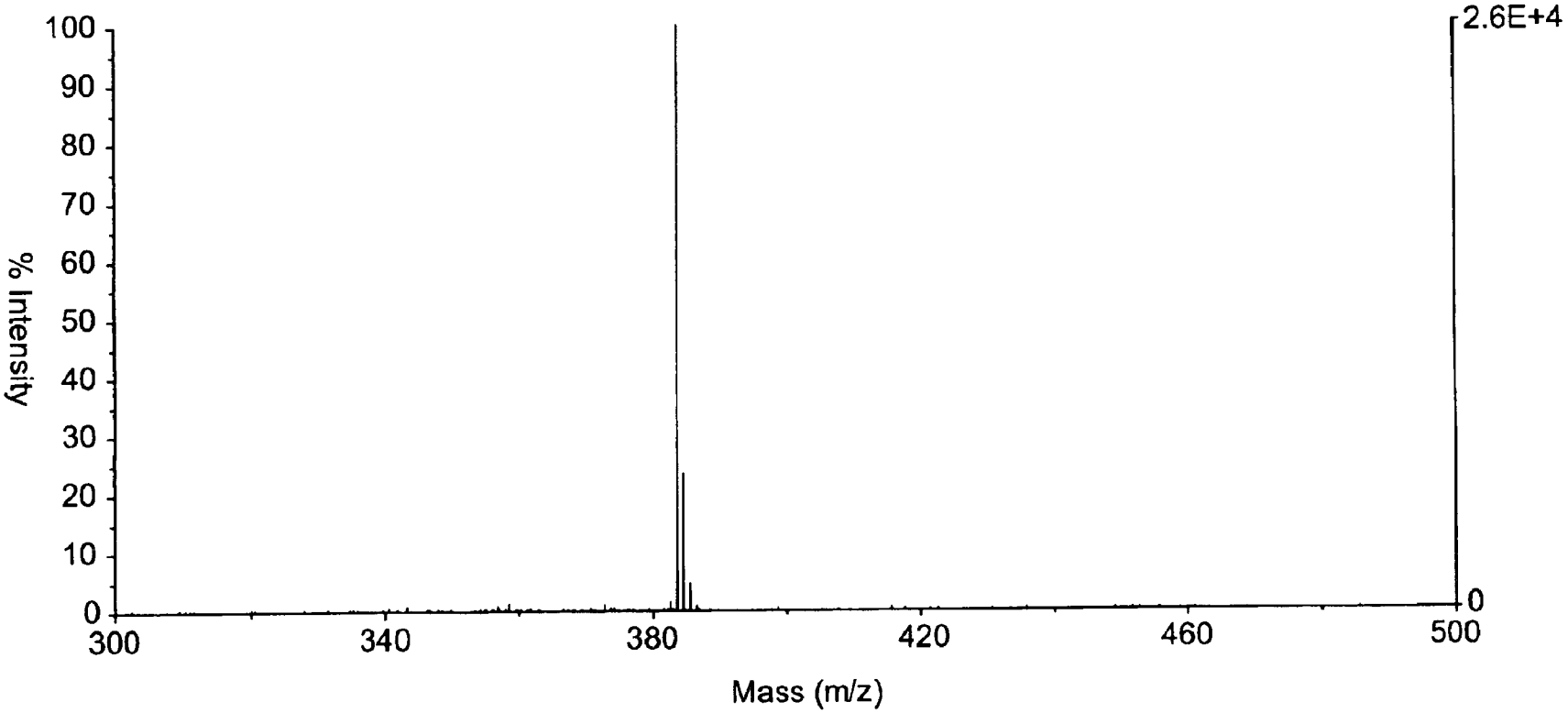
FIG. 41 is a mass spectrum of prazosin off polypropylene with microstructured surface TYPE A freshly coated with aluminum.
Figure 42:
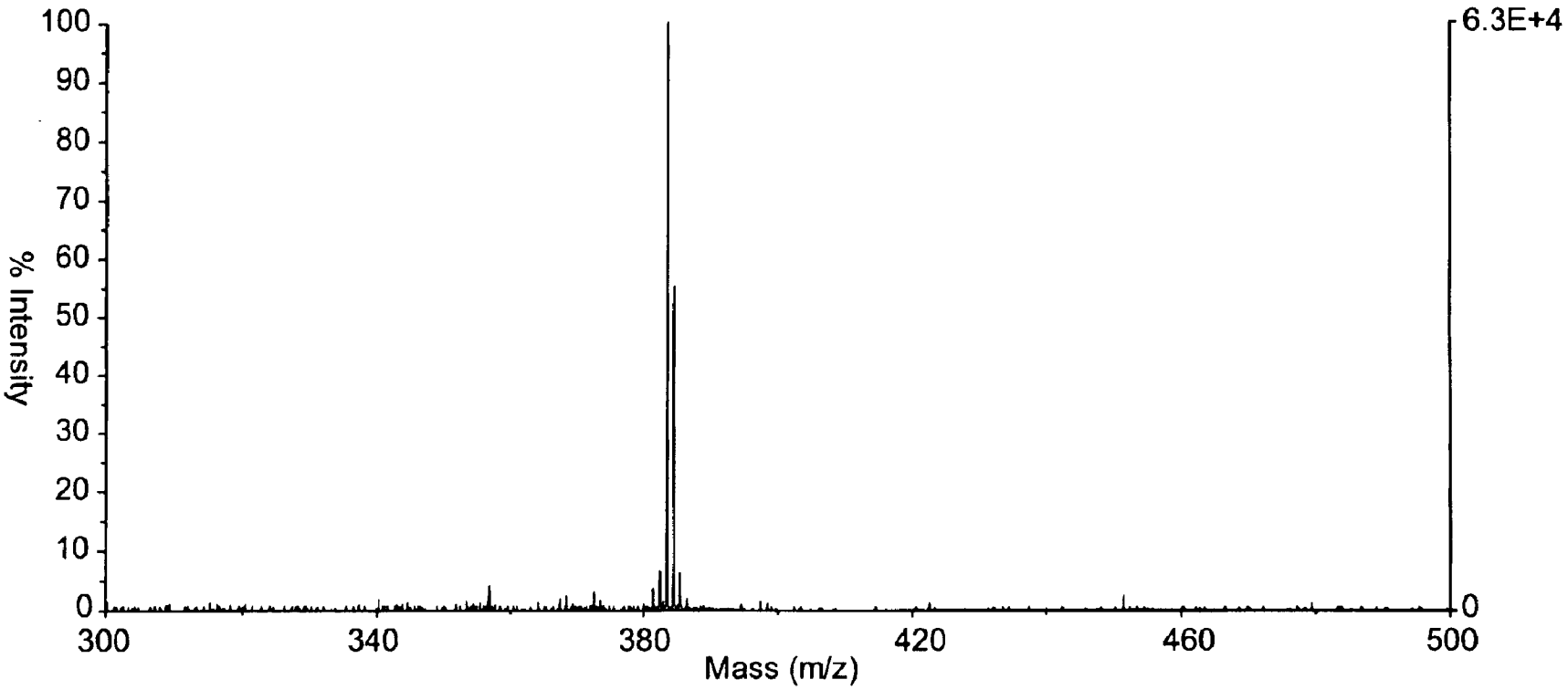
FIG. 42 is a mass spectrum of prazosin off polypropylene with microstructured surface TYPE A coated with aluminum and aged for five months.

FIG. 41 shows a mass spectrum of prazosin taken off of freshly coated films. FIG. 42 shows a mass spectrum of prazosin taken off of the same batch of film five months later with fresh analytes applied. Again, the aged film shows excellent signal-to-noise with excellent spectrum quality.

Example 7

This example illustrates the effect of structure versus nonstructure for the polycarbonate TYPE B ("PCTYPE B") structure with graphite coating.

Smooth polycarbonate film and polycarbonate film bearing the TYPE B structure were obtained as described previously. A 1: 40 dilution of Colloidal Graphite Paint from Energy Beam Sciences Inc. (Agawam, Mass.) in isopropanol was made. A coating of the diluted graphite dispersion was applied to the nonstructured polycarbonate and the TYPE B microstructured polycarbonate. This was accomplished by dipping a cotton swab into the dispersion and swabbing the dispersion onto the film. Two separate swabbings were performed, perpendicular to each other, to ensure complete coverage. The coating was allowed to dry for several hours prior to sample deposition.

One small molecule, clonidine (266.6 Da), and one peptide, angiotensin II (1046.2 Da), were obtained from Sigma Chemical Co. (St. Louis, Mo.) and were used without further purification. A solution containing 100 ng/μL of the analyte in 50:50 HPLC grade methanol/water with 0.1% trifluoro acetic acid was made for the small molecule. A solution containing 1000 ng/μL of the analyte in water was made for the peptide.

A volume of 1.5 μL of analyte was pipetted directly onto the film, and allowed to air dry for approximately fifteen minutes.

Figure 43:
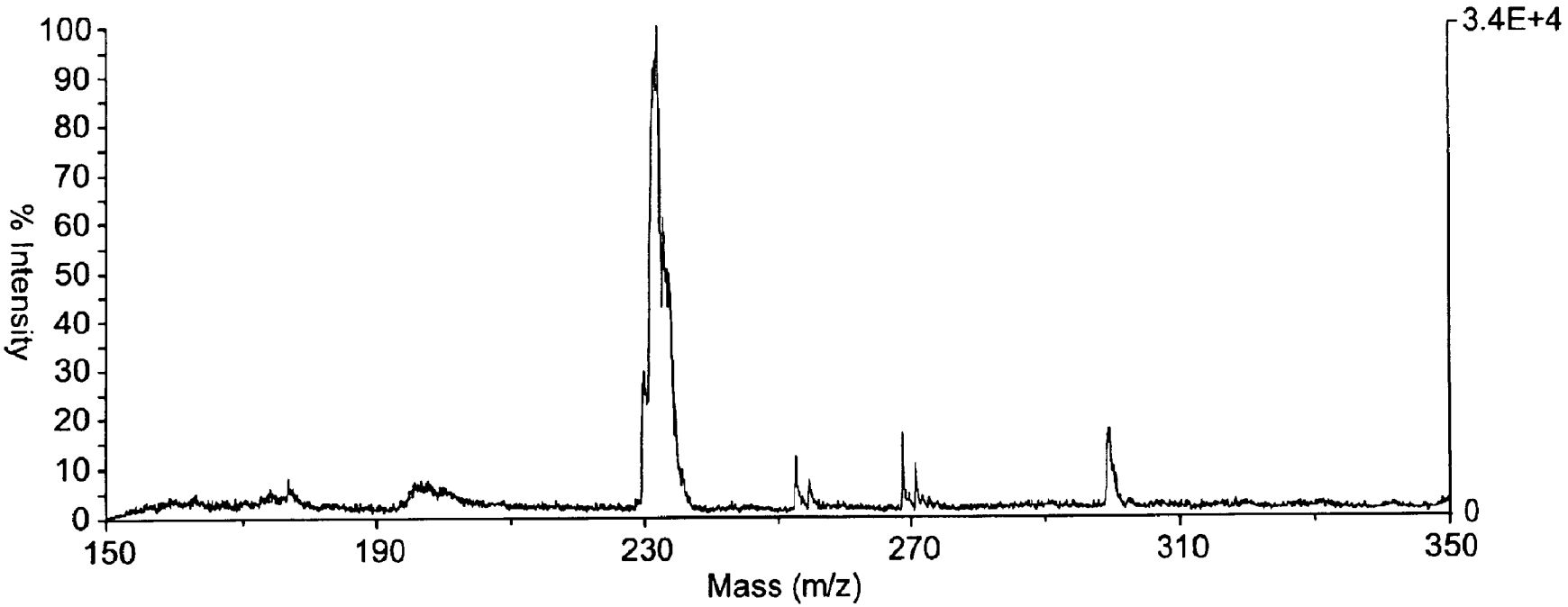
FIG. 43 is a mass spectrum of clonidine off smooth polycarbonate coated with colloidal graphite.
Figure 44:
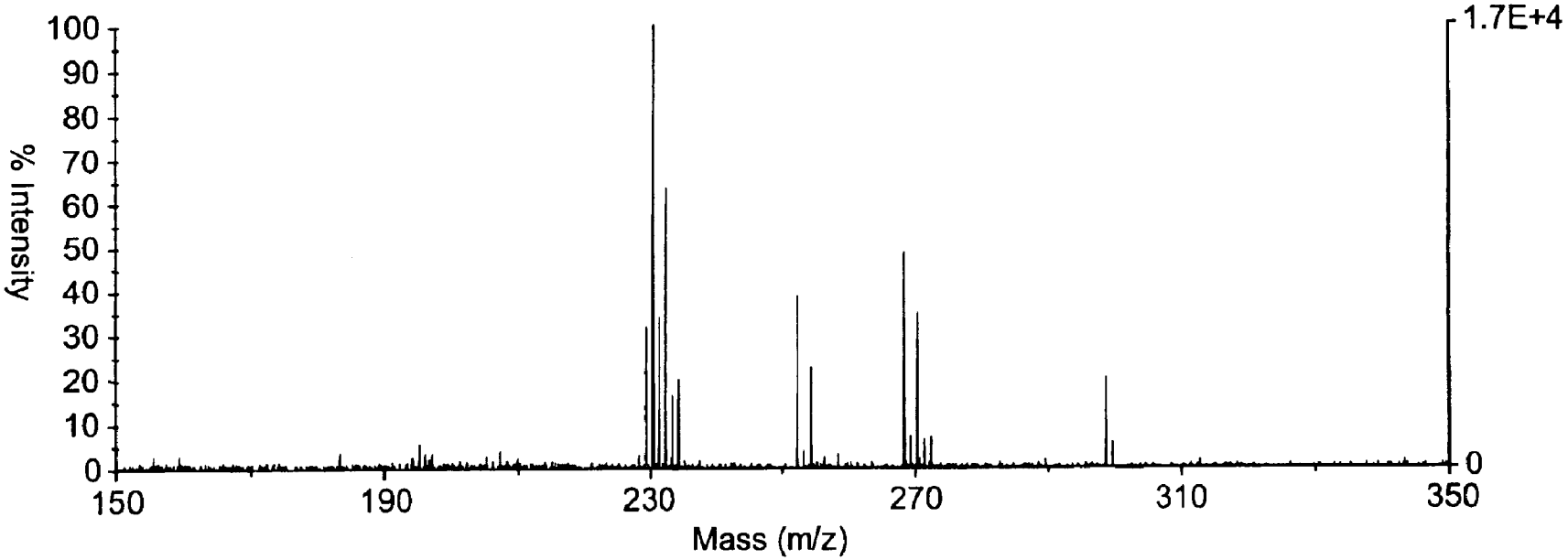
FIG. 44 is a mass spectrum of clonidine off polycarbonate with microstructured surface TYPE B coated with colloidal graphite.

FIG. 43 shows the mass spectrum of clonidine off the nonstructured polycarbonate film. The high laser intensity needed to ionize the analyte led to very low resolution, and the isotopes of the molecule cannot be distinguished. FIG. 44 shows the mass spectrum of clonidine off the polycarbonate film with the TYPE B structure. The spectrum quality is much improved, with the isotope peaks being clearly resolved and the signal-to-noise ratio being much higher than the spectrum taken off the nonstructured film.

Figure 45:
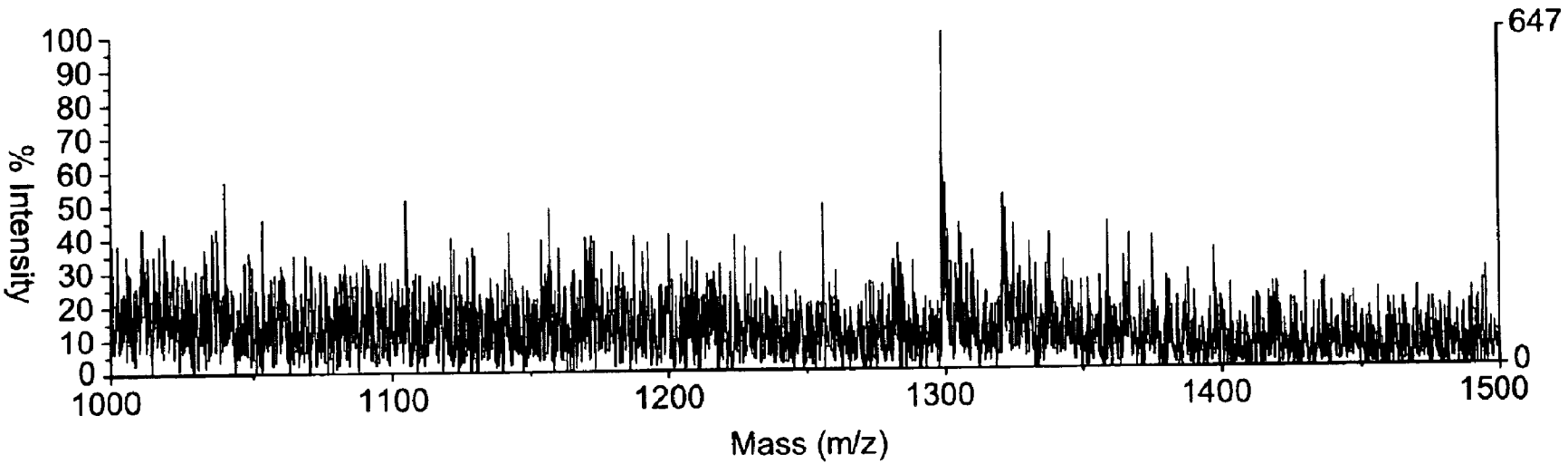
FIG. 45 is a mass spectrum of Angiotensin II off smooth polycarbonate film coated with colloidal graphite.
Figure 46:
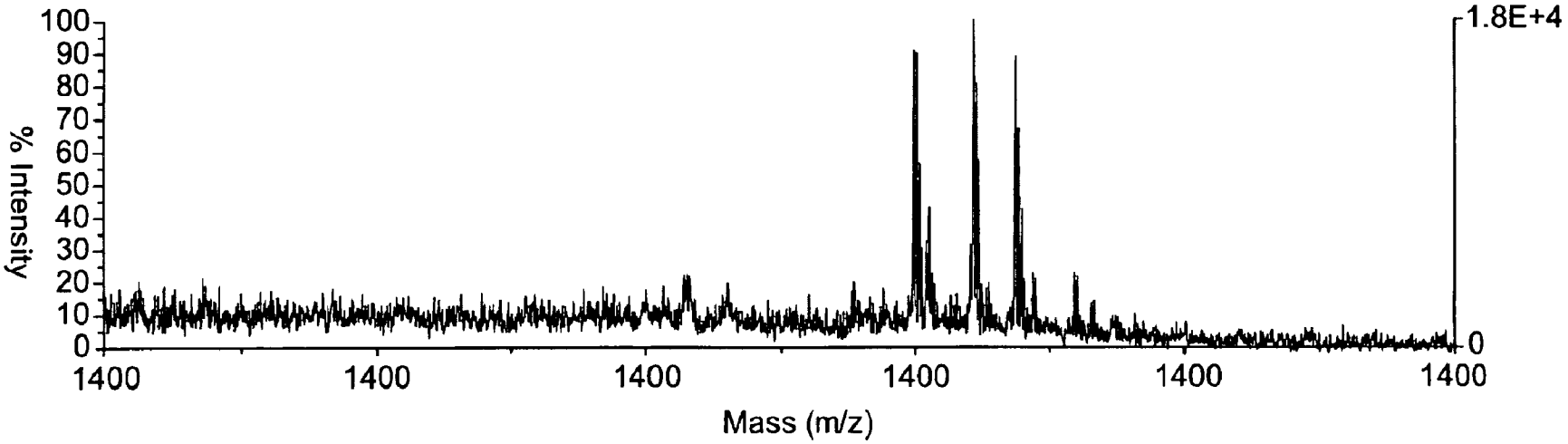
FIG. 46 is a mass spectrum of Angiotensin II off polycarbonate with microstructured surface TYPE B coated with colloidal graphite.

FIG. 45 shows the mass spectrum of angiotensin II off the nonstructured polycarbonate film. There is a great deal of baseline noise, and the analyte peak is hard to detect. FIG. 46 shows the mass spectrum of angiotensin II off the TYPE B microstructured polycarbonate film. There is much less noise, the molecular ion is easily detectable, and the signal to noise is much improved.

Example 8

This example illustrates the effect of graphite coating versus no coating for the polycarbonate TYPE B structure.

Polycarbonate bearing the TYPE B structure was obtained and coated with graphite as described previously. Separate samples of the polycarbonate with TYPE B structure were not coated.

One small molecule, clonidine (266.6 Da), and one peptide, angiotensin II (1046.2 Da), were obtained from Sigma Chemical Co. (St. Louis, Mo.) and were used without further purification. A solution containing 100 ng/μL of the analyte in 50:50 HPLC grade methanol/water with 0.1% trifluoro acetic acid was made for the small molecule. A solution containing 1000 ng/μL of the analyte in water was made for the peptide.

A volume of 1.5 μL of analyte solution was pipetted directly onto the film, and allowed to air dry for approximately fifteen minutes.

Figure 47:
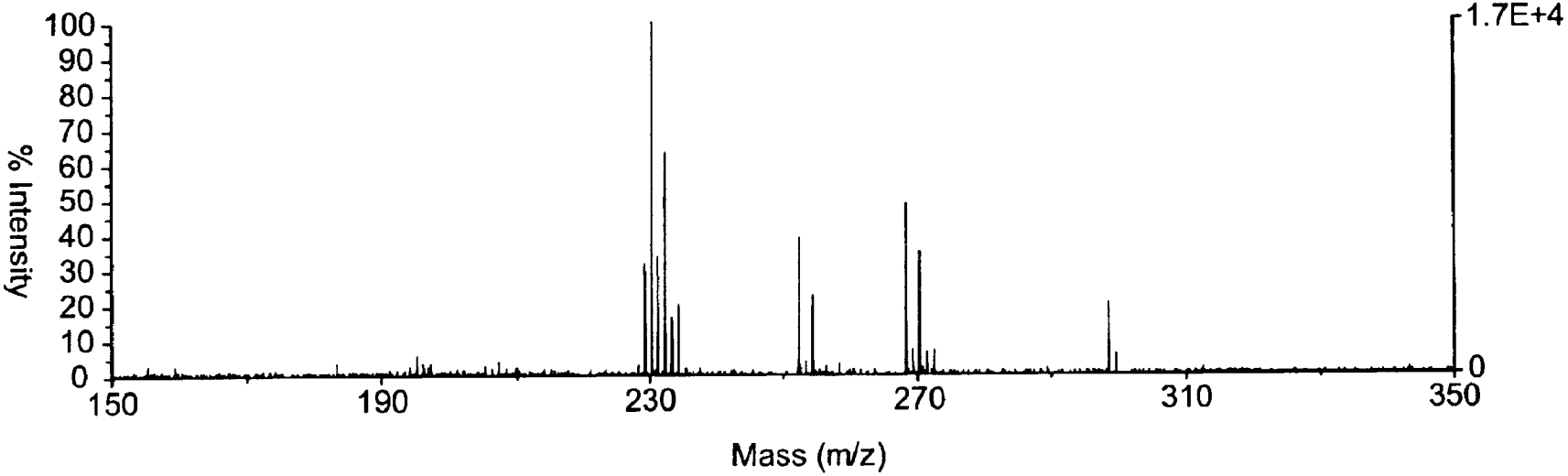
FIG. 47 is a mass spectrum of clonidine off polycarbonate with microstructured surface TYPE B coated with colloidal graphite.
Figure 48:
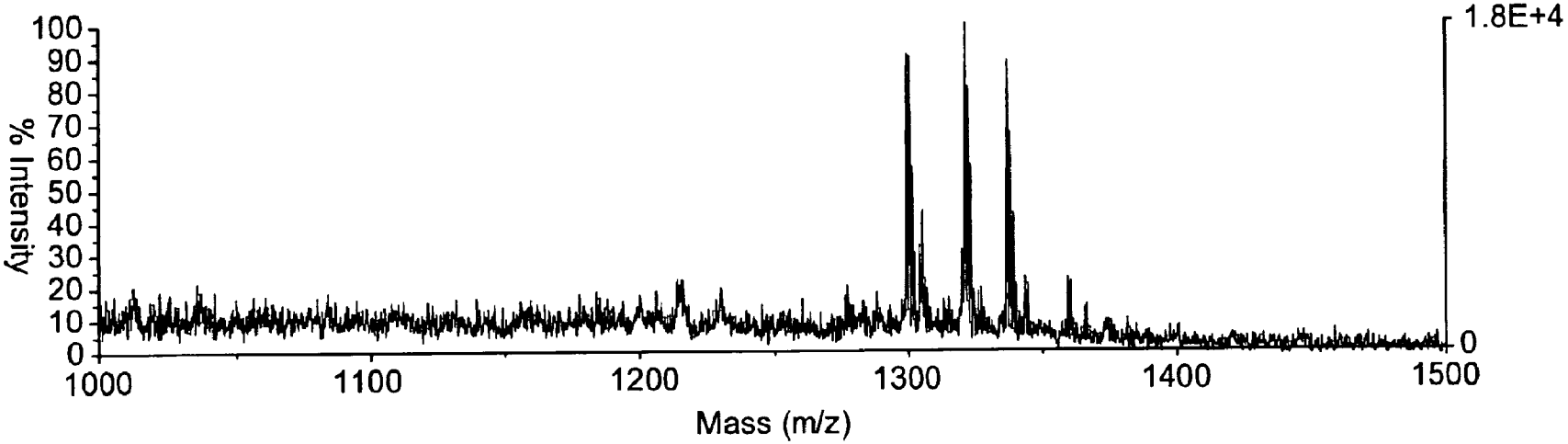
FIG. 48 is a mass spectrum of Angiotensin II off polycarbonate with microstructured surface TYPE B coated with colloidal graphite.

FIG. 47 shows the mass spectrum of clonidine off the graphite coated polycarbonate film with the TYPE B structure. The spectrum quality is good, and the isotope peaks are clearly resolved. The signal to noise ratio is excellent. FIG. 48 shows the mass spectrum of angiotensin II off the same TYPE B microstructured polycarbonate film. Spectrum quality is good with the molecular ion being easily detectable.

Figure 49:
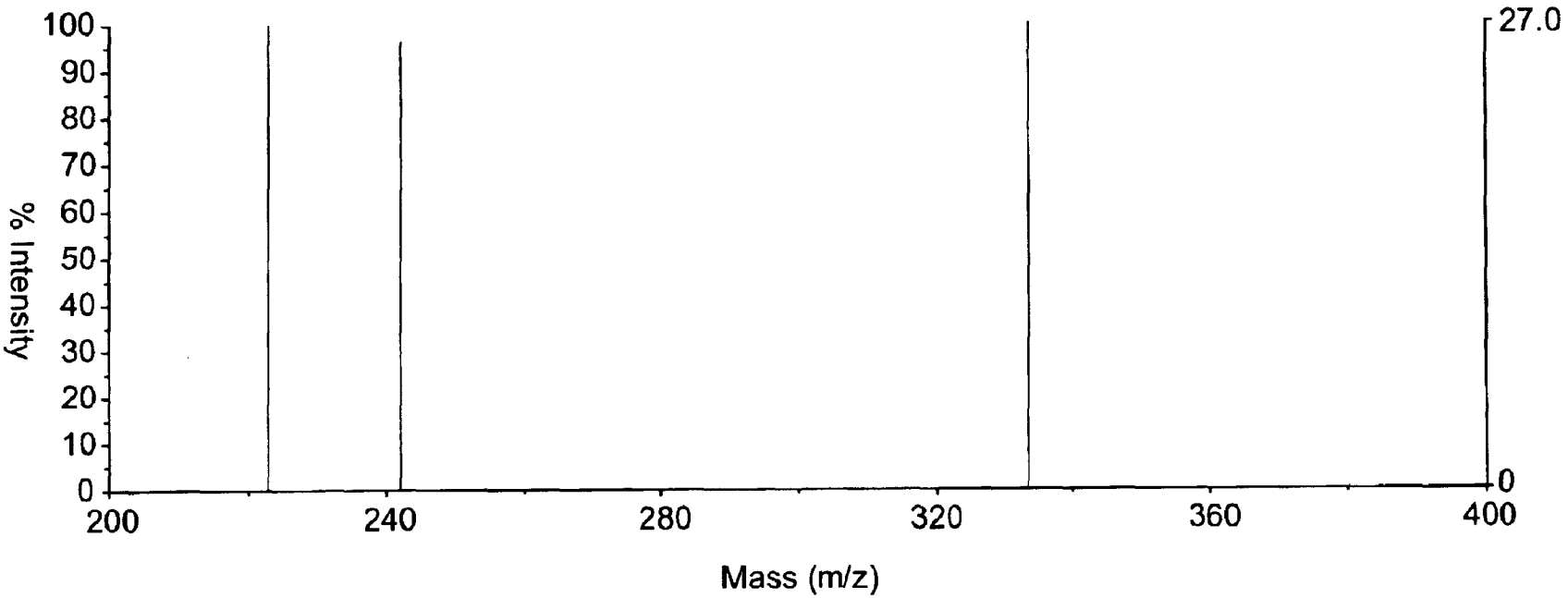
FIG. 49 is a mass spectrum of clonidine off polycarbonate with microstructured surface TYPE B with no coating.

FIG. 49 shows the mass spectrum of clonidine off the polycarbonate film with the TYPE B structure and no coating. There is a small analyte peak, but the relative intensity and signal-to-noise ratio are low. For angiotensin II off the polycarbonate film with the TYPE B structure and no coating, no peptide peaks were found (figure not shown).

Example 9

This example illustrates the use of the microstructured substrate in allowing both positive (cation) and negative (anion) analysis off the same substrate. The example also demonstrates use of the microstructured substrate for analyte mixtures.

Polypropylene with the TYPE A structure was obtained as described previously. A perforated polymer mask containing 550 μm diameter holes was taped to the film. The film was coated with aluminum followed by H-DLG, after which the mask was removed. The resulting films contained 550 μm diameter spots of H-DLG superimposed over aluminum.

A proprietary mix of eight compounds in mass range 150–600 Da, representative of those often encountered in combinatorial chemistry analysis, was obtained and was dissolved in methanol in concentration ranges from 0.1 to 0.3 μg/μL. 0.3 μL samples of analyte solution were pipetted onto the spots on the film and allowed to air dry for about fifteen minutes.

Figure 50:
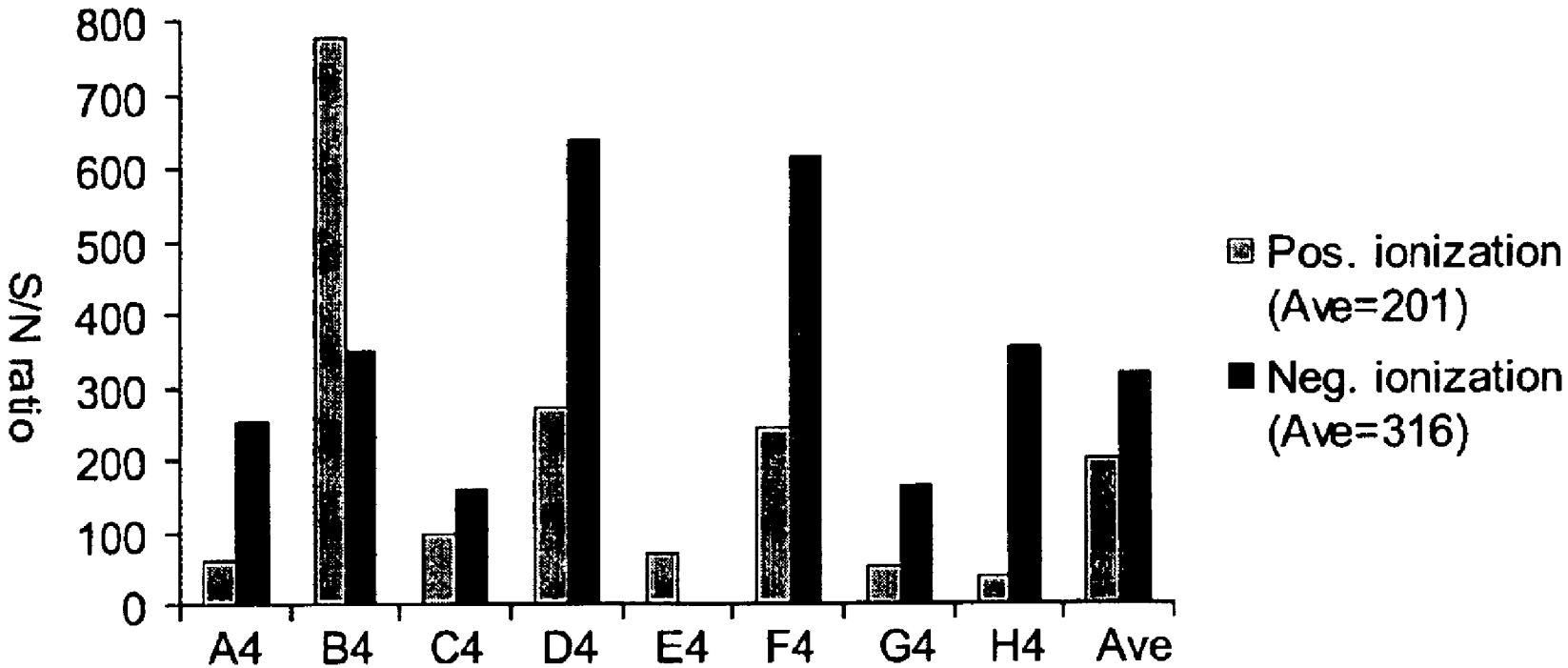
FIG. 50 is a Table showing Signal to Noise versus ionization mode for various analytes off Al/H-DLG coated polypropylene with microstructured surface TYPE A.

In FIG. 50 is presented the signal to noise data obtained for the main peak (or molecular ion peak) of each of the eight representative compounds and the average over all eight compounds. Acceptable signal to noise is seen to be obtainable in both positive and negative ionization mode.

Example 10

This example illustrates the use of a superimposed fine scale/large scale structure-within-structure substrate, coated with Al/H-DLG.

Polypropylene copolymer film with the structure-within-structure topology shown in FIG. 8 was obtained as described previously. An adhesive-backed polymer mask with an array of 1.4 mm diameter holes was adhered to the film. The film was coated with aluminum followed by H-DLG, after which the mask was removed. The resulting films contained 1.4 mm diameter spots of H-DLG superimposed over aluminum.

One small molecule, clonidine (266.6 Da), and one peptide, bradykinin (1060.2 Da), were obtained from Sigma Chemical Co. (St. Louis, Mo.) and used without further purification. Solutions containing 20 ng/μL of clonidine in 50:50 HPLC grade methanol/water with 0.1% trifluoro acetic acid, and 100 ng/μL of bradykinin in 50:50 HPLC grade methanol/water with 0.1% trifluoro acetic acid, were made. For each analyte, a volume of 0.2 μL of analyte solution was pipetted directly onto one of the coated spots on the film and allowed to air dry at room temperature for approximately fifteen minutes.

Figure 51:
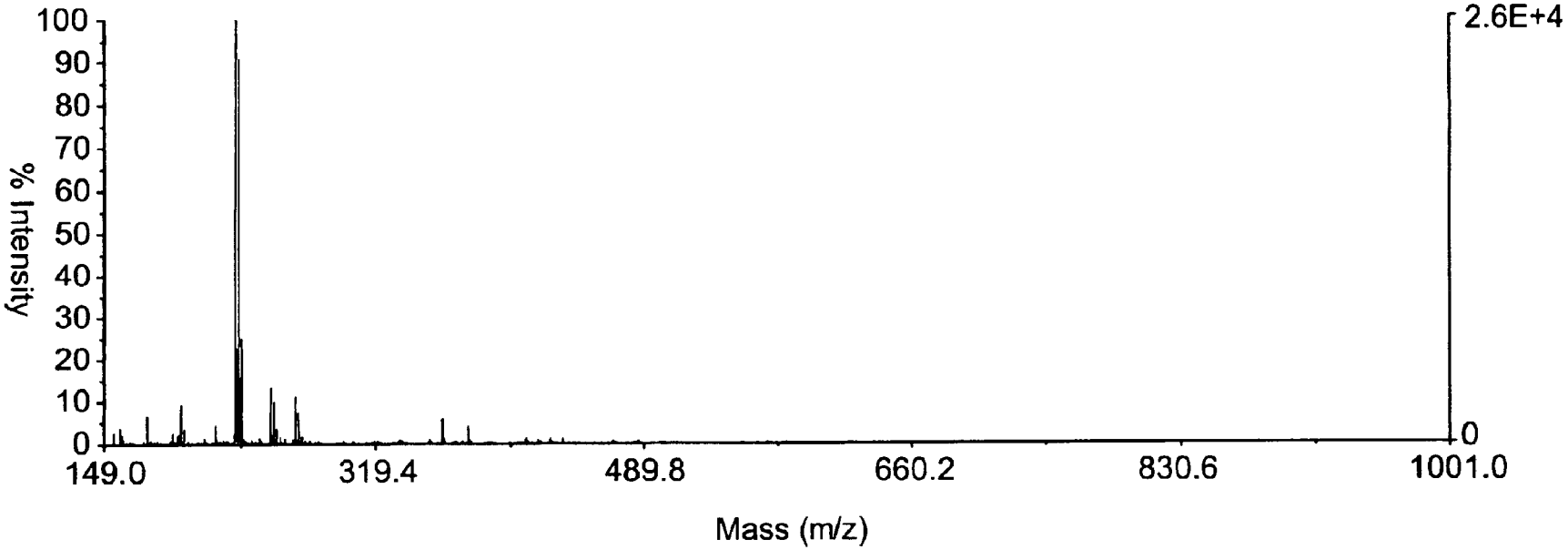
FIG. 51 is a mass spectrum of clonidine off Al/H-DLG coated structure-within-structure film.
Figure 52:
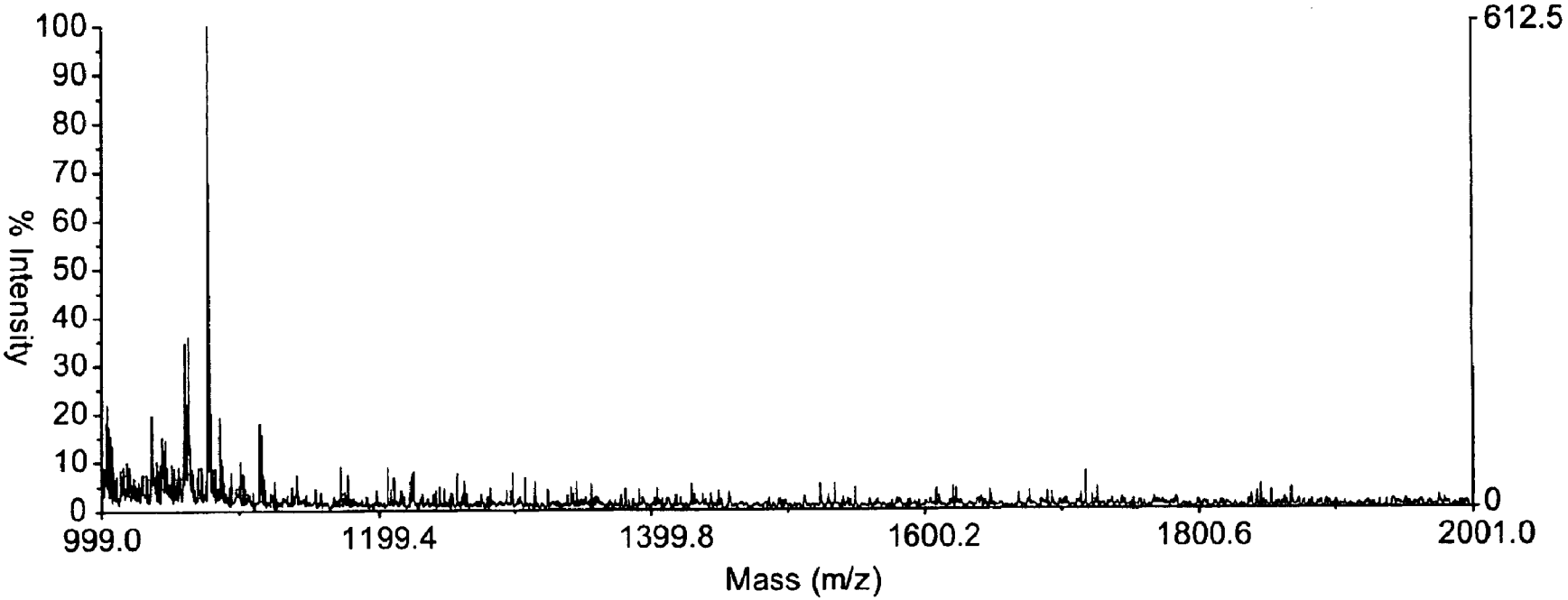
FIG. 52 is a mass spectrum of bradykinin off Al/H-DLG coated structure-within-structure film.

FIG. 51 shows the mass spectrum for clonidine off of the structure-within-structure film. The spectrum has high relative intensity, good signal-to-noise and relatively little chemical noise. FIG. 52 shows bradykinin off of the structure-within-structure film. Relative intensity is low, but the analyte peak can be clearly seen.

In both cases the structure-within-structure film was found to result in very uniform sample dry-down, as evidenced by easily obtainable spectra with no "sweet-spot" phenomenon.

Example 11

This example illustrates the use of uncoated, microstructured film in the presence of chemical matrix.

Polypropylene bearing the TYPE A structure was obtained and mounted on a commercially available metal MALDI plate using double-faced adhesive tape.

The small molecule clonidine (266.6 Da) was obtained from Sigma Chemical Co. (St. Louis, Mo.). A solution containing 20 ng/μL of the analyte in 50:50 HPLC grade methanol/water with 0.1% trifluoro acetic acid was made. A saturated solution of α-CHCA matrix in 50:50 HPLC grade methanol/water with 0.1% trifluoro acetic acid was diluted five-fold and twenty-fold. A volume of 1 μL of each of the diluted matrix solutions were then mixed with 2 μL of sample solution, yielding a ten and forty-fold total dilution of the matrix. A volume of 0.2 μL of the analyte/matrix solution was pipetted directly onto the film, followed by drying at room temperature for approximately fifteen minutes.

Figure 53:
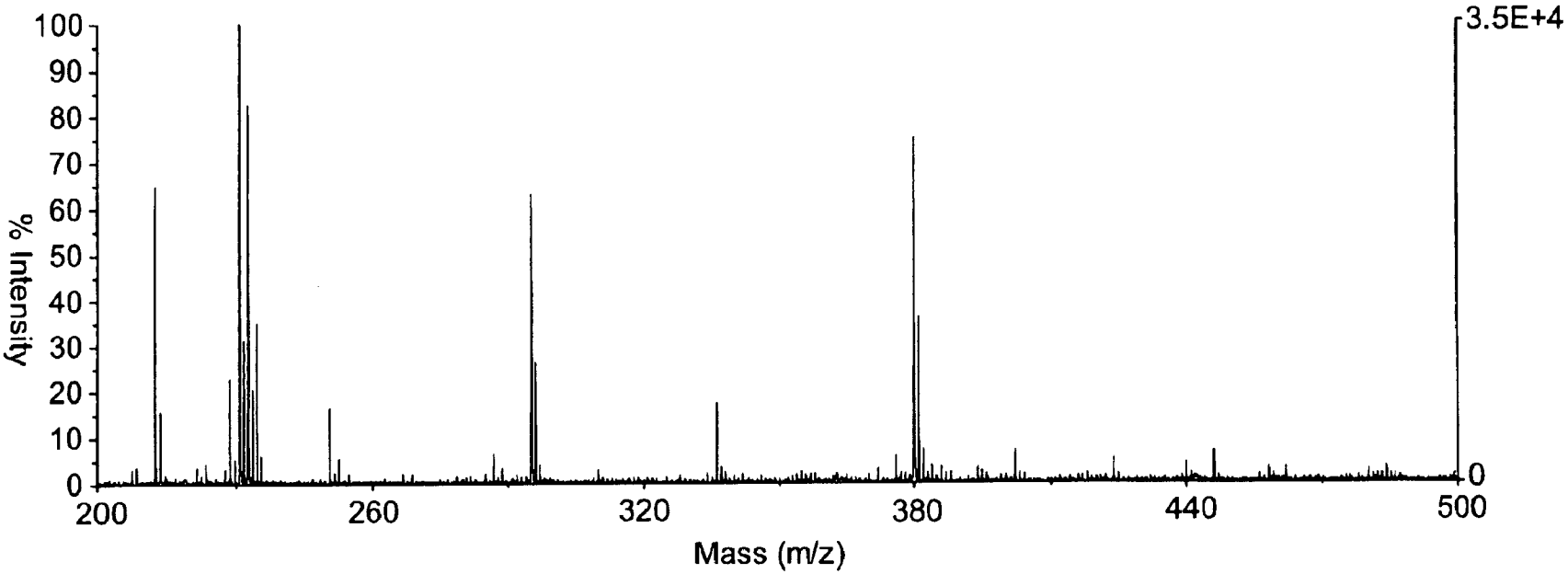
FIG. 53 is a mass spectrum of clonidine off uncoated polypropylene with microstructured surface TYPE A with a 10-fold dilution of CHCA matrix.
Figure 54:
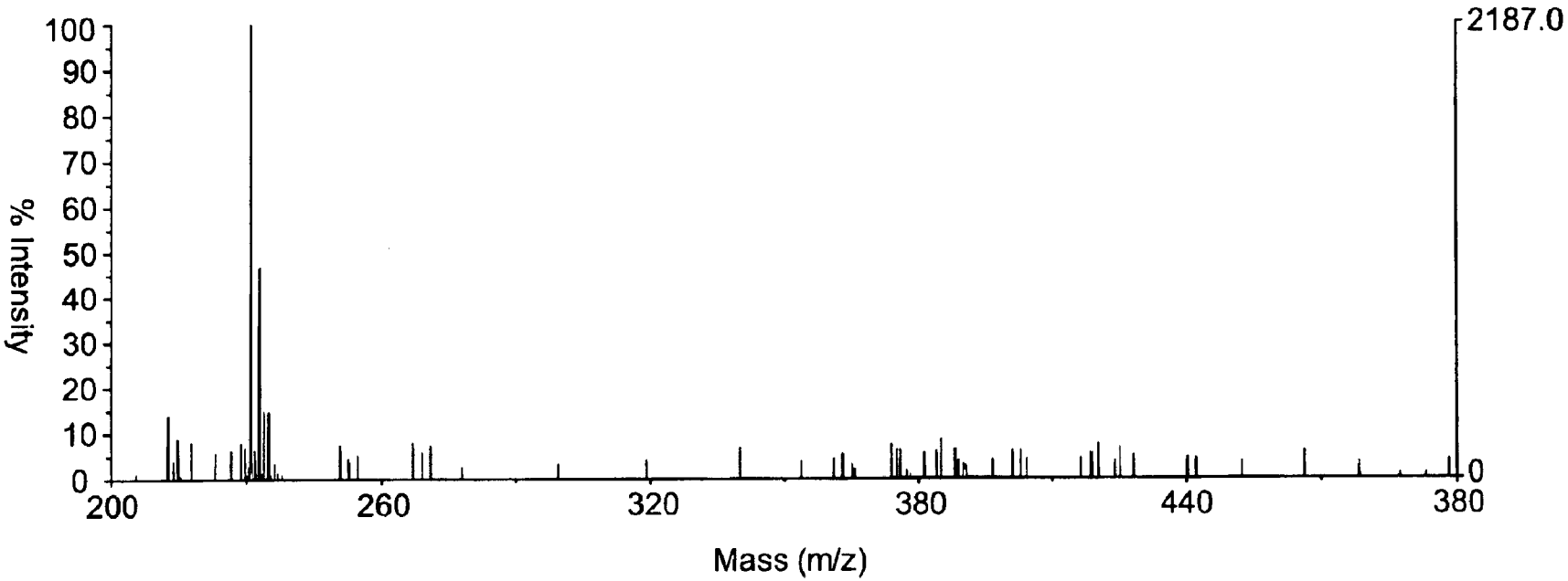
FIG. 54 is a mass spectrum of clonidine off uncoated polypropylene with microstructured surface TYPE A with a 40-fold dilution of CHCA matrix.

FIG. 53 shows the spectra for clonidine using the 10-fold dilution of α-CHCA matrix. The analyte peak has good signal to noise and relative intensity, but there is interference from the matrix peaks. FIG. 54 shows the spectra for clonidine using the 40-fold dilution of α-CHCA matrix. At this dilution level there is less interference from the matrix.

Example 12

This example demonstrates the use of microstructured, coated films in the presence of matrix.

Polypropylene film with the TYPE A structure was obtained as described previously. A metal mask with 500 μm diameter holes was adhered to the film. The film was coated with aluminum, after which the mask was removed. The resulting film contained 500 μm diameter spots of aluminum The Sequazyme™ Peptide Mass Standards Kit (PerSeptive Biosystems, Framingham, Mass.) was used for these experiments. Peptide Calibration Mixture 1, contained the following peptides: des-Arg$^1$-Bradykinin (904.05 Da); Angiotensin I (1296.51 Da); Glu1-Fibrinopeptide B (1570.61 Da); and Neurotensin (1672.96 Da). A stock solution of the peptide mixture was prepared by mixing the peptide standards with 100 μL of 30% acetonitrile in 0.01% TFA. A saturated solution of the matrix, alpha-cyano-4-hydroxycinnamic acid (α-CHCA) was prepared by mixing the pre-measured, 5–8 mg of α-CHCA with 1 ml of 50% acetonitrile in 0.3% trifluoroacetic acid (TFA) diluent. A volume of 24 μL of the standard α-CHCA matrix solution was mixed with 1 μL of the peptide stock solution.

Sample volumes of 0.1 μL or 0.2 μL were pipetted onto the aluminum-coated spots on the film, and allowed to air dry for approximately two minutes. The same sample deposition procedure was used to apply analyte spots to a commercially available stainless steel MALDI plate. No additional sample preparation or sample clean up was done to the samples prior to analysis.

Figure 55:
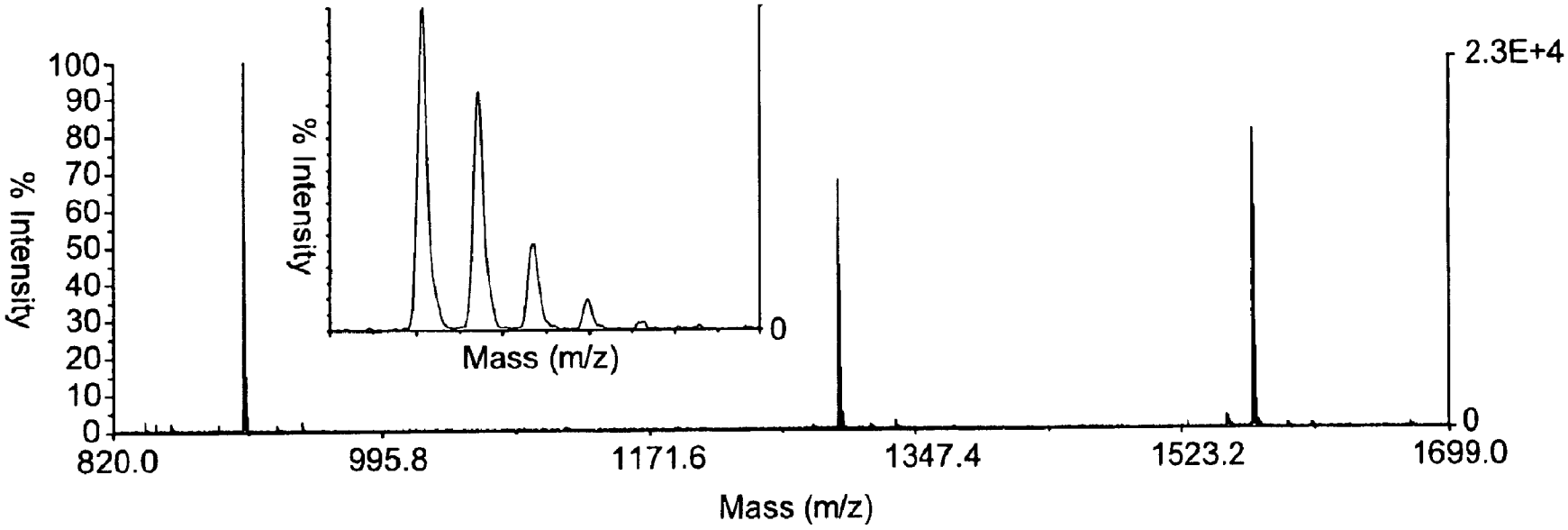
FIG. 55 is a mass spectrum of Calmix I off polypropylene with microstructured surface TYPE A and an aluminum film, with $_{\alpha}$-CHCA matrix.

The positive-ion MALDI mass spectrum obtained from 0.1 μL of Calibration Mixture 1 with α-CHCA on the TYPE A microstructured, Al coated film produced protonated molecular ions (m/z 1570) with a S/N value of 3,620 for Glu-Fibrinopeptide (MW 1569 Da), as shown in FIG. 55).

Figure 56:
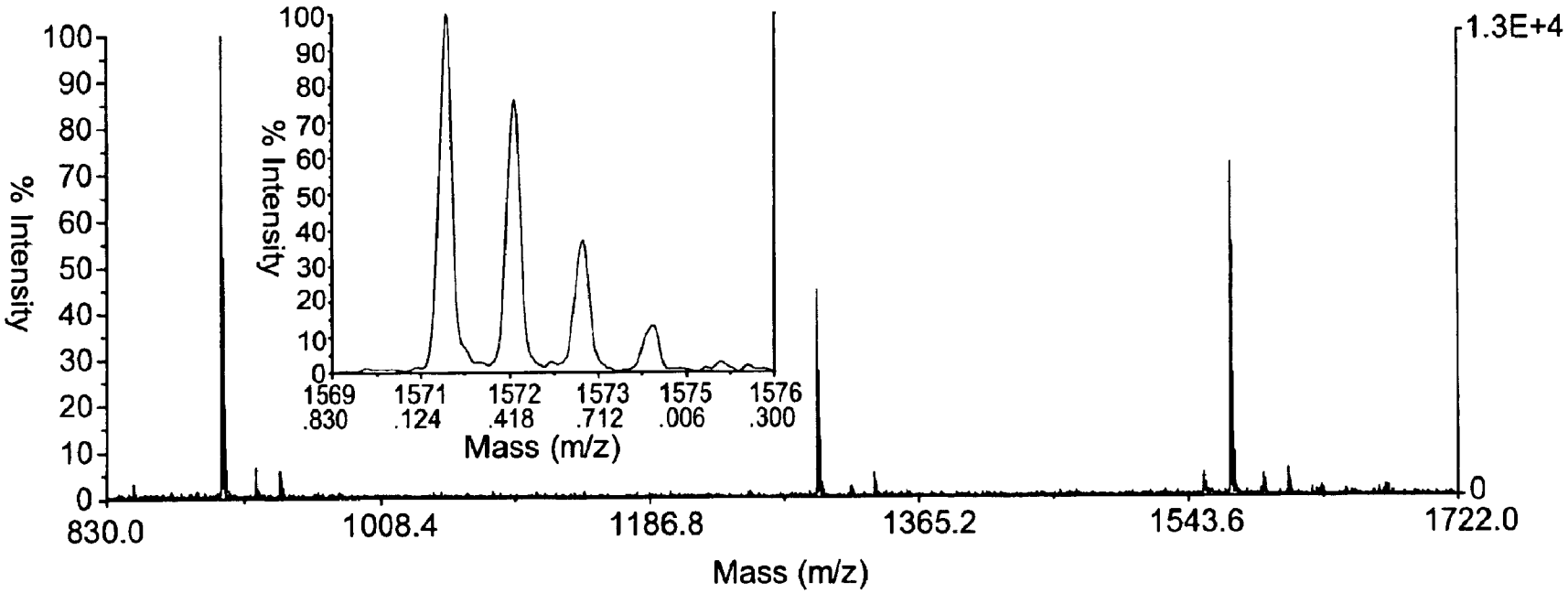
FIG. 56 is a mass spectrum of Calmix I off stainless steel plate, with $_{\alpha}$-CHCA matrix.

The positive-ion MALDI mass spectrum for the same analyte and matrix combination using the commercially available standard stainless steel metal plate is shown in FIG. 56. The operating conditions used with the metal plate were similar to the conditions used with the polypropylene TYPE A microstructured films. The signal to noise was comparable with the performance achieved using the aluminum coated PPTYPE A microstructured film.

Figure 57:
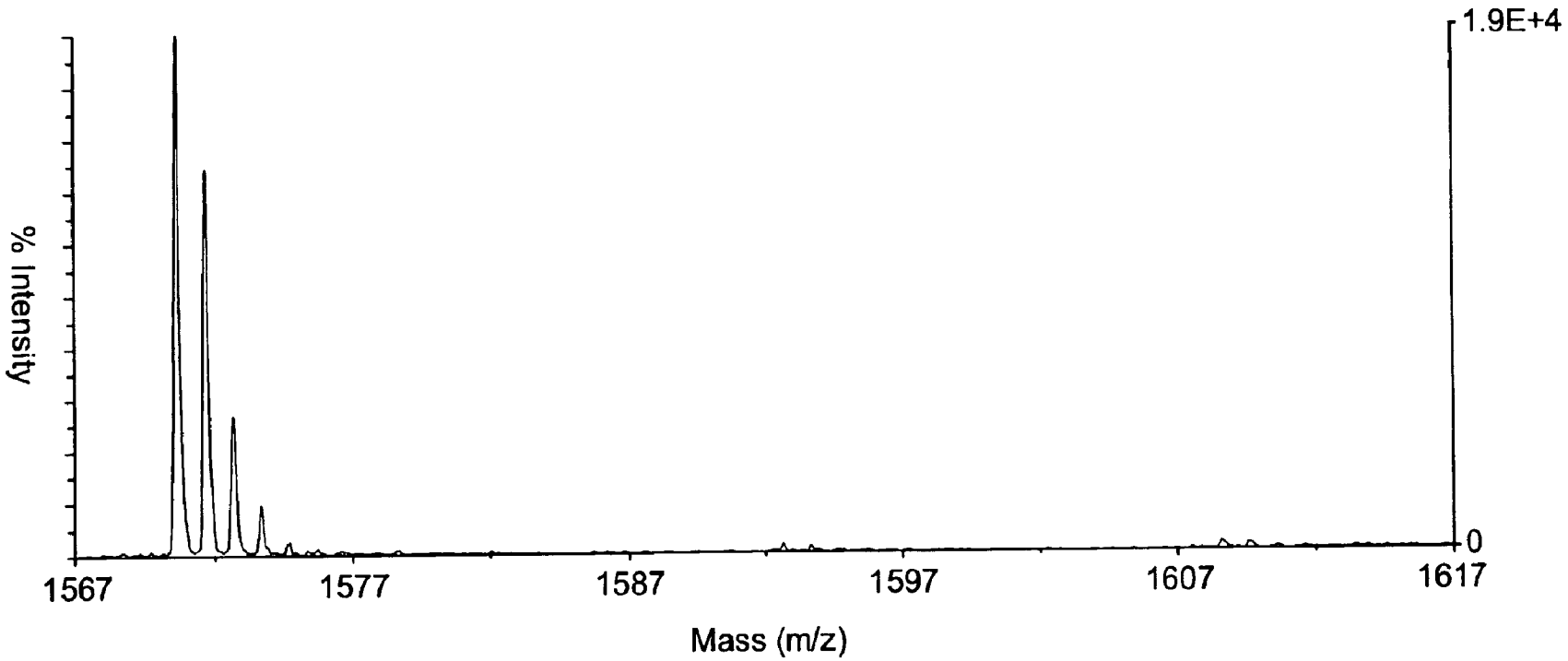
FIG. 57 is an expanded mass spectrum of Calmix I off polypropylene with microstructured surface TYPE A and an aluminum film, with $_{\alpha}$-CHCA matrix.
Figure 58:
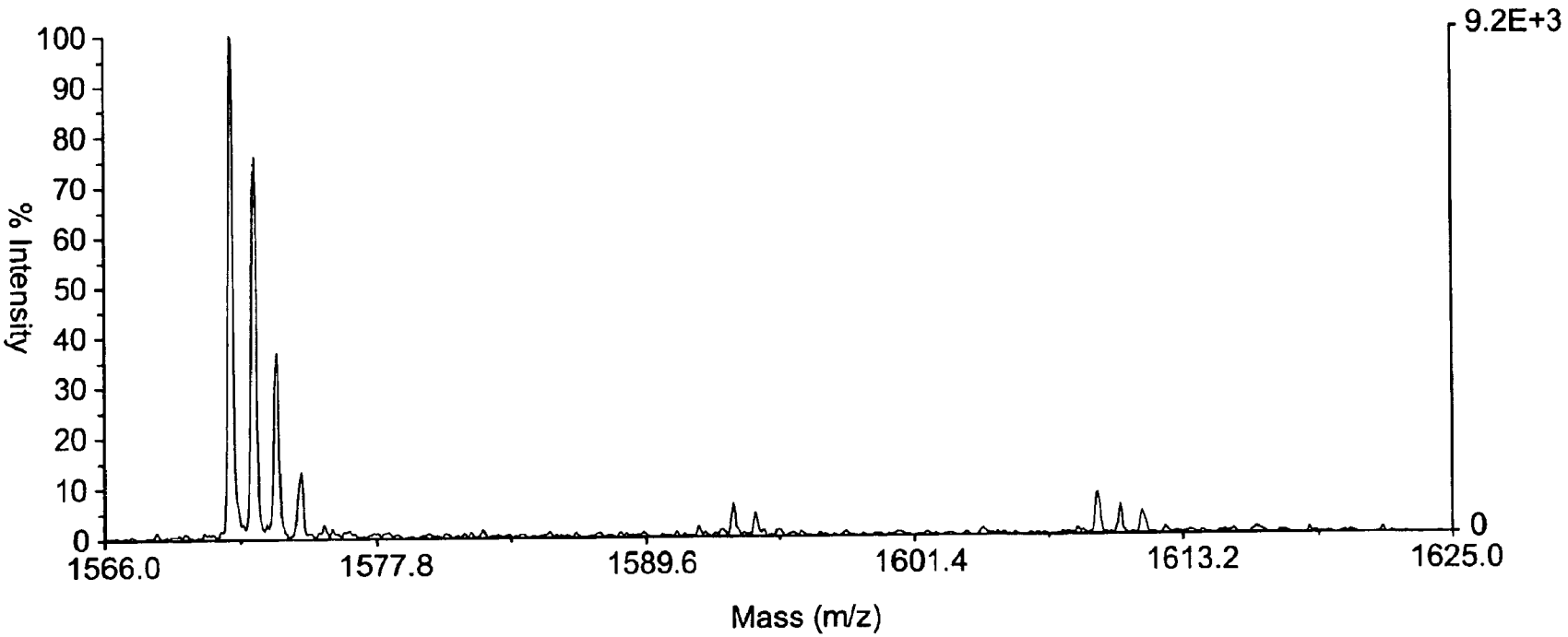
FIG. 58 is an expanded mass spectrum of Calmix I off Stainless Steel Plate, with $_{\alpha}$-CHCA matrix.

Although protonated molecular ions are the primary ionic species produced in the laser desorption/ionization process, sodium and potassium cationized species can also be formed. Close-up examination of the molecular ion region of Glu-Fibrinopeptide B from the stainless steel plate versus the microstructured film shows that cationization is significantly reduced when the microstructured film is used, as revealed in comparing FIGS. 57 and 58.

In contrast to the conventional metal plates, for which the best signal was found at the edge of the dried droplet, for the microstructured film the signal was much more uniform across the dried droplet.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description.

We claim:

1. A microstructured polymeric article comprising:

a polymeric substrate having a first surface;

a plurality of microstructures on the first surface of the polymeric substrate, the microstructures having at least two dimensions with a maximum characteristic length of 200 microns; and a coating over at least a portion of the plurality of microstructures;

wherein the polymeric article is configured for receiving of analytes and subsequent desorption of the analytes, and wherein the microstructures have a density of at least 100,000 per square centimeter.

2. The microstructured polymeric article of claim 1, wherein the coating is substantially nonvolatile.

3. The microstructured polymeric article of claim 1, wherein the article comprises at least two coatings over a portion of the plurality of microstructures.

4. The microstructured polymeric article of claim 3, wherein at least one coating comprises a metal or metal oxide.

5. The microstructured polymeric article of claim 3, wherein at least one coating comprises a metal or metal oxide and at least one coating comprises diamond like glass.

6. The microstructured polymeric article of claim 3, wherein at least one coating is hydrophilic.

7. The microstructured polymeric article of claim 1, wherein the coating comprises particles.

8. The microstructured polymeric substrate of claim 1, wherein the polymeric substrate comprises a thermoplastic material.

9. The microstructured polymeric substrate of claim 1, wherein the polymeric substrate is selected from the group consisting of polycarbonate and polypropylene.

10. The microstructured polymeric substrate of claim 1, wherein the polymeric substrate comprises a composite polymeric material.

11. The microstructured polymeric substrate of claim 1, wherein the polymeric substrate comprises a mixture of polymers.

12. The microstructured polymeric substrate of claim 1, wherein the microstructures have a density of at least 2500 microstructures per $mm^2$.

13. The microstructured polymeric substrate of claim 1, wherein the coating comprises graphite.

14. The microstructured polymeric substrate of claim 1, wherein the coating comprises metal or metal oxide layer on the polymeric substrate.

15. The microstructured polymeric substrate of claim 1,wherein the coating comprises diamond-like glass.

16. The microstructured polymeric substrate of claim 1, wherein the coating over the plurality of microstructures is present in a discontinuous pattern.

17. The microstructured polymeric substrate of claim 16, wherein the discontinuous pattern comprises spots, and wherein the spots are configured to receive and contain analytes.

18. The microstructured polymeric substrate of claim 17, wherein the spots are treated to provide increased hydrophilicity.

19. The microstructured polymeric substrate of claim 17, wherein the substrate is configured and arranged for holding a sample during mass spectrography analysis.

20. A device for receiving a sample of analyte material, the device comprising:

a substrate having a substantially nonporous analyte-receiving surface; and a plurality of microstructures configured and arranged for desorption of the analyte, wherein the microstructures have at least two dimensions with a maximum characteristic length of 200 microns and wherein the microstructures have a density of at least 100,000 per square centimeter.

21. The device of claim 20, wherein the substrate comprises a polymeric material.

22. The device of claim 20, wherein the analyte-receiving surface comprises metal or metal oxide.

23. The device of claim 20, wherein the analyte-receiving surface comprises graphite.

24. The device of claim 20, wherein the analyte-receiving surface comprises diamond-like glass.

25. The device of claim 20, further comprising a metal layer present on the polymeric substrate and diamond-like glass on the metal layer between the polymeric substrate and the diamond-like glass.

26. The device of claim 20, further comprising a discontinuous coating superimposed on the microstructures.

27. The device of claim 20, further comprising an identifying means.

28. The device of claim 20, further comprising an identifying bar code.

29. The device of claim 20, further comprising an identifying radio frequency identification tag.

30. A device for receiving a sample of analyte material, the device comprising at least two layers, the layers comprising:

a first layer of a polymeric substrate; and a second layer of a substantially nonvolatile material, the second layer positioned on top of the first layer to form an upper surface of the substrate;

wherein the upper surface of the substrate comprises a plurality of structures configured and arranged to promote desorption of the analyte material, wherein the structures have at least two dimensions with a maximum characteristic length of 200 microns and a density of at least 100,000 per square centimeter.

31. The device for receiving a sample of analyte material of claim 30, wherein the polymeric substrate is substantially non-porous.

32. The device for receiving a sample of analyte material of claim 30, wherein the second layer comprises a metal or metal oxide.

33. A device for receiving a sample of analyte material, the device comprising:

a substantially non-porous polymeric substrate having a first surface;

a plurality of microstructures positioned on the first surface of the polymeric substrate; and a nonvolatile layer present on the plurality of microstructures positioned on the first surface of the polymeric substrate, wherein the microstructures have a density of at least 100,000 per square centimeter.

34. The device for receiving a sample of analyte material of claim 33, wherein the substrate is configured for receiving and subsequent desorption of analytes.

35. A microstructured polymeric article comprising:

a polymeric substrate having a first surface;

a plurality of structures on the polymeric substrate, the structures having a characteristic dimension of at least 100 microns;

a plurality of microstructures on the first surface of the polymeric substrate, the microstructures arranged within the structures and being at least 50 percent smaller than the structures; and a coating over at least a portion of the plurality of structures and plurality of microstructures.

wherein the polymeric article is configured for receiving of analytes and subsequent desorption of the analytes.

36. The microstructured polymeric article of claim 35, wherein the microstructures have at least two dimensions with a maximum characteristic length of less than 50 microns.

37. The microstructured polymeric article of claim 35, wherein the coating comprises metal or a metal oxide.

38. The microstructured polymeric article of claim 35, wherein the substrate comprises polycarbonate or polypropylene.

39. A method of analyzing a material in the absence of matrix, the method comprising:

providing an analyte material;

providing a non-porous microstructured substrate, wherein the microstructures have at least two dimensions with a maximum characteristic length of 200 microns and a density of at least 100,000 per square centimeter;

depositing the analyte material on the non-porous substrate in the absence of a matrix; and exposing the analyte material to an energy source to desorb the analyte material.

40. The method of claim 39, wherein the energy source comprises a laser beam.

41. The method of claim 39, wherein non-porous substrate further comprises a coating of a metal or a metal oxide.

42. The method of claim 39, wherein the non-porous substrate comprises polycarbonate or polypropylene.

* * * * *

UNITED STATES PATENT AND TRADEMARK OFFICE

CERTIFICATE OF CORRECTION

PATENT NO. : 7,105,809 B2 
APPLICATION NO. : 10/299962
DATED : September 12, 2006
INVENTOR(S) : Kenneth B. Wood It is certified that error appears in the above-identified patent and that said Letters Patent is hereby corrected as shown below:

Title Page (56)
First Page,
Col. 2, (Other Publications), Line 11, After "Manufacturing"" delete "." and insert --,--, therefor.
Col. 2, (Other Publications), Line 15, After "Application"" delete "." and insert -- , --, therefor.

Column 2,
Line 67, Delete "derivativess," and insert -- derivatives, --, therefor.

Column 5,
Line 57 (approx.), Delete "$_{\alpha}$-CHCA" and insert -- α-CHCA --, therefor.
Line 59 (approx.), Delete "$_{\alpha}$-CHCA" and insert -- α-CHCA --, therefor.
Line 62 (approx.), Delete "$_{\alpha}$-CHCA" and insert -- α-CHCA --, therefor.
Line 65 (approx.), Delete "$_{\alpha}$-CHCA" and insert -- α-CHCA --, therefor.

Column 6,
Line 41, Delete "nano-structured and insert -- nanostructured --, therefor.

Column 7,
Line 17, Delete "fims" and insert -- films --, therefor.
Line 19, After "one" delete "one".

Column 10,
Line 47, Delete "inlcuding" and insert -- including --, therefor.

Column 13,
Line 16, After "10/183,122" insert -- (Docket No. 57837US02) --.
Line 18, After "10/183,121" insert -- (Docket No. 57838US02), --.

Column 20,
Line 44 (approx.), After "aluminum" insert -- . --.
Line 46, Delete "(PerSeptive" and insert -- (Perseptive --, therefor.

Column 22,
Line 13, In Claim 15, delete "1,wherein" and insert --1, wherein --, therefor.
Line 34 (approx.), In Claim 20, after "microns" insert -- , --.

UNITED STATES PATENT AND TRADEMARK OFFICE

CERTIFICATE OF CORRECTION

PATENT NO. : 7,105,809 B2
APPLICATION NO. : 10/299962
DATED : September 12, 2006
INVENTOR(S) : Kenneth B. Wood It is certified that error appears in the above-identified patent and that said Letters Patent is hereby corrected as shown below:

Column 23,
Line 34, In Claim 35, after "microstructures" delete "." and insert -- , --, therefor.

Signed and Sealed this

Second Day of January, 2007

JON W. DUDAS
*Director of the United States Patent and Trademark Office*